US008172380B2

(12) United States Patent
Takata

(10) Patent No.: US 8,172,380 B2
(45) Date of Patent: May 8, 2012

(54) DUAL CHAMBER, LIQUID APPARATUS HAVING LIQUID PERMEABILITY

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 475 days.

(21) Appl. No.: 12/243,613

(22) Filed: Oct. 1, 2008

(65) Prior Publication Data

US 2009/0085989 A1 Apr. 2, 2009

(30) Foreign Application Priority Data

Oct. 1, 2007 (JP) ..... 2007-258148
Oct. 1, 2007 (JP) ..... 2007-258149

(51) Int. Cl.
*B41J 2/175* (2006.01)

(52) U.S. Cl. ..... 347/86; 347/84

(58) Field of Classification Search ..... 347/6, 7, 347/84–86, 37

See application file for complete search history.

(56) References Cited

U.S. PATENT DOCUMENTS

| | | | | |
|---|---|---|---|---|
| 4,190,846 | A * | 2/1980 | Yamamoto et al. | 347/7 |
| 4,412,233 | A * | 10/1983 | Thomas et al. | 347/85 |
| 5,912,689 | A * | 6/1999 | Otsuka et al. | 347/86 |
| 6,003,965 | A * | 12/1999 | Arway et al. | 347/7 |
| 6,827,422 | B2 * | 12/2004 | Horie | 347/29 |
| 7,033,006 | B2 * | 4/2006 | Ebisawa et al. | 347/85 |
| 7,273,271 | B2 * | 9/2007 | Shiho et al. | 347/85 |
| 7,293,866 | B2 * | 11/2007 | Miyazawa et al. | 347/86 |
| 7,470,009 | B2 * | 12/2008 | Suda et al. | 347/85 |
| 7,914,101 | B2 * | 3/2011 | Ohashi et al. | 347/19 |
| 7,992,955 | B2 * | 8/2011 | Takata | 347/18 |
| 2008/0170108 | A1 * | 7/2008 | Lee et al. | 347/85 |
| 2008/0239028 | A1 * | 10/2008 | Umeda | 347/85 |
| 2009/0219354 | A1 * | 9/2009 | Rittgers et al. | 347/86 |

FOREIGN PATENT DOCUMENTS

| | | | |
|---|---|---|---|
| JP | S57-83488 | A | 5/1982 |
| JP | S59-137037 | U | 9/1984 |
| JP | S62-236748 | A | 10/1987 |

(Continued)

OTHER PUBLICATIONS

Japan Patent Office, Notification of Reasons for Refusal for Japanese Patent Application No. 2007-258148 (counterpart to above-captioned patent application), dispatched Nov. 29, 2011.

(Continued)

*Primary Examiner* — Julian Huffman
*Assistant Examiner* — Sharon A Polk
(74) *Attorney, Agent, or Firm* — Baker Botts L.L.P.

(57) ABSTRACT

A liquid discharge apparatus is provided. The liquid discharge apparatus includes a discharge head that discharges a first liquid supplied via a liquid supply tube from a liquid tank, wherein the liquid tank has a first liquid reservoir chamber that stores the first liquid and a second liquid reservoir chamber that stores a second liquid whose solvent is the same as that of the first liquid and whose concentration is lower than that of the first liquid, the liquid tank is partitioned by a partition wall that partitions an inside into the first liquid reservoir chamber and the second liquid reservoir chamber, and at least a part of the partition wall has liquid permeability and a solvent for the second liquid stored in the second liquid reservoir chamber is capable of permeating the inside of the first liquid reservoir chamber via the partition wall.

19 Claims, 33 Drawing Sheets

FOREIGN PATENT DOCUMENTS

| | | | |
|---|---|---|---|
| JP | H01-156073 | A | 6/1989 |
| JP | H11-56073 | A | 6/1989 |
| JP | H02-111555 | A | 4/1990 |
| JP | 2002-248789 | A | 9/2002 |
| JP | 2003-054011 | A | 2/2003 |
| JP | 2007-245655 | A | 9/2007 |

OTHER PUBLICATIONS

Japan Patent Office, Notification of Reasons for Refusal for Japanese Patent Application No. 2007-258149 (counterpart to above-captioned patent application), dispatched Nov. 29, 2011.

* cited by examiner

DUAL CHAMBER, LIQUID APPARATUS HAVING LIQUID PERMEABILITY

CROSS REFERENCE TO RELATED APPLICATION

The present application claims priority from Japanese Patent Application No. 2007-258148, which was filed on Oct. 1, 2007, and Japanese Patent Application No. 2007-258149, which was filed on Oct. 1, 2007, the disclosures of which are herein incorporated by reference in its entirety.

TECHNICAL FIELD

The present invention relates to a liquid discharging apparatus that includes a discharge head that discharges liquid such as ink supplied from a liquid tank.

BACKGROUND

As one of the systems supplying liquid to a discharge head of a liquid discharge apparatus such as an inkjet printer, there is a tube supply system. In a liquid discharge apparatus in this system, a liquid tank mounted to a main body of the liquid discharge apparatus and a discharge head that discharges liquid to be supplied are always connected by a liquid supply tube, and when a liquid is discharged from the discharge head, the liquid stored in the liquid tank is continually supplied to the discharge head via the liquid supply tube.

The liquid supply tube contacts the outside air inside the main body of the liquid discharge apparatus, and the inside of the liquid supply tube is filled with liquid even when the liquid discharge apparatus is made to pause. Therefore, when the pause of the apparatus persists for a long period of time, the liquid evaporates via the liquid supply tube to increase the viscosity of the liquid. With this increase in the viscosity, it is impossible to stably perform a liquid discharge operation such that the liquid cannot be discharged from the discharge head at a predetermined discharge amount or the like. Accordingly, for the tube supply system liquid discharge apparatuses, various types of structures for liquid supply tubes to prevent liquid from evaporating have been proposed (refer to Patent Documents 1 and 2, for example).

The patent document 1 discloses a liquid supply tube including an inner tube which is formed of a material with low moisture permeability to circulate liquid, and an outer tube which is formed of a material with low air permeability to contact the outside air.

With this liquid supply tube, it is possible to prevent the liquid from evaporating outward via the inner tube, and prevent the outside air from invading the inner tube via the outer tube.

The patent document 2 discloses a liquid supply tube composed of an internal pipe and an external pipe, and a nonvolatile silicon oil fills between the internal pipe and the external pipe. In accordance with this structure, the silicon oil functions to prevent liquid from permeating through those, which makes it possible to reduce an evaporation rate of the liquid.

[Patent Document 1] Japanese Published Unexamined Patent Application No. Hei2-111555

[Patent Document 2] Japanese Published Examined Patent Application No. Hei2-2709 (Japanese Published Unexamined Patent Application No. Sho57-83488)

SUMMARY

However, in both Patent Documents 1 and 2, liquid evaporation via the liquid supply tube is merely prevented, and liquid evaporation itself cannot be completely stopped.

Therefore, when a pause of the liquid discharge apparatus persists for a long period of time, an increase in the viscosity of the liquid due to the evaporation still appears, which may have an influence on the printing quality.

The present invention has been achieved in consideration of such circumstances, and an object of the present invention is to provide a liquid discharge apparatus capable of stably performing a discharge operation even when liquid evaporation occurs.

According to an exemplary embodiment of the present invention, there is provided a liquid discharge apparatus comprising a discharge head that discharges a first liquid supplied via a liquid supply tube from a liquid tank, wherein the liquid tank has a first liquid reservoir chamber that stores the first liquid and a second liquid reservoir chamber that stores a second liquid whose solvent is the same as that of the first liquid and whose concentration is lower than that of the first liquid, the liquid tank is partitioned by a partition wall that partitions an inside into the first liquid reservoir chamber and the second liquid reservoir chamber, and at least a part of the partition wall has liquid permeability and a solvent for the second liquid stored in the second liquid reservoir chamber is capable of permeating the inside of the first liquid reservoir chamber via the partition wall.

According to another exemplary embodiment of the present invention, a liquid discharge apparatus comprising a discharge head that discharges a first liquid; a liquid supply tube that supplies the first liquid to the discharge head from a liquid tank storing the first liquid; and a liquid circulation path through which a second liquid whose solvent is the same as that of the first liquid and whose concentration is lower than that of the first liquid is circulated, wherein the liquid supply tube has liquid permeability, the liquid circulation path is configured to surround at least a part of the liquid supply tube, the second liquid circulating in the liquid circulation path circulates while contacting the outer surface of the liquid supply tube, and a solvent for the second liquid is capable of permeating the liquid supply tube.

Further, according to another exemplary embodiment of the present invention, A liquid tank for storing a first liquid to be supplied to a discharge head via a liquid supply tube, comprising a first liquid reservoir chamber that stores the first liquid, a second liquid reservoir chamber that stores a second liquid whose solvent is the same as that of the first liquid and whose concentration is lower than that of the first liquid, and a partition wall that partitions an inside of the liquid tank into the first liquid reservoir chamber and the second liquid reservoir chamber, wherein at least a part of the partition wall has liquid permeability and a solvent for the second liquid stored in the second liquid reservoir chamber is capable of permeating the inside of the first liquid reservoir chamber via the partition wall.

BRIEF DESCRIPTION OF THE DRAWINGS

Illustrative aspects of the invention will be described in detail with reference to the following figures wherein:

FIG. 5 is a sectional view illustrating the internal structure of an ink cartridge of a second embodiment.

FIG. 15 is an action diagram for explanation of an operation for circulating a coolant in the fifth invention.

FIG. 23 is a sectional view illustrating the internal structure of an ink cartridge of a ninth embodiment, FIG. 23B shows a state in which the ink cartridge is mounted on;

FIG. 33 is an action diagram for explanation of an operation for circulating the coolant in the twelfth embodiment.

DETAILED DESCRIPTION OF EXEMPLARY EMBODIMENTS OF THE PRESENT INVENTION

Preferred embodiments of the present invention will be hereinafter described with reference to the accompanying drawings.

Figure 1:
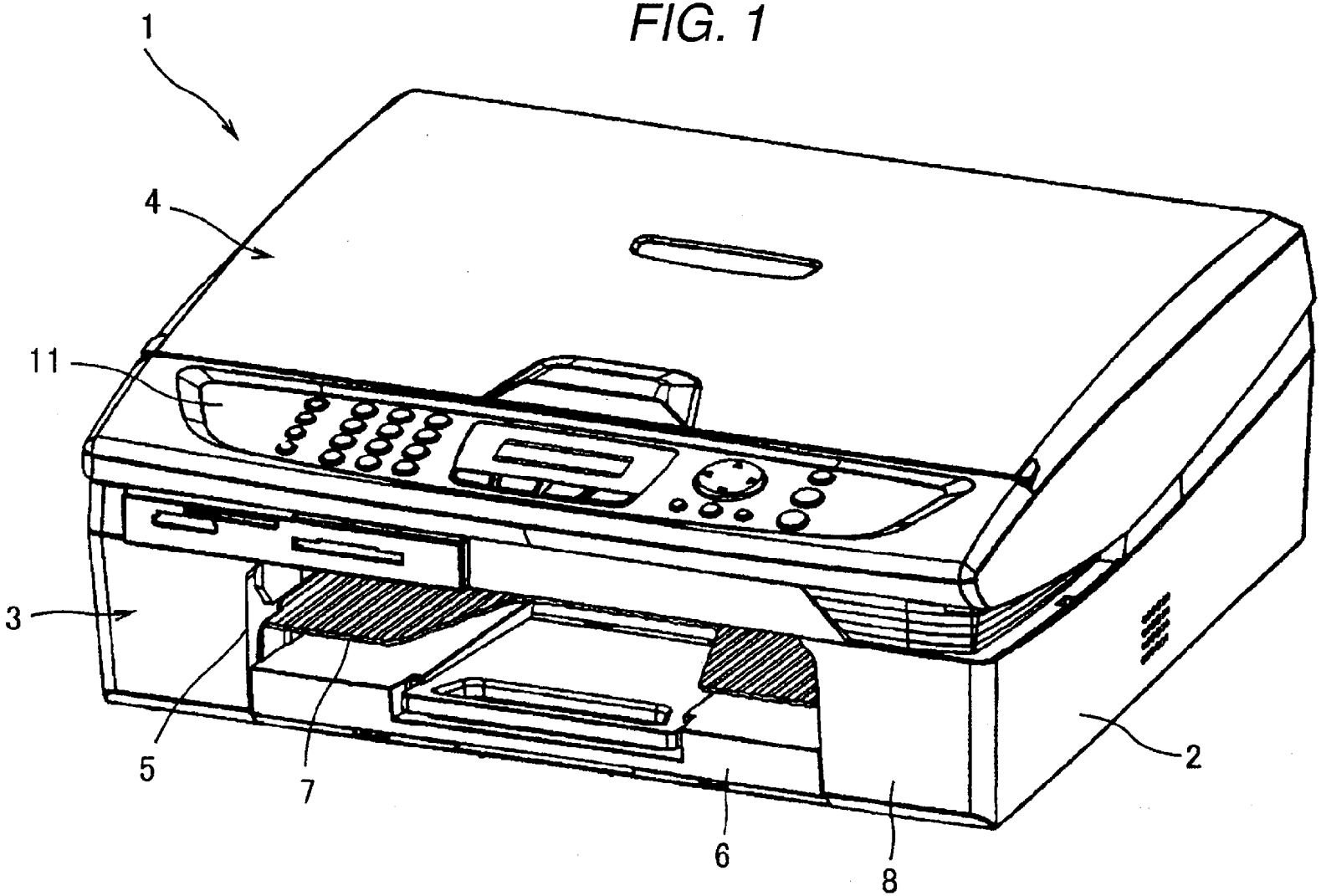
FIG. 1 is a perspective view of a multifunctional device having a printer of a first embodiment shown as one example of a liquid discharge apparatus according to the present invention.

FIG. 1 is a perspective view of a multifunctional device 1 having a printer 3 of a first embodiment shown as one example of a liquid discharge apparatus according to the present invention. As shown in FIG. 1, the multifunctional device 1 has a printer function, a scanner function, a copy function, and a facsimile function, and includes a substantially rectangular parallelepiped housing 2 forming a main body outer shape of the multifunctional device 1. The printer (liquid discharge apparatus) 3 that performs a printing operation in an inkjet system is provided at the lower portion of the housing 2, and a scanner 4 is provided at the upper portion of the housing 2. An opening 5 is formed in the front face of the housing 2, and a sheet feeding tray 6 and a sheet discharging tray 7 which are respectively capable of containing recording sheets serving as recording media are provided so as to be overlapped above and below. A door 8 is attached so as to be openable and closable to the right lower portion at the front face side of the housing 2, and a cartridge mounting part 9 (refer to FIGS. 2 and 3) is provided inside the door 8. When the door 8 is opened, the cartridge mounting part 9 is exposed to the front face side, which allows ink cartridges (liquid tanks) 10 (refer to FIGS. 2 and 3) storing ink (a first liquid) therein to be attachable and detachable. An operation panel 11 on which an operator operates the multifunctional device 1 is provided on the upper portion of the front face side of the housing 2.

Figure 2:
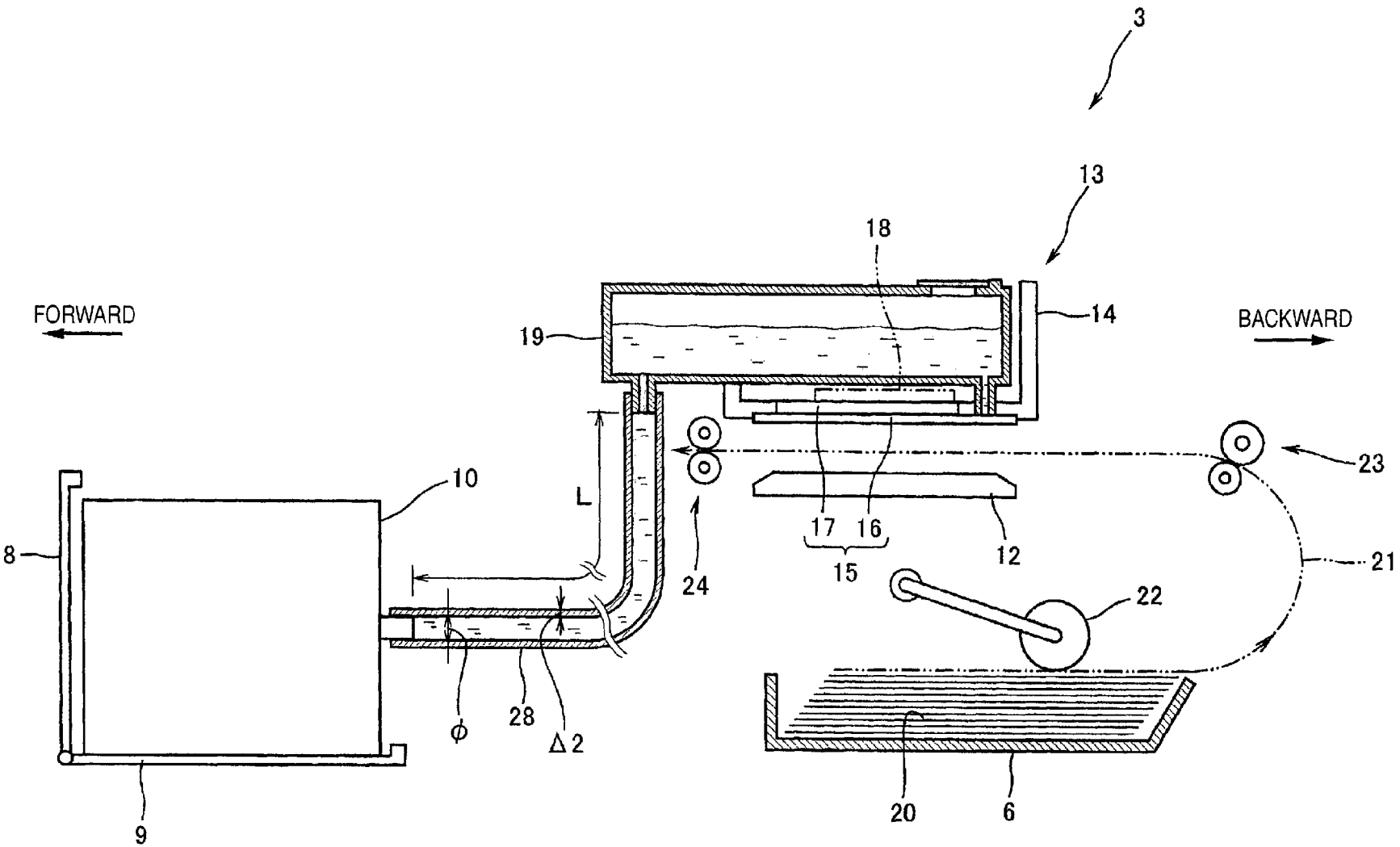
FIG. 2 is a schematic diagram illustrating the schematic structure of the printer of the first embodiment in a lateral view.

FIG. 2 is a schematic diagram illustrating the schematic structure of the printer 3 of the first embodiment in a lateral view. As shown in FIG. 2, in the housing 2, a platen 12 is provided above the sheet feeding tray 6, and an image recording unit 13 is provided above the platen 12.

The image recording unit 13 is formed such that a discharge head 15 that discharges ink and the like are loaded on a carriage 14. The discharge head 15 is composed of a cavity unit 16 having an internal ink channel (not shown) and a nozzle hole forming a downstream end opening of the ink channel, and a piezoelectric actuator 17 that imparts a discharge pressure to the ink in the ink channel. The discharge head 15 is attached to the outer bottom face of the carriage 14, and the opening surface of the nozzle hole in the cavity unit 16 is directed downward. When the piezoelectric actuator 17 operates, a discharge pressure is imparted to the ink in the ink channel, and ink in an amount according to the discharge pressure and the viscosity of the ink is discharged from the nozzle hole.

Moreover, an IC chip 18 in which a circuit to control the driving of the piezoelectric actuator 17 is built-in and an ink sub-tank 19 which is capable of storing ink therein and is communicated with the upstream end opening of the ink channel of the cavity unit 16 are loaded on the carriage 14.

A feed roller 22 that feeds a recording sheet 20 in the sheet feeding tray 6 to a conveyance path 21 is provided directly above the sheet feeding tray 6. The conveyance path 21 goes upward from the back face side of the sheet feeding tray 6 to turn around toward the front face side, and passes through between the platen 12 and the image recording unit 13 to connect to the sheet discharging tray 7 (refer to FIG. 1). A conveying roller pair 23 that pinches and conveys the recording sheet 20 flowing in the conveyance path 21 onto the platen 12 is provided at the back face side of the platen 12, and a discharge roller pair 24 that pinches and conveys the recording sheet 20 which has been printed to the sheet discharging tray 7 is provided at the front face side of the image recording unit 13.

Figure 3:
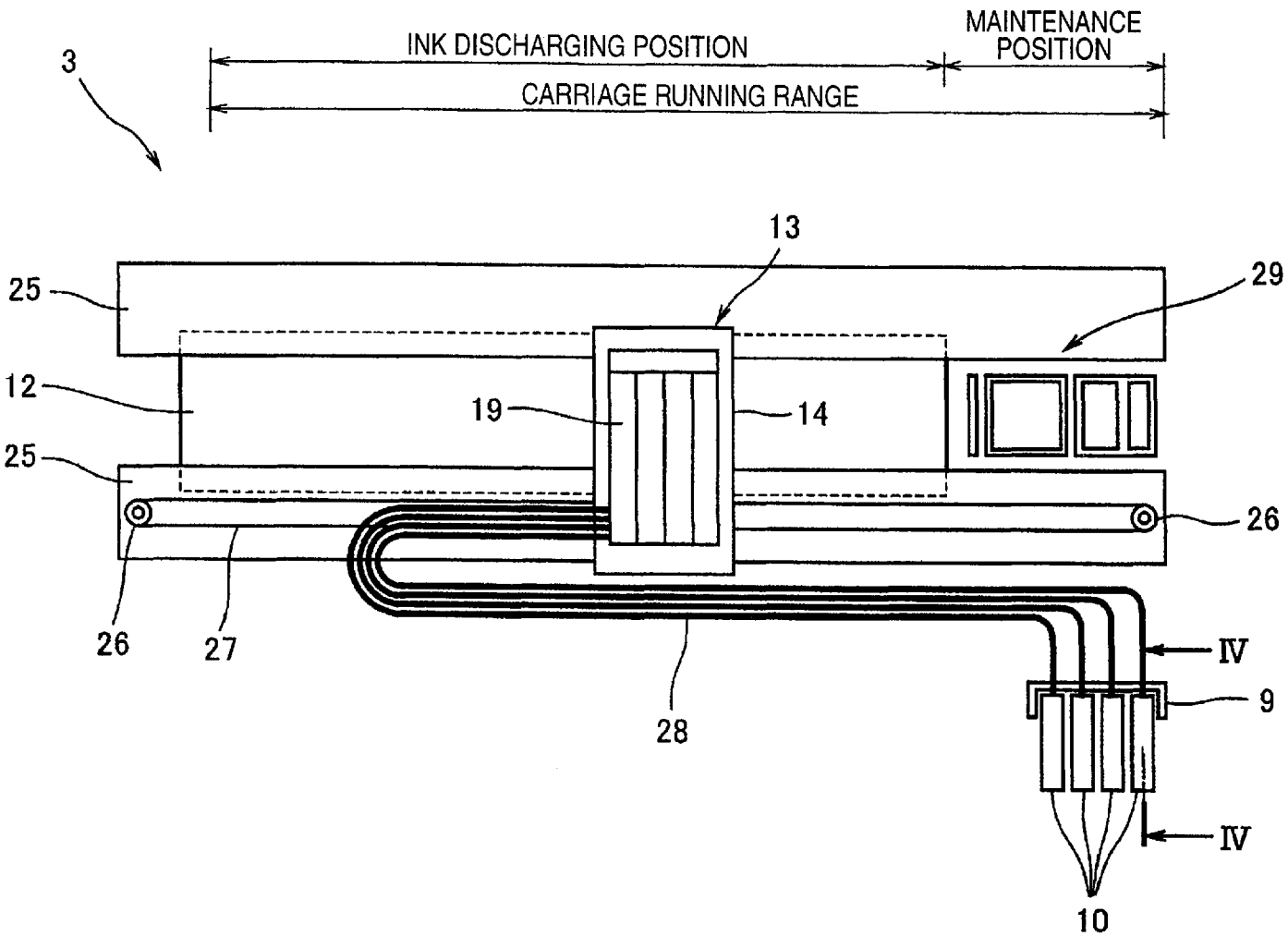
FIG. 3 is a schematic diagram illustrating the schematic structure of the printer of the first embodiment in a plan view.

FIG. 3 is a schematic diagram illustrating the schematic structure of the printer 3 of the first embodiment in a plan view. As shown in FIG. 3, a pair of front and rear guide rails 25 and 25 extending parallel from side to side is provided above the platen 12. The carriage 14 of the image recording unit 13 is supported so as to be capable of reciprocating from side to side (in a running direction) on the guide rails 25. The image recording unit 13 is connected to a timing belt 27 wound around a pair of pulleys 26 and 26, and the timing belt 27 is installed to be parallel to the extending direction of the guide rail 25. A motor (not shown) driven to rotate positively and negatively is provided at one of the pulleys 26 and 26, and the timing belt 27 reciprocates due to the pulley 26 being driven to rotate positively and negatively, and the image recording unit 13 is made to move along the guide rails 25.

The cartridge mounting part 9 is disposed on the right side of the platen 12, and the ink cartridges 10 are mounted onto the cartridge mounting part 9 so as to be detachable and replaceable. The printer 3 is capable of performing full-color printing by using four color inks (cyan, magenta, yellow, and black inks), and the four ink cartridges 10 storing the respective color inks therein are mounted so as to be arrayed from side to side to the cartridge mounting part 9. The ink sub-tanks 19 corresponding to the number of the ink cartridges 10 are provided at the carriage 14.

Ink supply tubes 28 (liquid supply pipes) to supply the inks in the ink cartridges 10 to the discharge head 15 loaded on the carriage 14 are installed between the respective ink cartridges 10 and the carriage 14 inside the housing 2. As shown in FIG. 2, the ink supply tubes 28 are connected to the ink sub-tanks 19 to cause the ink cartridges 10 to be communicated with the ink sub-tanks 19.

The region above the platen 12 in the running range of the carriage 14 is an ink discharging position. The ink discharging position of the printer 3 has at least a predetermined region corresponding to a width dimension of a recording sheet, and the carriage 14 is made capable of reciprocating within this range. When the carriage 14 is within this ink discharging position, the ink is discharged in an appropriate timing during a running of the carriage 14 from the nozzle hole of the discharge head 15 toward a recording sheet which has been conveyed toward the front face side along the conveyance path 21 (refer to FIG. 2) (i.e., in a direction perpendicular to the running direction of the carriage 14) to reach on the platen 12, which makes it possible to perform a printing operation to print images and characters on the recording sheet.

Note that the right side of the ink discharging position in the running range of the carriage 14 is a maintenance position. When the carriage 14 is at this maintenance position, by utilizing a maintenance unit 29 provided on the right side of the platen 12, it is possible to perform a wiping operation of wiping the opening surface of the nozzle hole of the discharge head 15, a flushing operation of discharging ink in order to fix the opening surface of the nozzle hole after wiping, and a purge operation of sucking dried ink, foreign matter, and the like from the nozzle hole by negative pressure.

When the ink in the discharge head 15 is consumed by a printing operation, a flushing operation, or a purge operation, the inks in the ink sub-tanks 19 are supplied to the ink channel of the discharge head 15, and the inks in the ink cartridges 10 are supplied to the ink sub-tanks 19 via the ink supply tubes 28. In this way, the ink supply tubes 28 are always filled with inks.

Figure 4:
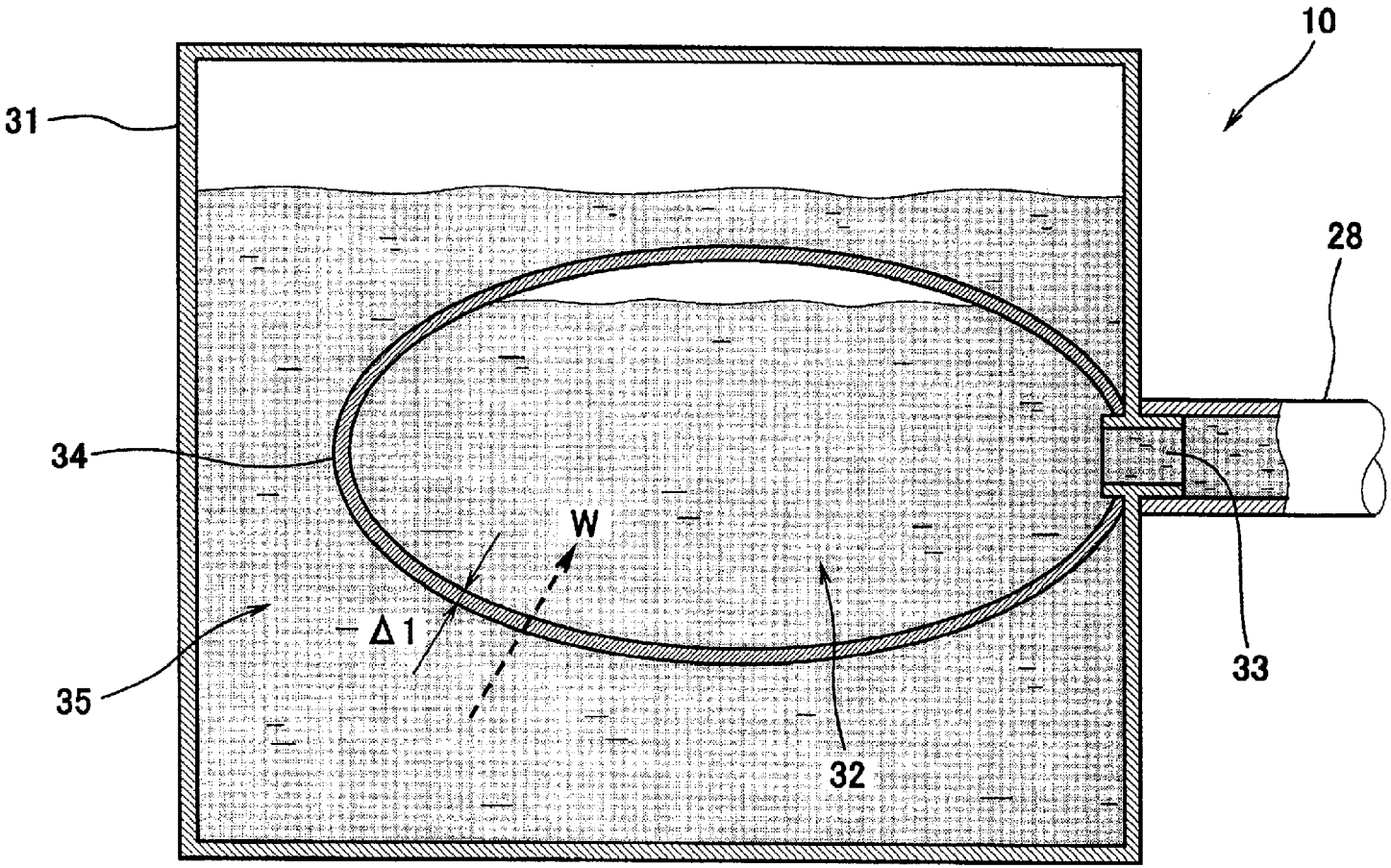
FIG. 4 is a view taken along the line connecting arrows IV and IV in FIG. 3, and a sectional view illustrating the internal structure of an ink cartridge according to the first embodiment.

FIG. 4 is a view taken along the line connecting arrows IV and IV in FIG. 3, and a sectional view illustrating the internal structure of the ink cartridge 10 in the first embodiment. The ink cartridge 10 has a rectangular parallelepiped casing 31 formed of a synthetic resin material, and an ink pack 34 (a partition wall) forming an ink reservoir chamber 32 (a first liquid reservoir chamber) is housed in the casing 31. An ink supply hole 33 through which the ink reservoir chamber 32 is communicated with the outside is provided at the casing 31, and when the cartridge 10 is mounted to the cartridge mounting part 9, an end of a cartridge side ink supply tube **28*a* is connected to the ink supply hole 33. A valve mechanism (not shown) which is usually closed and is connected to the end of the ink supply tube 28*a* to be opened is provided inside an ink supply hole 33 of the ink cartridge 10**.

Note that the ink pack 34 is formed of a film with moisture permeability such as a polystyrene film, a urethane film, or a polyolefin film. Further, the ink for the printer 3 is an aqueous ink, and the solvent thereof is water. A solid-phase component included in the ink increases the viscosity of the ink. Accordingly, the viscosity of the ink which is one of the factors having an influence on a discharge operation of the discharge head 15 varies so as to be greater as the concentration of the ink increases.

A water reservoir chamber 35 (a second liquid reservoir chamber) is formed at a space region outside the ink pack 34 in the casing 31, and an aqueous solution (a second liquid) using water as a solvent in the same way as the ink is stored in the water reservoir chamber 35. A preservative such as paraben is dissolved in the aqueous solution, which prevents the aqueous solution from changing in quality over a long period.

In this way, the ink cartridge 10 has the ink reservoir chamber 32 surrounded by the inner face of the ink pack 34, and the water reservoir chamber 35 surrounded by the outer face of the ink pack 34 and the inner face of the casing 31, and the both chambers 32 and 35 are partitioned with the permeable film forming the ink pack 34.

Where a molar concentration of the aqueous solution stored in the water reservoir chamber 35 is set to be less than a molar concentration of the ink in the ink reservoir chamber 32, osmotic pressure is generated in accordance with a concentration difference between the aqueous solution and the ink. Accordingly, as shown by dashed line arrow W, the water serving as the solvent for the aqueous solution stored in the water reservoir chamber 35 is made capable of permeating the inside of the ink reservoir chamber 32 via the ink pack 34.

In accordance with the concentration difference between the aqueous solution and the ink that determines osmotic pressure, a material and a thickness Δ1 (refer to FIG. 4) of the ink pack 34 that determine water permeable amounts per unit time and per unit area corresponding to the osmotic pressure, and an area of the region of the ink pack 34 partitioning the inside into the ink reservoir chamber 32 and the water reservoir chamber 35 (corresponding to the entire surface area of the ink pack 34 in the present embodiment), an amount of the water serving as the solvent for the aqueous solution in the water reservoir chamber 35, that permeates the inside of the ink reservoir chamber 32 via the ink pack 34 per unit time (a permeability rate) is determined. Note that the thickness Δ1 of the ink pack 34 and the water permeable amounts per unit time and per unit area corresponding to osmotic pressure are generally in an inversely proportional relationship. In this way, an amount of the water of the aqueous solution permeating per unit time is determined in accordance with a concentration difference between the aqueous solution and the ink, which is appropriately changeable and a specification of the ink pack 34.

In contrast thereto, the ink supply tube 28 is always filled with ink as described above, and at least a part thereof contacts the outside air inside the housing 2. The ink supply tube 28 is formed of a synthetic resin material, such as polypropylene, with low moisture permeability. However, the water serving as the solvent for the ink evaporates outward from the tube over time.

In accordance with a material of the ink supply tube 28 that determines the moisture permeability of the ink supply tube 28, a thickness Δ2 of the ink supply tube 28 (refer to FIG. 2) that determines the amounts of the water serving as the solvent for the ink evaporating per unit time and per unit area, and a surface area of the portion of the ink supply tube 28 contacting the outside air inside the housing 2, an amount of the water of the ink in the ink supply tube 28 evaporating outward from the tube per unit time (an evaporation rate) is determined. Note that the thickness Δ2 of the ink supply tube 28 and the amounts of the water of the ink evaporating per unit time and per unit area are generally in an inverse proportional relationship. Further, a surface area of the portion of the ink supply tube 28 contacting the outside air inside the housing 2 can be obtained by a length L (refer to FIG. 2) of the portion of the ink supply tube 28 contacting the outside air and a diameter ϕ (refer to FIG. 2) of the tube 28. In this way, an amount of the water of the ink evaporating per unit time is determined in accordance with a specification of the ink supply tube 28.

Accordingly, by taking into consideration the respective parameters with which a permeable amount of the water serving as the solvent for the aqueous solution per unit time is determined and the respective parameters with which an amount of evaporation of the water serving as the solvent for the ink per unit time is determined, it is possible to set these permeable amount and amount of evaporation to be equal.

In the printer 3 configured in this way, even in a case in which the water of the ink in the ink supply tube 28 evaporates, water equal to the amount of evaporation permeates the inside of the ink reservoir chamber 32. In accordance therewith, the concentration of the ink can be kept constant over a long period, and the viscosity of the ink can be kept constant over a long period.

Note that, because the solvent for the ink is water, and the solvent for the liquid stored in the water reservoir chamber 35 is water in the same way as the ink, even in a case in which the solvent for the liquid stored in the water reservoir chamber 35 permeates the ink reservoir chamber 32 via the film 34, the permeation merely has an influence on the concentration of the ink, but does not change the composition of the ink.

Next, a second embodiment of the present invention will be described. The second embodiment is different in an internal structure of the ink cartridge from the first embodiment. Note that structures which are the same as those of the first embodiment are denoted by the same reference numerals, and descriptions thereof will be simplified.

Figure 5A:
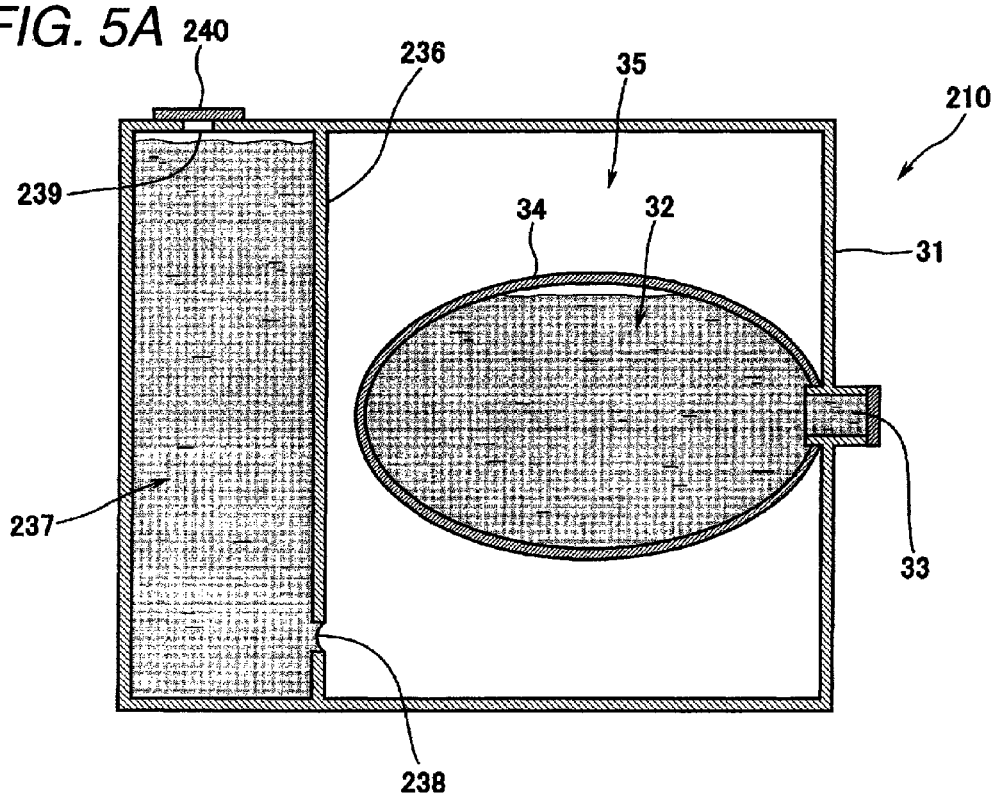
FIG. 5A shows a state before the ink cartridge is mounted.
Figure 5B:
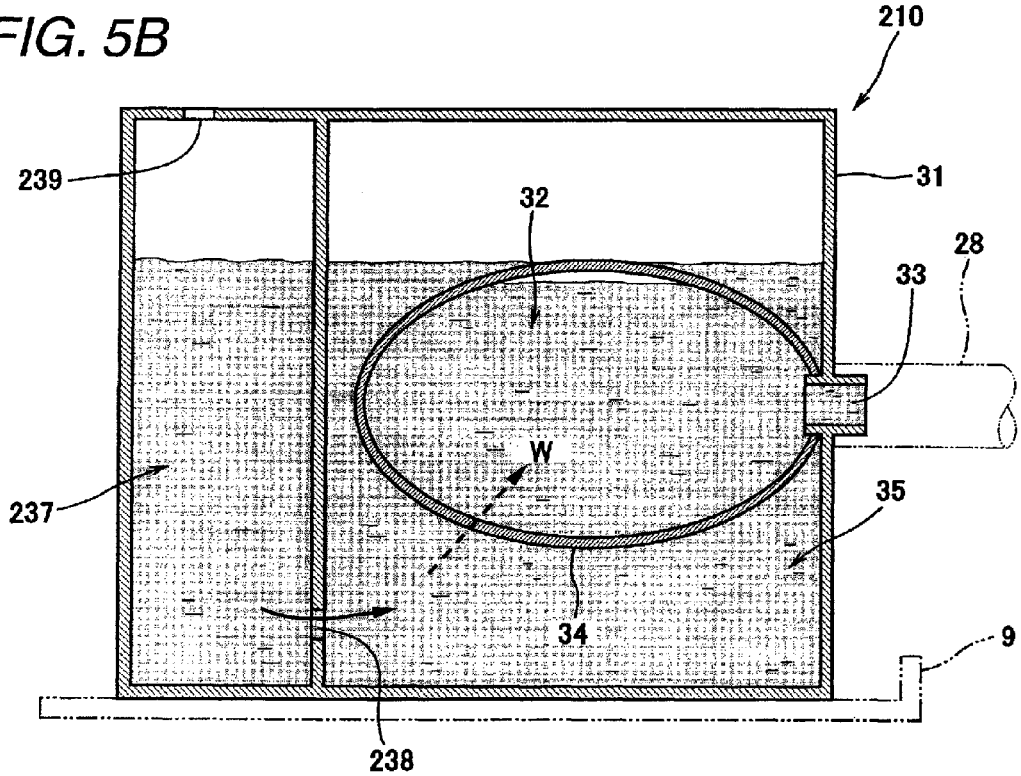
FIG. 5B shows a state in which the ink cartridge is mounted.

FIG. 5 is a sectional view illustrating the internal structure of an ink cartridge 210 according to the second embodiment. FIG. 5A shows a state before the ink cartridge 210 is mounted on the cartridge mounting part 9, and FIG. 5B shows a state in which the ink cartridge 210 is mounted on the cartridge mounting part 9. As shown in FIG. 5, a partition wall 236 that partitions the inside into the water reservoir chamber 35 and an initial water reservoir chamber 237 (an initial liquid reservoir chamber) is provided in the casing 31 of the ink cartridge 210. The inside of the casing 31 is divided into two in this way. However, the ink pack 34 is built in the water reservoir chamber 35, and the initial water reservoir chamber 237 forms a space isolated from the ink pack 34. The initial water reservoir chamber 237 is communicated with the water reservoir chamber 35 via a small opening 238 formed so as to pass through the partition wall 236, and is communicated with the atmosphere via an atmosphere communicating hole 239 formed in the casing 31. Further, in the same way as in the first embodiment, the ink supply hole 33 through which the ink reservoir chamber 32 is communicated with the outside is provided at the casing 31, and a valve mechanism (not shown) is provided in the ink supply hole 33.

At the time of manufacturing the ink cartridge 210, the ink reservoir chamber 32 is filled with an aqueous ink, and as shown in FIG. 5A, the inside of the initial water reservoir chamber 237 is filled with the aqueous solution described above, and the inner pressure in the water reservoir chamber 35 and the initial water reservoir chamber 237 is reduced to be negative pressure as compared with the atmosphere pressure. A seal 240 is bonded onto the outer face of the casing 31 so as to be easily detachable, and the atmosphere communicating hole 239 is sealed up with the seal 240, and the water reservoir chamber 35 and the initial water reservoir chamber 237 are maintained in a depressurized state. The small opening 238 is formed to be sufficiently small in order for the aqueous solution filling the inside of the initial water reservoir chamber 237 to form a meniscus by its surface tension, and in a state in which the seal 240 is bonded thereto, the aqueous solution in the initial water reservoir chamber 237 does not flow into the water reservoir chamber 35.

In contrast thereto, as shown in FIG. 5B, when the seal 240 is detached therefrom, the initial water reservoir chamber 237 is communicated with the atmosphere via the atmosphere communicating hole 239, and the inside of the initial water reservoir chamber 237 is made to have positive pressure as compared with that in the water reservoir chamber 35. In accordance therewith, the meniscus formed in the small opening 238 is broken, and the water in the initial water reservoir chamber 237 passes through the small opening 238 to flow into the water reservoir chamber 35.

In accordance with the ink cartridge 210 of the present embodiment, in a state in which the seal 240 is bonded thereto, water is stored in the initial water reservoir chamber 237 independent of the ink reservoir chamber 32, and the water does not permeate the inside of the ink reservoir chamber 32. After the seal 240 is detached therefrom, the aqueous solution flows into the water reservoir chamber 35, and as shown by the dashed line arrow W in FIG. 5B, the water serving as the solvent for the flowed aqueous solution is capable of permeating the inside of the ink reservoir chamber 32 via the ink pack 34. Accordingly, unless the seal 240 is not detached therefrom directly before the ink cartridge 210 is detached to be replaced, it is possible to prevent the water of the aqueous solution from permeating the inside of the ink reservoir chamber 32 during a period from the time of manufacturing it to the time of mounting it onto the cartridge mounting part 9. In this way, provided that the seal 240 is handled correctly, it is possible to keep the concentration of the ink stored in the ink reservoir chamber 32 in an appropriate state until the ink cartridge 210 is actually used.

Meanwhile, there is a lower limit which is zero to the concentration of the aqueous solution stored in the water reservoir chamber 35, which has a limit on the increase of a concentration difference between the ink and the aqueous solution. Further, it is difficult to secure a large area as the area of the region of the ink pack 34 partitioning the inside into the ink reservoir chamber 32 and the water reservoir chamber 35 due to the structural restrictions of the ink cartridges 10 and 210 as compared with the surface area of the portion of the ink supply tube 28 contacting the atmosphere.

Hereinafter, a third embodiment of the present invention in view of such circumstances will be described. The third embodiment is different from the above-described embodiment in the point that a liquid pressure imparting unit 341 to impart liquid pressure to the aqueous solution in the water reservoir chamber 35 is separately provided therein. Here, the third embodiment is considered as a modified embodiment of the second embodiment for descriptive purposes. However, the liquid pressure imparting unit 341 can be applied to the first embodiment as well. Note that structures which are the same as those of the above-described embodiment are denoted by the same reference numerals, and descriptions thereof will be simplified.

Figure 6:
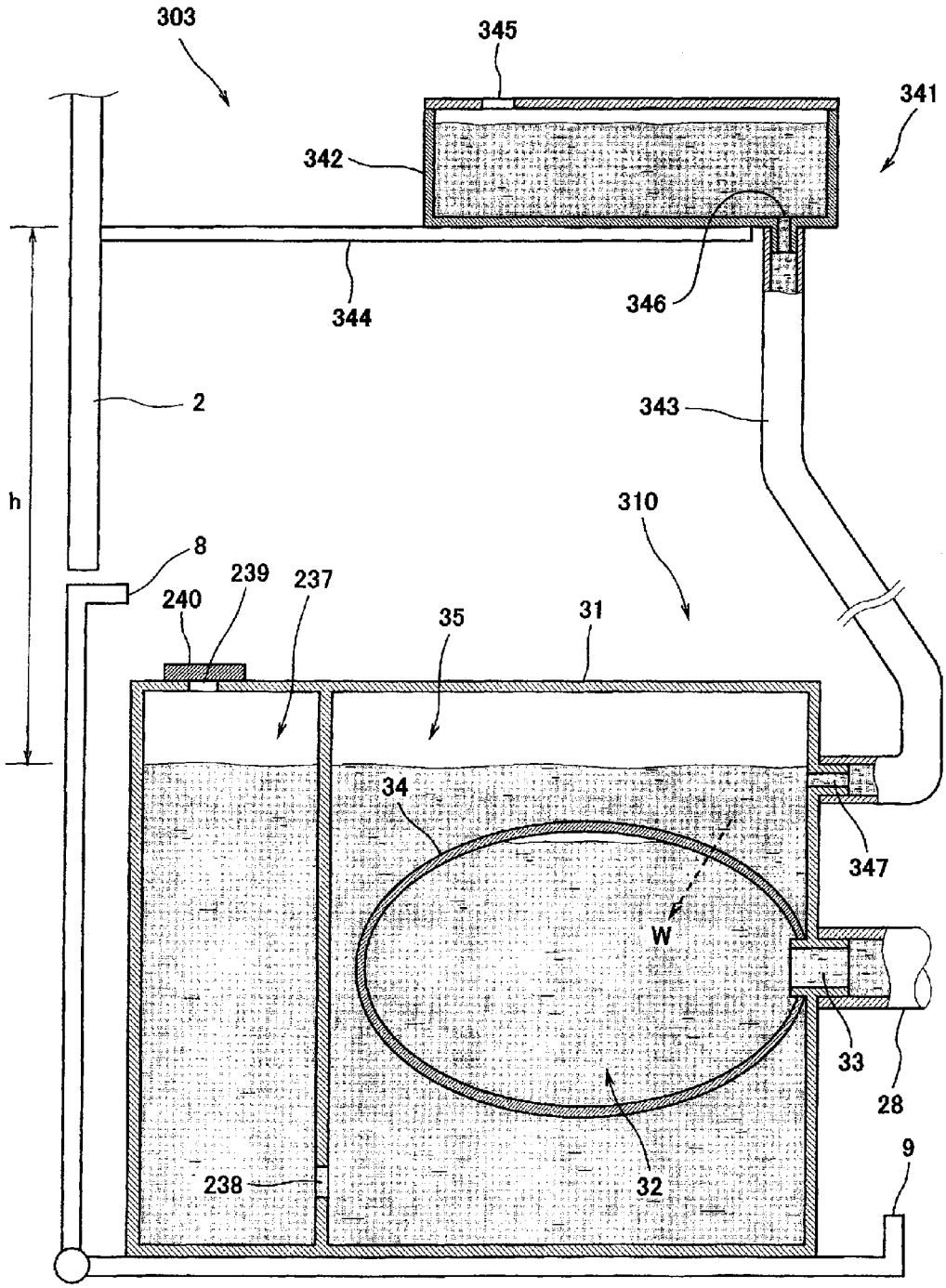
FIG. 6 is a schematic diagram illustrating the internal structure of an ink cartridge and the structure of a liquid pressure imparting unit of a third embodiment.

FIG. 6 is a schematic diagram illustrating the internal structure of an ink cartridge 310 of the third embodiment and the structure of the liquid pressure imparting unit 341. FIG. 6 shows a state in which, after the seal 240 is once detached from the ink cartridge to cause the aqueous solution to flow into the water reservoir chamber 35, the ink cartridge 310 coming into a state again in which the atmosphere communicating hole 239 is sealed with the seal 240 is mounted on the cartridge mounting part 9. As shown in FIG. 6, the liquid pressure imparting unit 341 includes an upper water tank (an upper water reservoir unit) 342 provided above the water reservoir chamber 35 of the ink cartridge 310, and a water supply tube 343 through which the upper water tank 342 is communicated with the water reservoir chamber 35. The upper water tank 342 is attached to a frame 344 horizontally extending from an area higher than the door 8 on the inner face of the housing 2, and is disposed on the upper side by a predetermined height h from the water reservoir chamber 35. The upper water tank 342 is capable of storing the aqueous solution described above therein, and the internal space is communicated with the atmosphere via an atmosphere communicating hole 345. The water supply tube 343 connects a water supply hole 346 through which the internal space of the upper water tank 342 is communicated with the outside and a water inflow hole 347 through which the water reservoir chamber 35 of the ink cartridge 310 is communicated with the outside therebetween. Further, the water reservoir chamber 35 is blocked off from the atmosphere with the seal 240. Accordingly, water head pressure determined in accordance with the height h is applied to the aqueous solution in the water reservoir chamber 35. Note that an end of the water supply tube 343 to be connected to the water inflow hole 347 is supported by a support mechanism (not shown) to fix its disposition, and when the ink cartridge 310 is mounted on the cartridge mounting part 9, the end of the water supply tube 343 is automatically connected to the water inflow hole 347. Then, a valve mechanism (not shown) which is usually closed and is connected to the end of the water inflow hole 347 to be opened is provided inside the end of the water supply tube 343. With this valve mechanism, the aqueous solution in the upper water tank 342 is prevented from leaking out of the water supply tube 343 when the ink cartridge 310 is not mounted on the cartridge mounting part 9. Further, a valve mechanism (not shown) which is usually closed and is connected to the end of the water supply tube 343 to be opened is provided in the water inflow hole 347 of the ink cartridge 310.

In this way, in the present embodiment, because the aqueous solution in the water reservoir chamber 35 receives the water head pressure to increase its liquid pressure as compared with the first and second embodiments, it is possible to increase the amounts of the water of the aqueous solution in the water reservoir chamber 35 permeating the inside of the ink reservoir chamber 32 via the ink pack 34 per unit time and per unit area. In this way, by adjusting the water head pressure with the setting for the disposition of the upper water tank 342, even in a case in which the specification of the ink supply tube 28 is changed so as to increase an amount of evaporation or the specification of the ink pack 34 is changed so as to decrease a permeable amount, the permeable amount and the amount of evaporation can be set to be equal.

Further, even in a case in which the aqueous solution in the water reservoir chamber 35 is decreased due to permeation, the aqueous solution in the upper water tank 342 is replenished via the water supply tube 343, which makes it possible to keep an amount of the aqueous solution in the water reservoir chamber 35 constant.

Next, a fourth embodiment of the present invention will be described. The fourth embodiment is different from the above-described embodiment in the point that a cooling unit 448 to cool the periphery of the discharge head 15 is provided therein. Here, the fourth embodiment is considered as a modified embodiment of the second embodiment for descriptive purposes. However, the cooling unit 448 can be applied to the first and third embodiments as well. Structures which are the same as those of the above-described embodiments are denoted by the same reference numerals, and descriptions thereof will be simplified.

Figure 7:
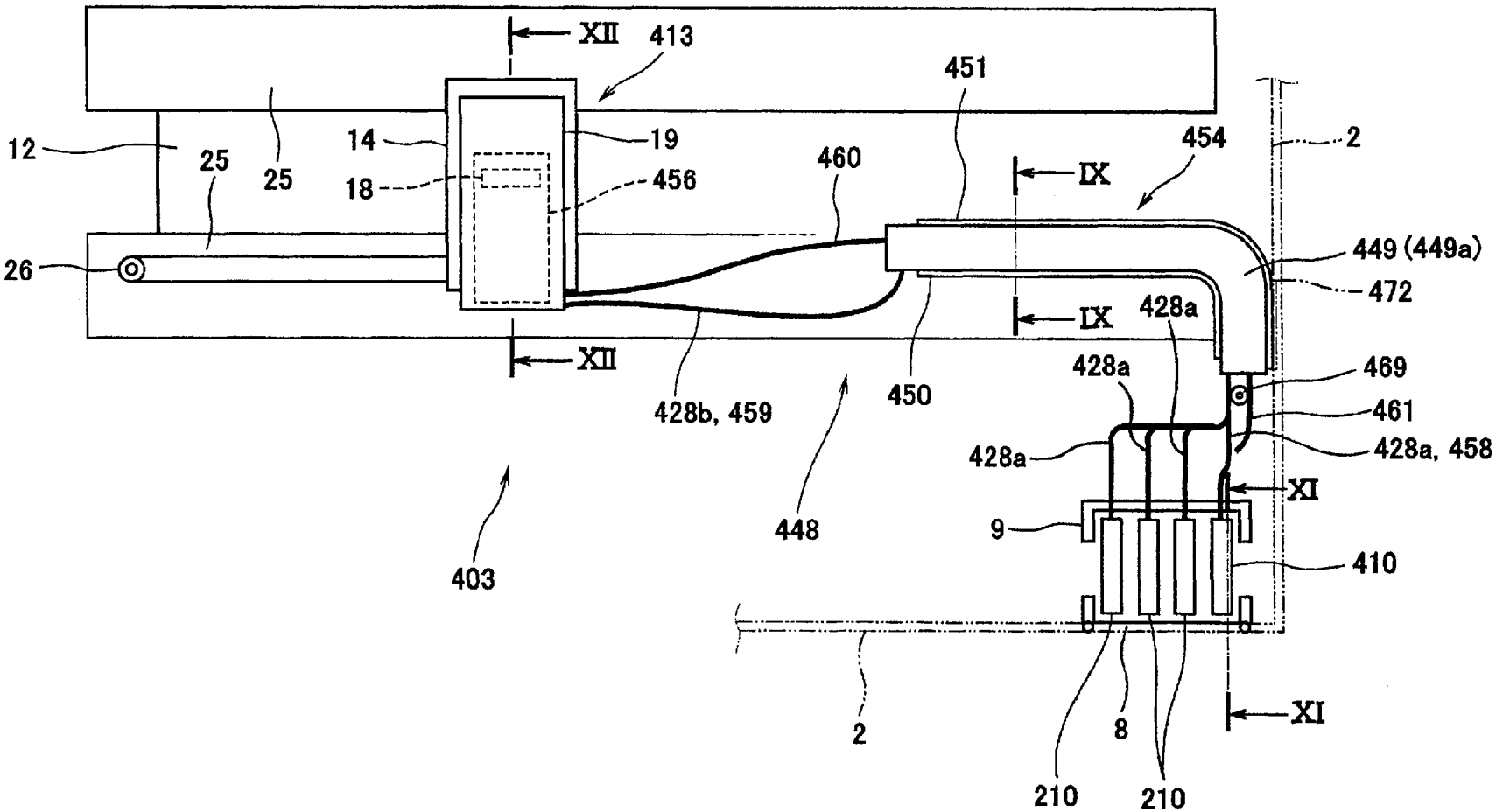
FIG. 7 is a schematic diagram illustrating the schematic structure of the printer of a fourth embodiment in a plan view.

FIG. 7 is a schematic diagram illustrating the schematic structure of a printer 403 of the fourth embodiment in a plan view. The printer 403 is provided in the housing 2 shown in FIG. 1 to form the multifunctional device 1. As shown in FIG. 7, four ink cartridges are mounted on the cartridge mounting part 9 in order to perform full-color printing. However, three of the four ink cartridges have the same structure as the ink cartridge 210 of the second embodiment shown in FIG. 5, and a remaining ink cartridge 410 is one in which the structure of the ink cartridge 210 of the second embodiment is modified as will be described later.

First, to describe a structure to connect the ink cartridges 210 and 410 and the ink sub-tank 19, cartridge side ink supply tubes 428*a* are connected to the ink supply holes 33 (refer to FIGS. 5 and 11) of the respective ink cartridges 210 and 410, and the ink supply tubes 428*a* are partially held by a tube holding member 449. The tube holding member 449 extends backward along the inner side face of the housing 2 from the front side of the cartridge mounting part 9, and bends to the left to extend toward the carriage 14 of an image recording unit 413. Cartridge side ink supply tubes 428*b* communicated with the cartridge side ink supply tubes 428*a* held by the tube holding member 449 are connected to the other end of the tube holding member 449. The carriage side ink supply tubes 428*b* are connected to the ink sub-tank 19 loaded on the carriage 14 of the image recording unit 413 (refer to FIG. 12 as well).

Figure 8:
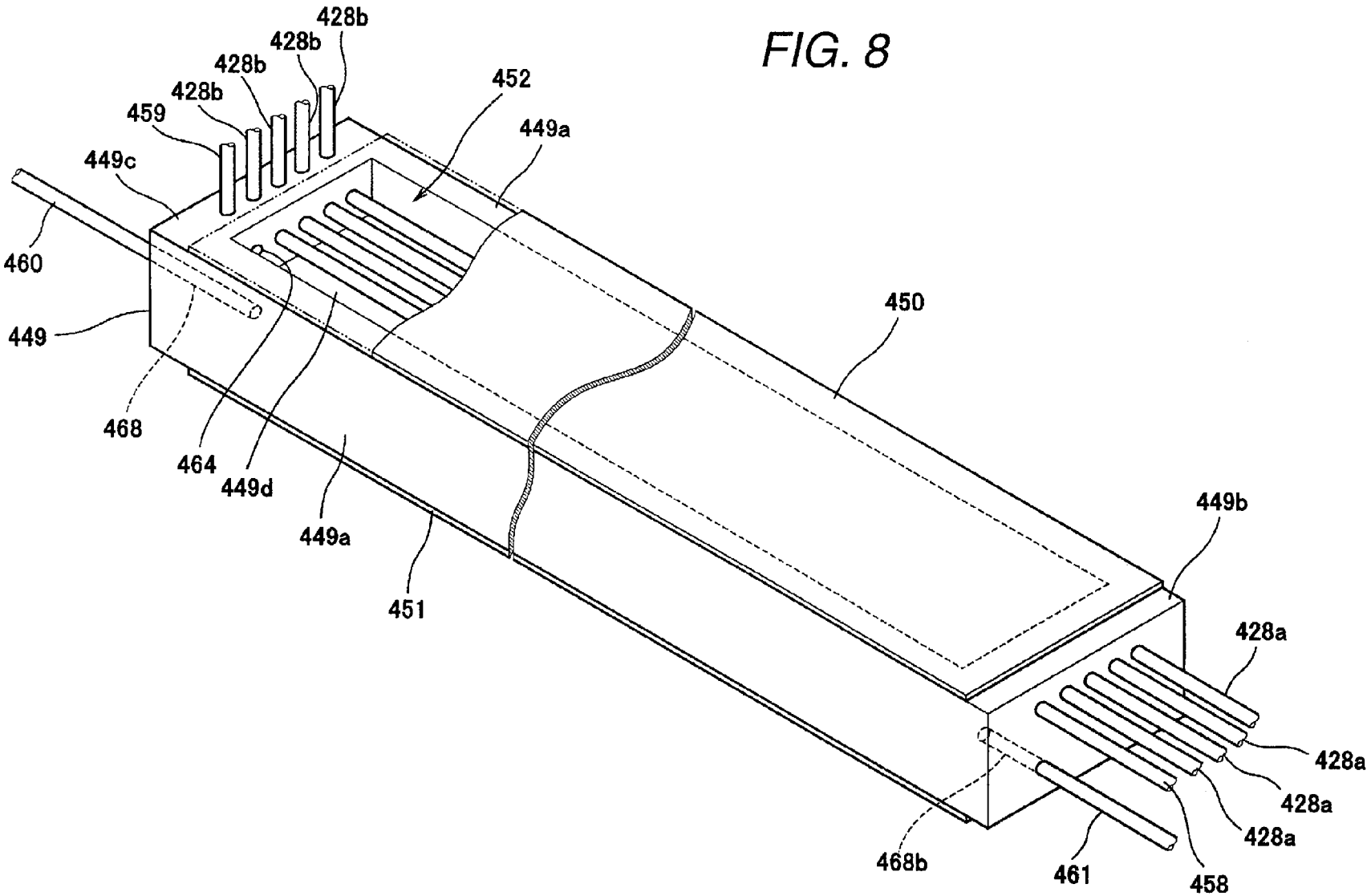
FIG. 8 is a perspective view of a tube holding member.
Figure 9:
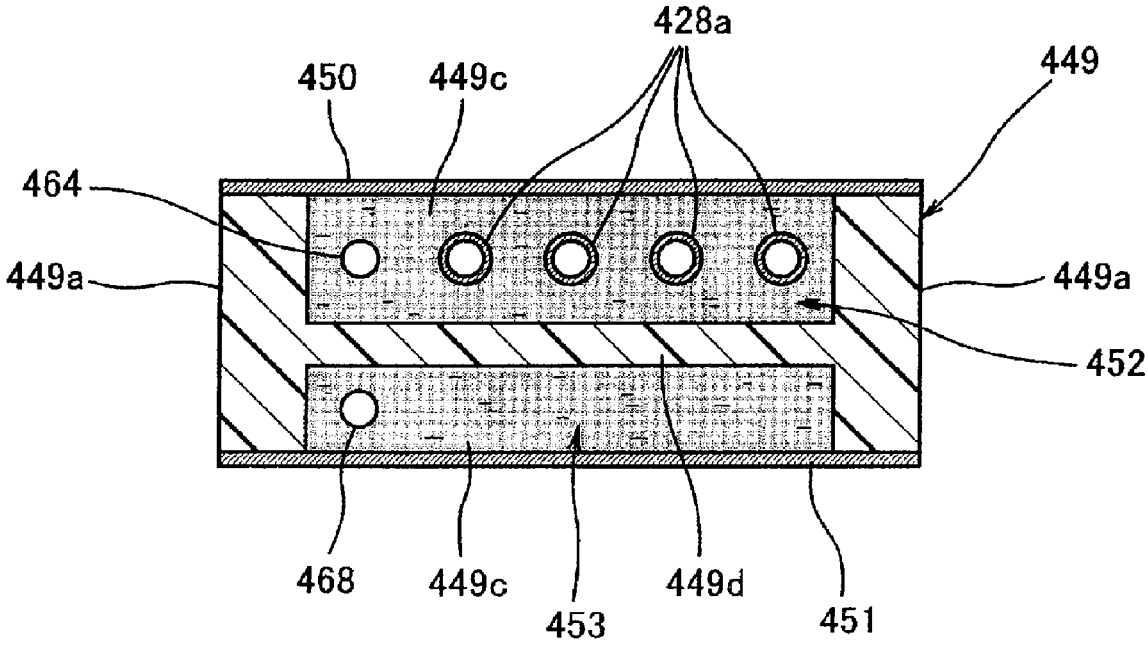
FIG. 9 is a view taken along the line connecting arrows IX and IX of FIG. 7, and a sectional view of the tube holding member.

FIG. 8 is a perspective view of the tube holding member 449. FIG. 9 is a view taken along the line connecting arrows IX and IX of FIG. 7, and a sectional view of the tube holding member 449. The tube holding member 449 is formed of a material, such as elastomer, with elasticity and low moisture permeability. As shown in FIG. 8, the tube holding member 449 is composed of a pair of side walls 449*a* and 449*a* extending in a longitudinal direction, one end wall 449*b* connecting one of the edges of the both side walls 449*a* and 449*a*, other end wall 449*c* connecting the other of the edges of the both side walls 449*a* and 449*a*, and an intermediate wall 449*d* partitioning a rectangular frame shaped space surrounded by the walls 449*a*, 449*a*, 449*b*, and 449*c* into two spaces, and as shown in FIG. 9, the tube holding member 449 is formed into an H lettered shape in section. Films 450 and 451 with low water permeability are bonded onto the tube holding member 449 so as to cover the respective open surfaces of the two spaces. Accordingly, a first space 452 surrounded by the inner faces of the both side walls 449*a*, one plane of the intermediate wall 449*d*, and the film 450, and a second space 453 surrounded by the inner faces of the both side walls 449*a*, the other plane of the intermediate wall 449*d*, and the film 451 are formed.

As shown in FIG. 8, each of the respective cartridge side ink supply tube 428*a* is inserted into the one end wall 449*b* of the tube holding member 449 to extend along the extending direction of the side walls inside the first space 452, and is pressed into the inner face of the other end wall 449*c* of the tube holding member 449. One end of the carriage side ink supply tube 428*b* is connected to the outer face of the other end wall 449*c*. An internal channel (not shown) through which the both ink supply tubes 428*a* and 428*b* are communicated with one another is formed inside the other end wall 449*c*. Note that the four cartridge side ink supply tubes 428*a* extend in a longitudinal direction so as to be arrayed at substantially even intervals between the both side walls 449*a* and 449*a* in the first space 452.

Figure 10:
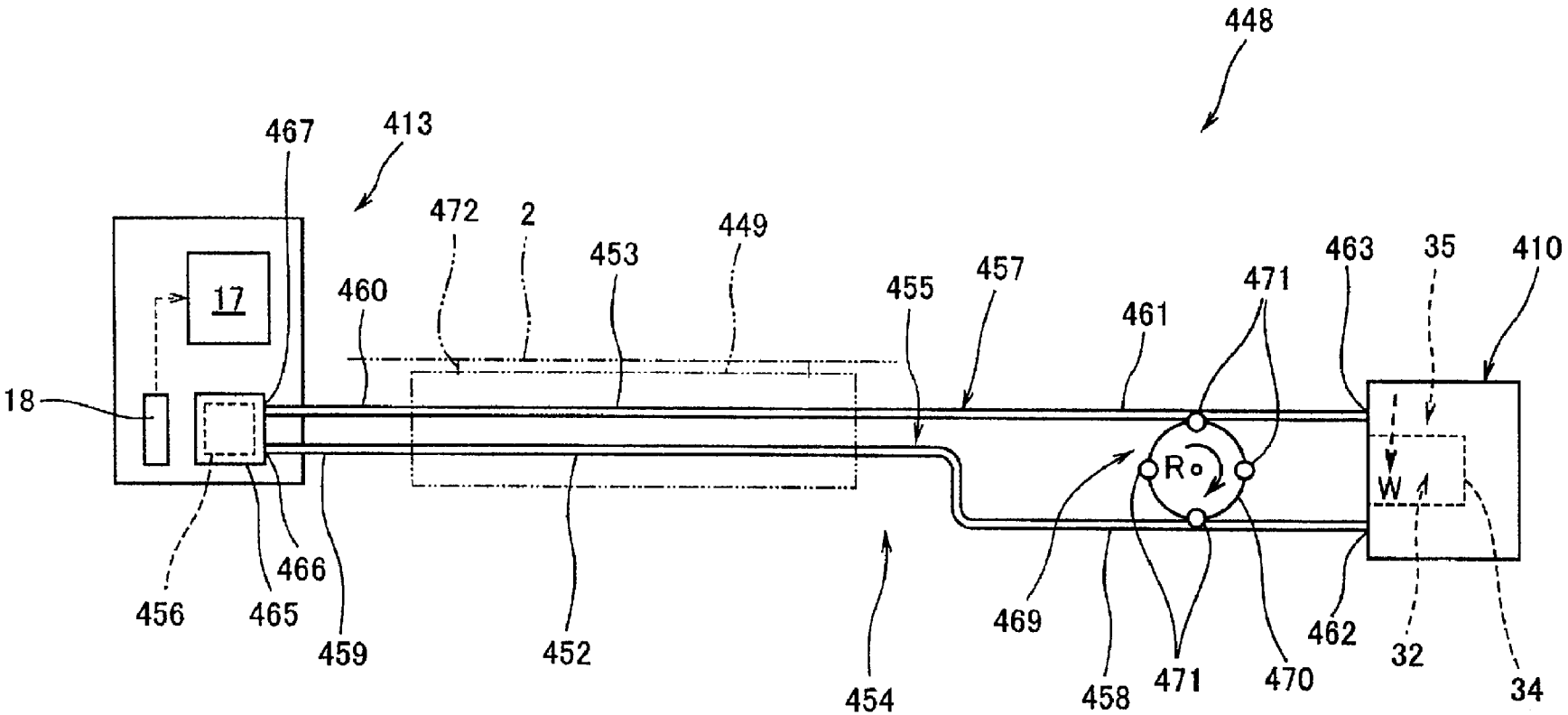
FIG. 10 is a schematic diagram for explanation of a structure of a cooling unit in the fourth embodiment.

FIG. 10 is a schematic diagram for explanation of the structure of the cooling unit 448 in the fourth embodiment. As shown in FIG. 10, the cooling unit 448 is configured to cool the periphery of an IC chip 18 which is loaded on the carriage 14 to control to drive the piezoelectric actuator 17 by using the aqueous solution stored in the water reservoir chamber 35 in the ink cartridge 410 as a coolant. This cooling unit 448 includes a coolant tank 465 forming a coolant chamber 456 provided in the vicinity of the IC chip 18 in the carriage 14 to be capable of storing a coolant therein, a coolant circulation pathway 454 composed of a coolant outward path 455 and a coolant return path 457 through which the water reservoir chamber 35 of the ink cartridge 410 is communicated with the coolant chamber 456, and a pump 469 that imparts dynamic pressure to the coolant in the coolant circulation pathway 454.

Figure 11:
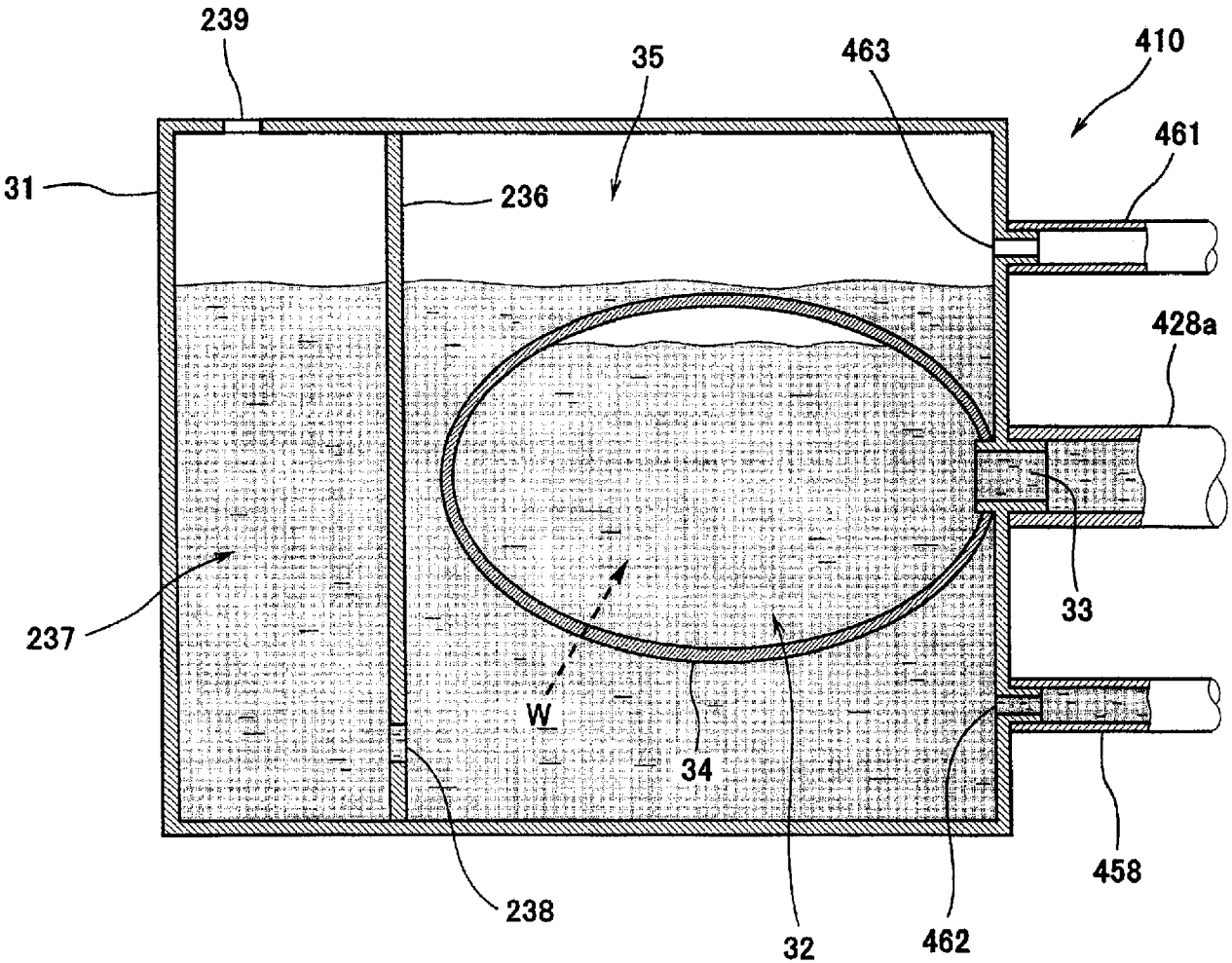
FIG. 11 is a view taken along the line connecting arrows XI and XI of FIG. 7, and a sectional view illustrating an internal structure of the ink cartridge of the fourth embodiment.

FIG. 11 is a view taken along the line connecting arrows XI and XI of FIG. 7, and a sectional view illustrating a structure of the ink cartridge 410 of the fourth embodiment. As shown in FIG. 11, a water outflow hole 462 and a water inflow hole 463 through which the water reservoir chamber 35 is communicated with the outside are provided at the ink cartridge 410. A cartridge side coolant supply tube 458 forming the coolant outward path 455 is connected to the water outflow hole 462, and a cartridge side coolant collection tube 461 forming the coolant return path 457 is connected to the water inflow hole 463 (refer to FIG. 10 as well). Note that the ends of the cartridge side coolant supply tube 458, the cartridge side coolant collection tube 461, and the cartridge side ink supply tube 428*a* are supported by a support mechanism (not shown) to fix their disposition, and when the ink cartridge 410 is mounted on the cartridge mounting part 9, the cartridge side coolant supply tube 458 is connected to the water outflow hole 462, the cartridge side coolant collection tube 461 is connected to the water inflow hole 463, and the cartridge side ink supply tube 428*a* is connected to the ink supply hole 33, automatically. Then, valve mechanisms (not shown) which are usually closed and are connected to corresponding holes to be opened are provided inside the ends of these tubes 458, 461, and 428*a*. With the valve mechanisms, when the ink cartridge 410 is not mounted on the cartridge mounting part 9, the aqueous solution in the coolant outward path and the coolant return path is prevented from leaking out of the tubes, and the ink is prevented from leaking out of the tubes. Further, valve mechanisms (not shown) which are usually closed and are connected to corresponding tubes to be opened are provided inside the water outflow hole 462, the water inflow hole 463, and the ink supply hole 33 as well of the ink cartridge 410.

As shown in FIG. 8, the cartridge side coolant supply tube 458 is pressed into the one end wall 449*b* of the tube holding member 449 to cause the coolant chamber 456 to be communicated with the first space 452. A carriage side coolant supply tube 459 is connected to the other end wall 449*c* of the tube holding member 449 so as to be arrayed with the carriage side ink supply tubes 428*b*. The carriage side coolant supply tube 459 is communicated with the first space 452 via a through-hole 464 formed inside the other end wall 449*c*.

Figure 12:
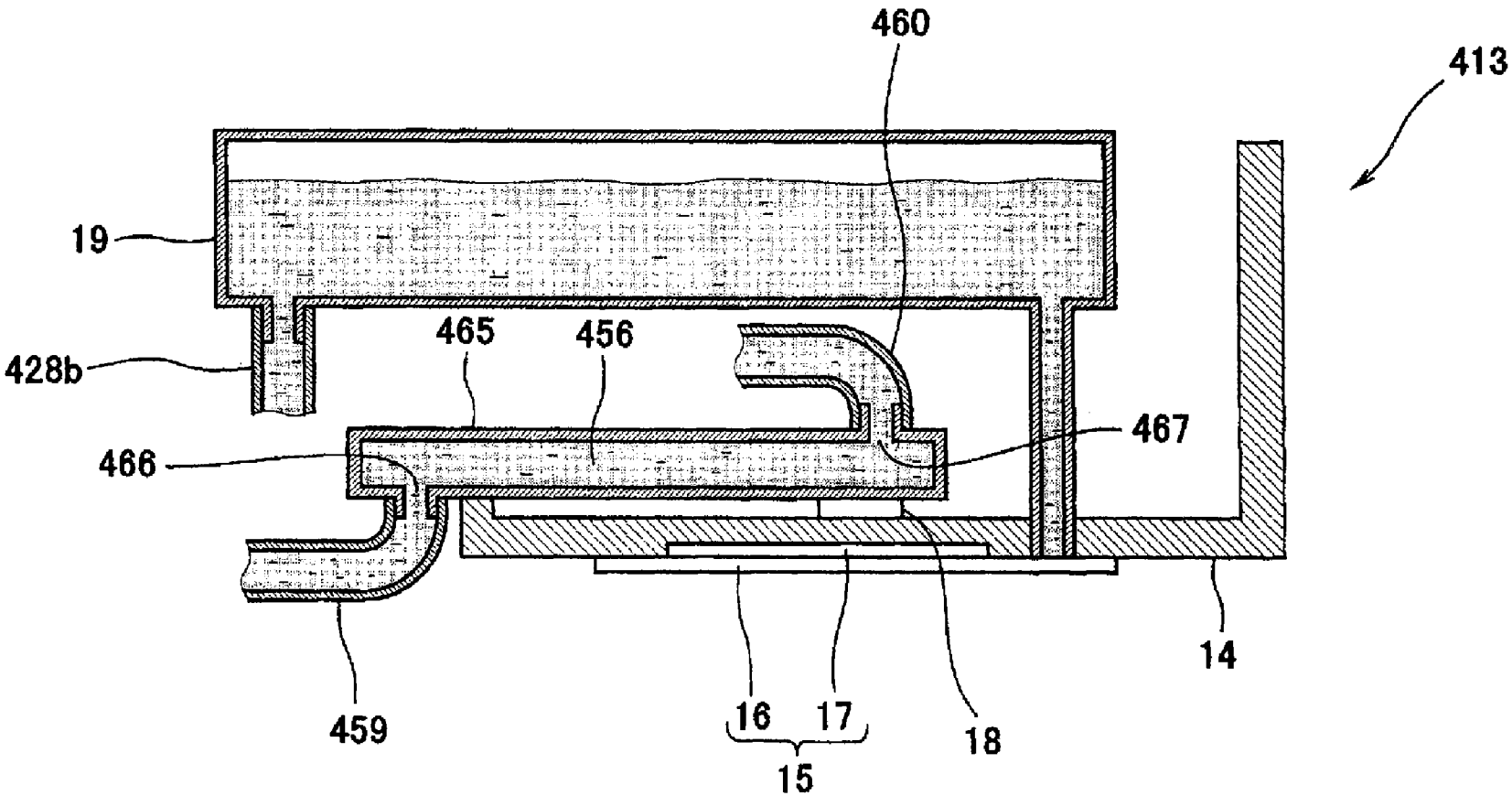
FIG. 12 is a view taken along the line connecting arrows XII and XII of FIG. 7, and a schematic diagram illustrating the structure of an image recording unit of the fourth embodiment in a side sectional view.

FIG. 12 is a view taken along the line connecting arrows XII and XII of FIG. 7, and a schematic diagram illustrating the structure of the image recording unit 413 in a side sectional view. As shown in FIG. 12, an IC chip 38 is loaded on the inner bottom face of the carriage 14, and the coolant tank 465 is installed between the IC chip 38 and the ink sub-tank 19. A water inflow hole 466 and a water outflow hole 467 through which the coolant chamber 456 is respectively communicated with the outside are provided at the coolant tank 465. The carriage side coolant supply tube 459 is connected to the water inflow hole 466, and a carriage side coolant collection tube 460 is connected to the water outflow hole 467 (refer to FIG. 10 as well).

As shown in FIGS. 8 and 9, the carriage side coolant collection tube 460 is connected to the other end wall 449*c* of the tube holding member 449, and is communicated with the second space 453 via a through-hole 468. Further, as shown in FIG. 8, the cartridge side coolant collection tube 461 is connected to the one end wall of the tube holding member 449. The cartridge side coolant collection tube 461 is communicated with the second space 453 via a through-hole 468*b* formed inside the one end wall 449*b*, and as described above, the cartridge side coolant collection tube 461 is communicated with the water reservoir chamber 35 via the water inflow hole 463 of the ink cartridge 410 (refer to FIG. 11 as well).

In this way, the coolant outward path 455 is formed by the cartridge side coolant supply tube 458, the first space 452, and the carriage side coolant supply tube 459, and the coolant return path 457 is formed by the carriage side coolant collection tube 460, the second space 453, and the cartridge side coolant collection tube 461 (refer to FIG. 10).

As shown in FIG. 7, the cartridge side coolant supply tube 458 is disposed so as to be overlapped above and below with the cartridge side ink supply tube 428*a*, and the carriage side coolant supply tube 459 is disposed so as to be overlapped above and below with the carriage side ink supply tube 428*b*. The cartridge side coolant supply tube 458 and the cartridge side coolant collection tube 461 respectively extend back and forth so as to be arrayed right and left between the ink cartridge 410 and the one end wall 449*b* of the tube holding member 449. The pump 469 is provided so as to be sandwiched by the both tubes 458 and 461. As the structure is shown in FIG. 10, the pump 469 is constituted by a tube pump, and is composed of a drum 470 driven to rotate in a predetermined direction shown by arrow R, and a plurality of indenters 471 provided as protrusions on the outer circumferential surface of the drum 470, and the both tubes 458 and 461 are disposed so as to be crushed by the indenters 471.

Further, as described above, the tube holding member 449 is made to partially contact the inner side face of the housing 2 to be bent. The tube holding member 449 is disposed such that the side walls 449*a* and 449*a* are directed upward and downward, and the film 450 forming the first space 452 is directed toward the inner circumferential side of the bent tube holding member 449, and the film 451 forming the second space 453 is directed toward the outer circumferential side thereof. Accordingly, a part of the film 451 forming the second space 453 comes into contact with the inner side face of the housing 2. In contrast thereto, a heat sink 472 formed such that a material with high heat conductivity such as aluminum is formed into a plate shape is attached to the portion contacting the film 451 at the inner side face of the housing 2 (refer to FIG. 10 as well). Note that, provided that the tube holding member 449 is disposed in this way, because the four ink supply tubes 428*a* come to be arrayed above and below between the both side walls 449*a* and 449*a*, the portions of the ink supply tubes 428*a* held by the tube holding member 449 can be led around at the same curvature.

In the printer 403 including the cooling unit 448, when the pump 469 is driven, the aqueous solution (coolant) in the water reservoir chamber 35 flows toward the coolant chamber 456 through the coolant outward path 455. At this time, in the process in which the aqueous solution passes through the first space 452, it is possible to suppress a rise in temperature of the ink in the cartridge side ink supply tube 458. Further, because the outside of the cartridge side ink supply tube 458 is filled with the aqueous solution, it is possible to prevent the water of the ink in the cartridge side ink supply tube 458 from evaporating (refer to FIGS. 8 and 9).

Further, because the coolant flown into the coolant chamber 456 draws heat from the IC chip 18, it is possible to suppress a rise in temperature around the discharge head 15 in the carriage 14.

Further, by driving the pump 469, the coolant in the coolant chamber 456 increased in temperature due to the heat exchange with the IC chip 18 flows toward the water reservoir chamber 35 through the coolant outward path 457. At this time, in the process in which the coolant passes through the second space 453, the heat is absorbed by the heat sink 472 attached to the inner side face of the housing 2. The coolant cooled in this way is guided to the water reservoir chamber 35 via the cartridge side coolant collection tube 461.

In the present embodiment as well, in the same way as in the first to third embodiments, because the water of the aqueous solution in the water reservoir chamber 35 is made to permeate the inside of the ink reservoir chamber 32 via the ink pack 34, the concentration of the ink can be kept constant over a long period even if evaporation of the ink occurs, which makes it possible to keep the viscosity of the ink constant over a long period. Accordingly, it is possible to stably perform an ink discharge operation by the discharge head 15.

Moreover, it is possible to water-cool the periphery of the discharge head 15 by using the aqueous solution therein as a coolant by the cooling unit 448. In accordance therewith, it is possible to suppress a rise in temperature of the ink in the ink channel of the discharge head 15 and the ink in the ink sub-tank 19 disposed above the discharge head 15. Accordingly, it is possible to prevent the viscosity of the ink from changing around the discharge head 15, which makes it possible to more stably perform an ink discharge operation by the discharge head 15.

In this way, because the aqueous solution stored in the water reservoir chamber 35 of the present embodiment is used as a coolant, a component effective as a coolant may be mixed therein. That is, high boiling point liquid such as glycerine may be mixed therein, or a microparticulated capsule filled with a phase-change material that makes a phase change under a temperature condition around the IC chip 18 (for example, at 20 to 80 degrees) may be mixed therein.

To describe the timing of driving the pump 469, because heat generation from the periphery of the carriage 15 notably occurs when the piezoelectric actuator 17 is controlled to drive by a circuit built in the IC chip 18 to perform a printing operation, the driving of the pump 469 may be performed simultaneously with the execution of the printing operation.

In accordance therewith, cooling is carried out when heat generation notably occurs, and the pump 469 is made to pause during another duration, which makes it possible to reduce electricity consumption and the like. Further, a temperature sensor capable of sensing a temperature around the discharge head 15 to output temperature data denoting the temperature is loaded on the carriage 14, and when it is judged that the temperature data is greater than a threshold temperature set in advance, the control for driving the pump 469 may be carried out.

Next, a fifth embodiment of the present invention will be described. The fifth embodiment is different in a structure of a cooling unit 548 from the fourth embodiment. Note that structures which are the same as those of the above-described embodiment are denoted by the same reference numerals, and descriptions thereof will be simplified.

Figure 13:
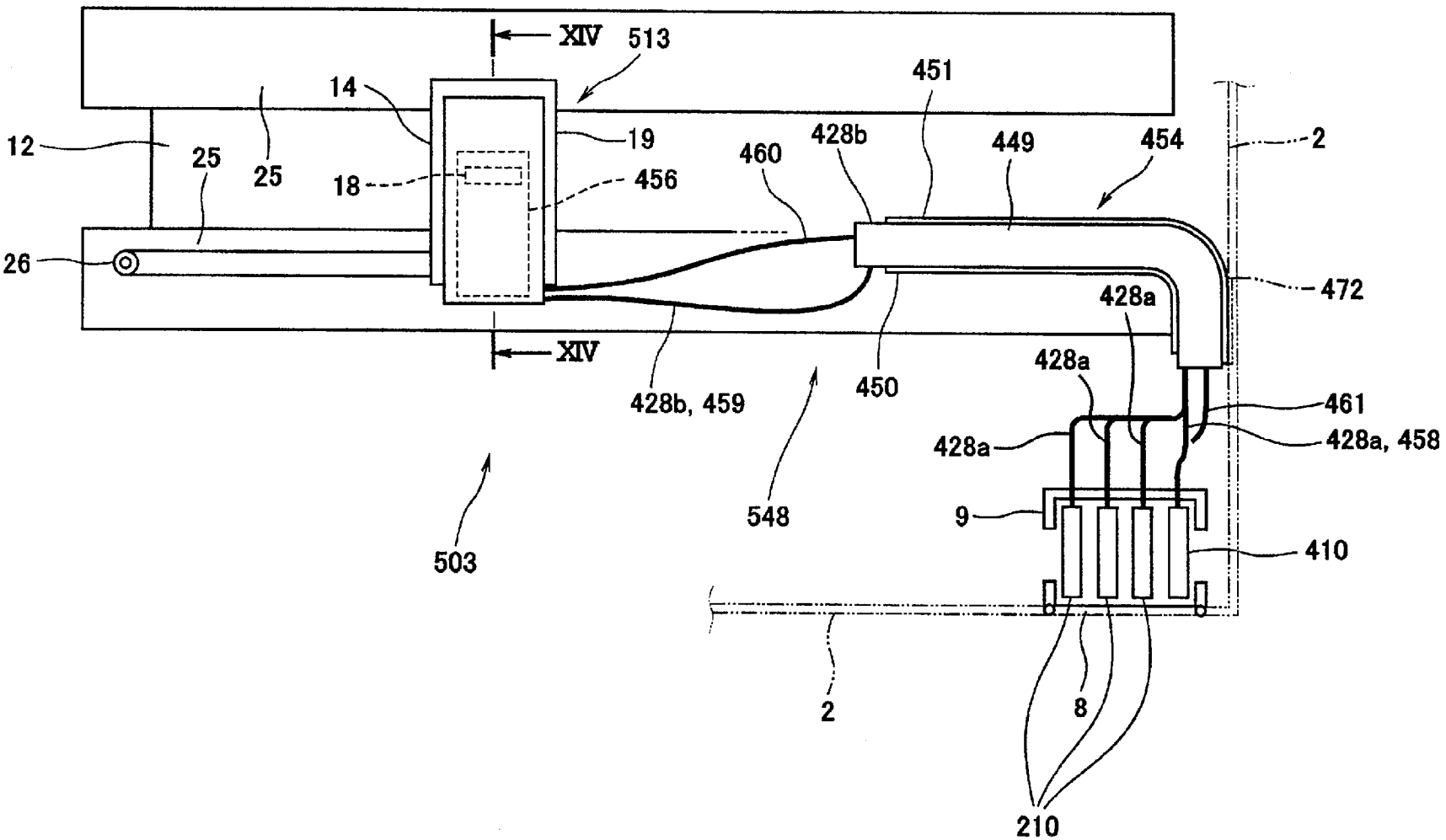
FIG. 13 is a schematic diagram illustrating the schematic structure of a printer of a fifth embodiment in a plan view.
Figure 14:
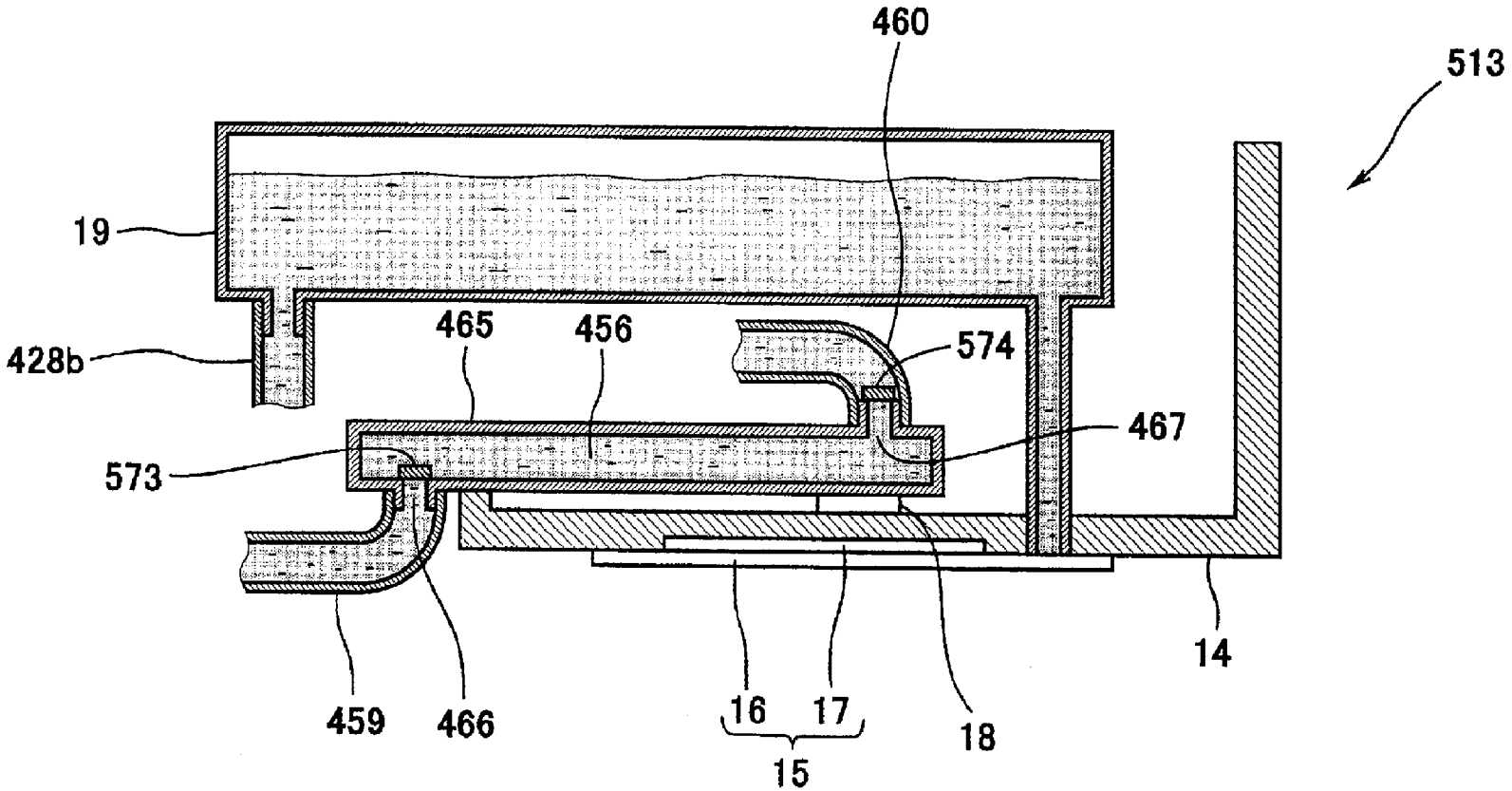
FIG. 14 is a view taken along the line connecting arrows XIV and XIV of FIG. 13, and a schematic diagram illustrating a structure of an image recording unit of the fifth embodiment in a side sectional view.

FIG. 13 is a schematic diagram illustrating the schematic structure of a printer 503 of the fifth embodiment in a plan view. FIG. 14 is a view taken along the line connecting arrows XIV and XIV of FIG. 13, and a schematic diagram illustrating the structure of an image recording unit 513 of the fifth embodiment in a side sectional view. The cooling unit 548 of the present embodiment shown in FIGS. 13 and 14, as can be understood by comparison with FIGS. 7 and 12 showing the fourth embodiment, in place of the pump 469 being omitted, an inflow side check valve 573 is provided at the water-inflow hole 466 of the coolant chamber 465, and an outflow side check valve 574 is provided at the water outflow hole 467. The other structures of the ink cartridge 410, the coolant circulation pathway 454, the tube holding member 449, the heat sink 472, and the like are the same as those of the cooling unit 448 in the fourth embodiment.

As shown in FIG. 13, the carriage side coolant supply tube 459 and the carriage side coolant collection tube 460 extend to the right in the running direction of the carriage 14 from the image recording unit 513. Note that the carriage side coolant supply tube 459 and the carriage side coolant collection tube 460 may extend toward any side of the running direction of the carriage 14, and may extend to the left.

As shown in FIG. 14, the water inflow hole 466 of the coolant tank 465 is formed in the bottom face, and the coolant in the carriage side coolant supply tube 459 flows from the lower side to the upper side through the water inflow hole 466 to flow into the coolant chamber 456. Further, the water outflow hole 467 of the coolant tank 465 is formed in the top face, and the coolant in the coolant chamber 456 flows from the lower side to the upper side out of the water outflow hole 467 to the carriage side coolant collection tube 460. The inflow side check valve 573 is composed of a valve element placed so as to block the opening at the upper side of the water inflow hole 466, and the outflow side check valve 574 is composed of a valve element placed so as to block the opening at the upper side of the water outflow hole 467. The valve elements have a specific gravity greater than that of the coolant, and are made lightweight so as to be floatable due to the dynamic pressure of the coolant.

Figure 15A:
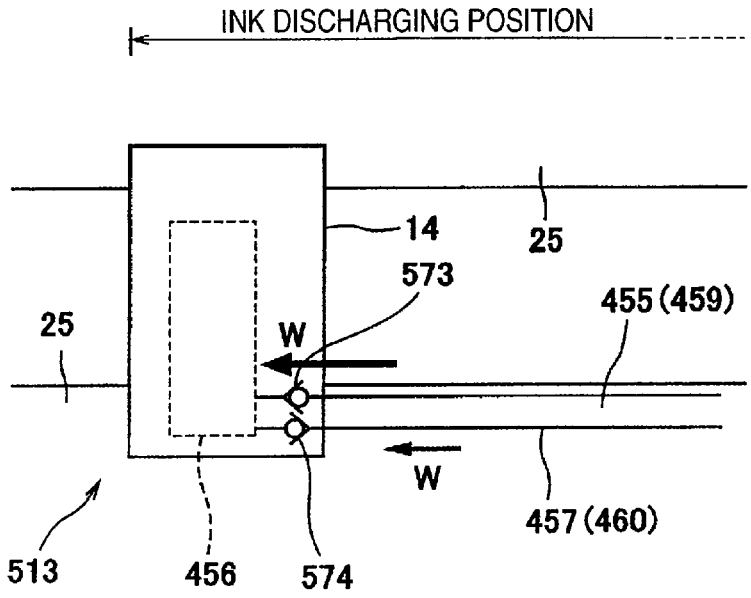
FIG. 15A shows a state in which the carriage is located on the extreme left in the ink discharging position.
Figure 15B:
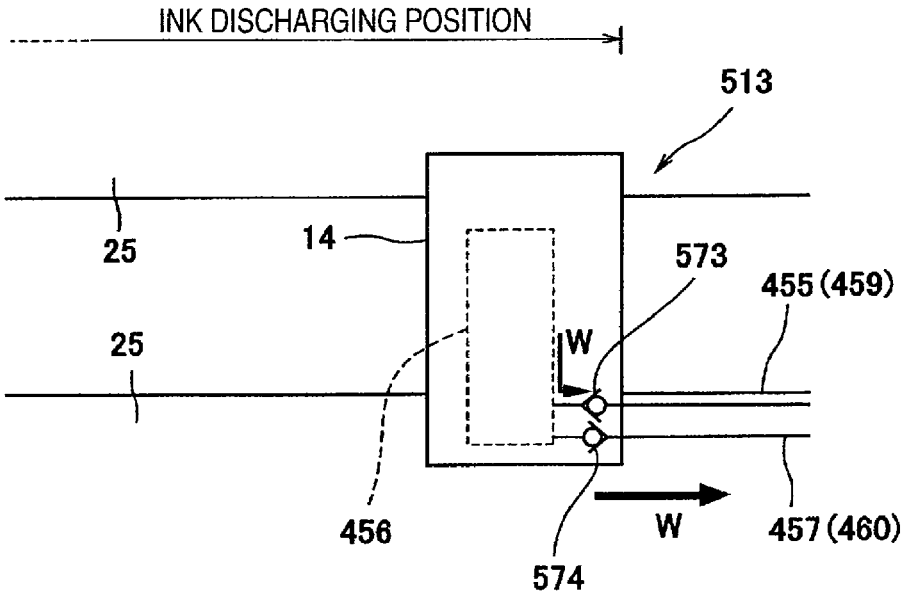
FIG. 15B shows a state in which the carriage is located on the extreme right in the ink discharging position.

FIG. 15 is an action diagram for explanation of an operation for circulating the coolant in the present embodiment. FIG. 15A shows a state in which the carriage 14 is located on the extreme left in the ink discharging position in order to turn its traveling direction to the right, and FIG. 15B shows a state in which the carriage 14 is located on the extreme right in the ink discharging position in order to turn its traveling direction to the left. Note that, when the printer 503 performs a printing operation, the carriage 14 reciprocates from side to side within the ink discharging position. However, the carriage 14 makes a substantially uniform motion at the intermediate portion in the ink discharging position.

As shown in FIG. 15A, when the carriage 14 moving to the left turns its traveling direction to the right, after the carriage 14 reduces its traveling speed at a predetermined deceleration to stop on the extreme left, the carriage 14 accelerates at a predetermined acceleration to move to the right. Accordingly, inertia force toward the left is applied to the coolant in the carriage side coolant supply tube 459 and the carriage side coolant collection tube 460 which are provided so as to extend from the carriage 14 to the right. Therefore, the coolant in the tubes 459 and 460 makes an attempt to flow by receiving the dynamic pressure according to this inertia force as shown by arrow W. That is, the coolant in the carriage side coolant supply tube 459 flows from the lower side to the upper side through the water inflow hole 466, and the dynamic pressure floats the valve element of the inflow side check valve 573 against gravitational force of the valve element of the inflow side check valve 573 to open the inflow side check valve 573, and the coolant flows into the coolant chamber 456. The coolant in the carriage side coolant collection tube 460 makes an attempt to flow from the upper side to the lower side through the water outflow hole 467. However, because the valve element of the inflow side check valve 574 blocks the opening of the water outflow hole 467, the coolant does not counterflow into the coolant chamber 456.

As shown in FIG. 15B, when the carriage 14 moving to the right turns its traveling direction to the left, after the carriage 14 reduces its traveling speed at a predetermined deceleration to stop on the extreme right, the carriage 14 accelerates at a predetermined acceleration to move to the left. Accordingly, inertia force toward the right is applied to the coolant in the carriage side coolant supply tube 459 and the carriage side coolant collection tube 460. Therefore, the coolant in the tubes 459 and 460 makes an attempt to flow by receiving the dynamic pressure according to this inertia force as shown by arrow W. That is, the coolant in the carriage side coolant collection tube 460 makes an attempt to flow from the lower side to the upper side through the water outflow hole 467, and the dynamic pressure floats the valve element of the outflow side check valve 574 against gravitational force of the valve element of the outflow side check valve 574 to open the outflow side check valve 574, and the coolant flows into the carriage side coolant collection tube 460. The coolant in the carriage side coolant supply tube 459 makes an attempt to flow from the upper side to the lower side through the water inflow hole 466. However, because the valve element of the inflow side check valve 573 blocks the opening of the water inflow hole 466, the coolant does not counterflow from the inside of the coolant chamber 456 into the carriage side coolant supply tube 459.

In this way, when the carriage 14 is made to reciprocate from side to side according to the execution of a printing operation, the coolant flows in the coolant circulation pathway 454 with the inertia force applied thereto in accordance with acceleration and deceleration at the time of turning its direction as dynamic pressure. At this time, the coolant is prevented from counterflowing by the check valves 573 and 574, and the coolant in the coolant circulation pathway 454 flows in one direction to be circulated. Note that, because the tubes 459 and 460 are provided so as to extend in the running direction of the carriage 14 from the carriage 14, and the direction in which the dynamic pressure generated by the inertia force according to the acceleration and deceleration of the carriage 14 is generated and the direction in which the tubes 459 and 460 extend are made parallel to one another, it is possible to smoothly perform the circulation of the coolant by utilizing the reciprocation of the carriage 14.

In this way, in the present embodiment, a dedicated driving source for circulating the coolant is not necessary, which makes it possible to form the cooling unit 548 compact. However, the present embodiment may be configured such that the pump 469 as well in the fourth embodiment is provided, and the coolant is circulated even while the carriage 14 does not move.

Figure 16:
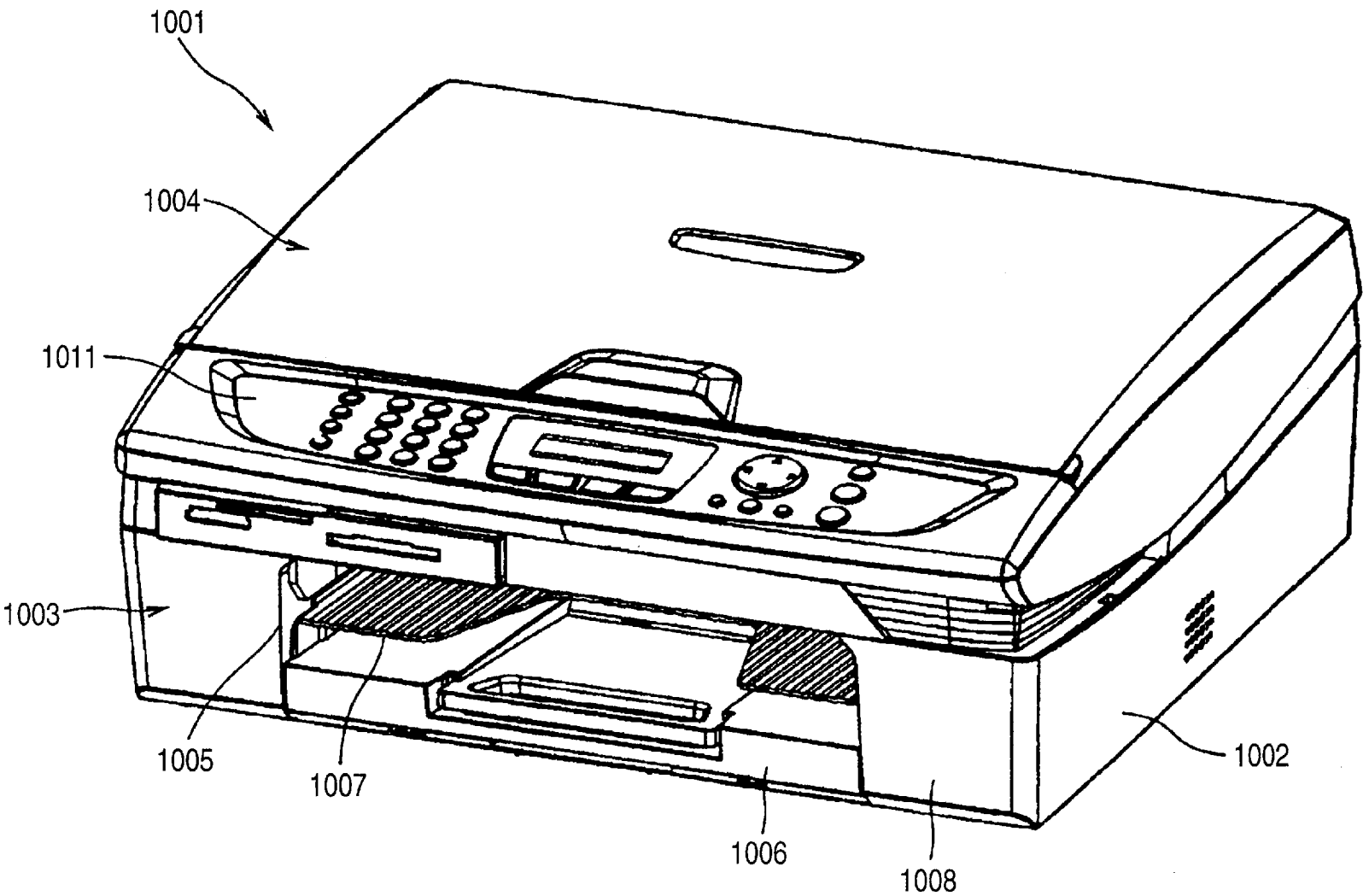
FIG. 16 is a perspective view of a multifunctional device having a printer of a sixth embodiment shown as one example of a liquid discharge apparatus according to the present invention.

FIG. 16 is a perspective view of a multifunctional device 1001 having a printer 1003, that is a sixth embodiment shown as one example of a liquid discharge apparatus according to the present invention. As shown in FIG. 16, the multifunctional device 1001 has a printer function, a scanner function, a copy function, and a facsimile function, and includes a substantially rectangular parallelepiped housing 1002 forming a main body outer shape of the multifunctional device 1001. The printer (liquid discharge apparatus) 1003 that performs a printing operation in an inkjet system is provided at the lower portion of the housing 1002, and a scanner 1004 is provided at the upper portion of the housing 1002. An opening 1005 is formed in the front face of the housing 1002, and a sheet feeding tray 1006 is provided at the lower stage of the opening 1005, and a sheet discharging tray 1007 is provided at the upper stage thereof. A door 1008 is attached so as to be openable and closable to the right lower portion at the front face side of the housing 1002, and a cartridge mounting part 1009 (refer to FIGS. 17 and 18) is provided inside the door 1008. When the door 1008 is opened, the cartridge mounting part 1009 is exposed to the front face side, which allows ink cartridges (liquid tanks) 1010 (refer to FIGS. 17 and 18) storing ink (first liquid) therein to be detachable and replaceable. An operation panel 1011 on which an operator operates the multifunctional device 1001 is provided on the upper portion of the front face side of the housing 1002.

Figure 17:
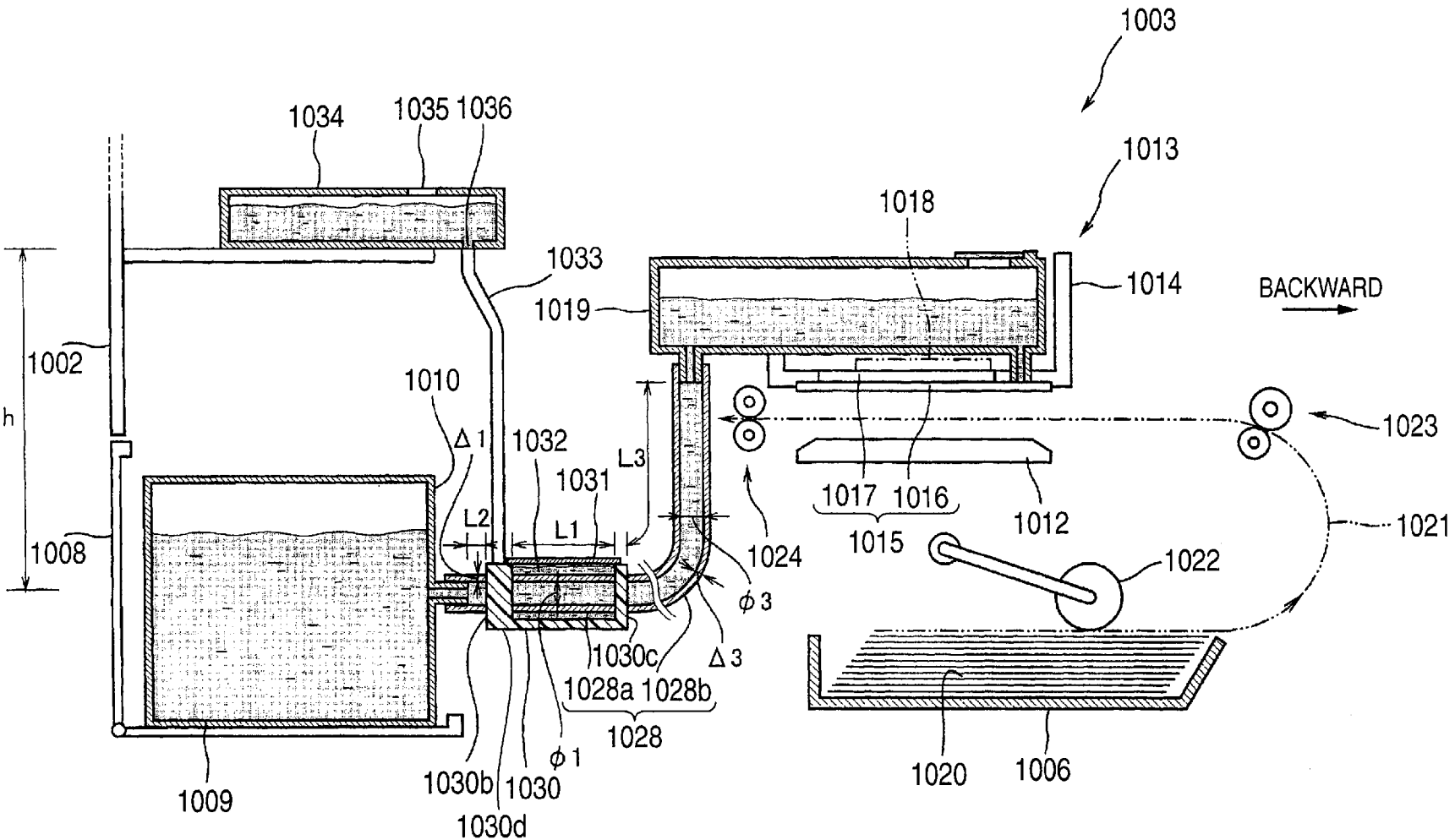
FIG. 17 is a schematic diagram illustrating the schematic structure of the printer of the sixth embodiment in a lateral view.

FIG. 17 is a schematic diagram illustrating the schematic structure of the printer 1003 of the sixth embodiment in a lateral view. As shown in FIG. 17, in the housing 1002, a platen 1012 is provided above the sheet feeding tray 1006, and an image recording unit 1013 is provided above the platen 1012.

The image recording unit 1013 is formed such that a discharge head 1015 that discharges ink and the like are loaded on a carriage 1014. The discharge head 1015 is composed of a cavity unit 1016 having an internal ink channel (not shown) and a nozzle hole forming a downstream end opening of the ink channel, and a piezoelectric actuator 1017 that imparts a discharge pressure to the ink in the ink channel. The discharge head 1015 is attached to the outer bottom face of the carriage 1014, and the opening surface of the nozzle hole in the cavity unit 1016 is directed downward. When the piezoelectric actuator 1017 operates, a discharge pressure is imparted to the ink in the ink channel, and ink in an amount according to the discharge pressure and the viscosity of the ink is discharged from the nozzle hole.

Moreover, an IC chip 1018 in which a circuit to control the driving of the piezoelectric actuator 1017 is built-in and an ink sub-tank 1019 which is capable of storing ink therein and is communicated with the upstream end opening of the ink channel of the cavity unit 1016 are loaded on the carriage 1014.

A feed roller 1022 that feeds a recording sheet 1020 in the sheet feeding tray 1006 to a conveyance path 1021 is provided directly above the sheet feeding tray 1006. The conveyance path 1021 goes upward from the back face side of the sheet feeding tray 1006 to turn around toward the front face side, and passes through between the platen 1012 and the image recording unit 1013 to connect to the sheet discharging tray 1007 (refer to FIG. 16). A conveying roller pair 1023 that pinches and conveys the recording sheet 1020 flowing in the conveyance path 1021 onto the platen 1012 is provided at the back face side of the platen 1012, and a discharge roller pair 1024 that pinches and conveys the recording sheet 1020 which has been printed to the sheet discharging tray 1007 is provided at the front face side of the image recording unit 1013.

Figure 18:
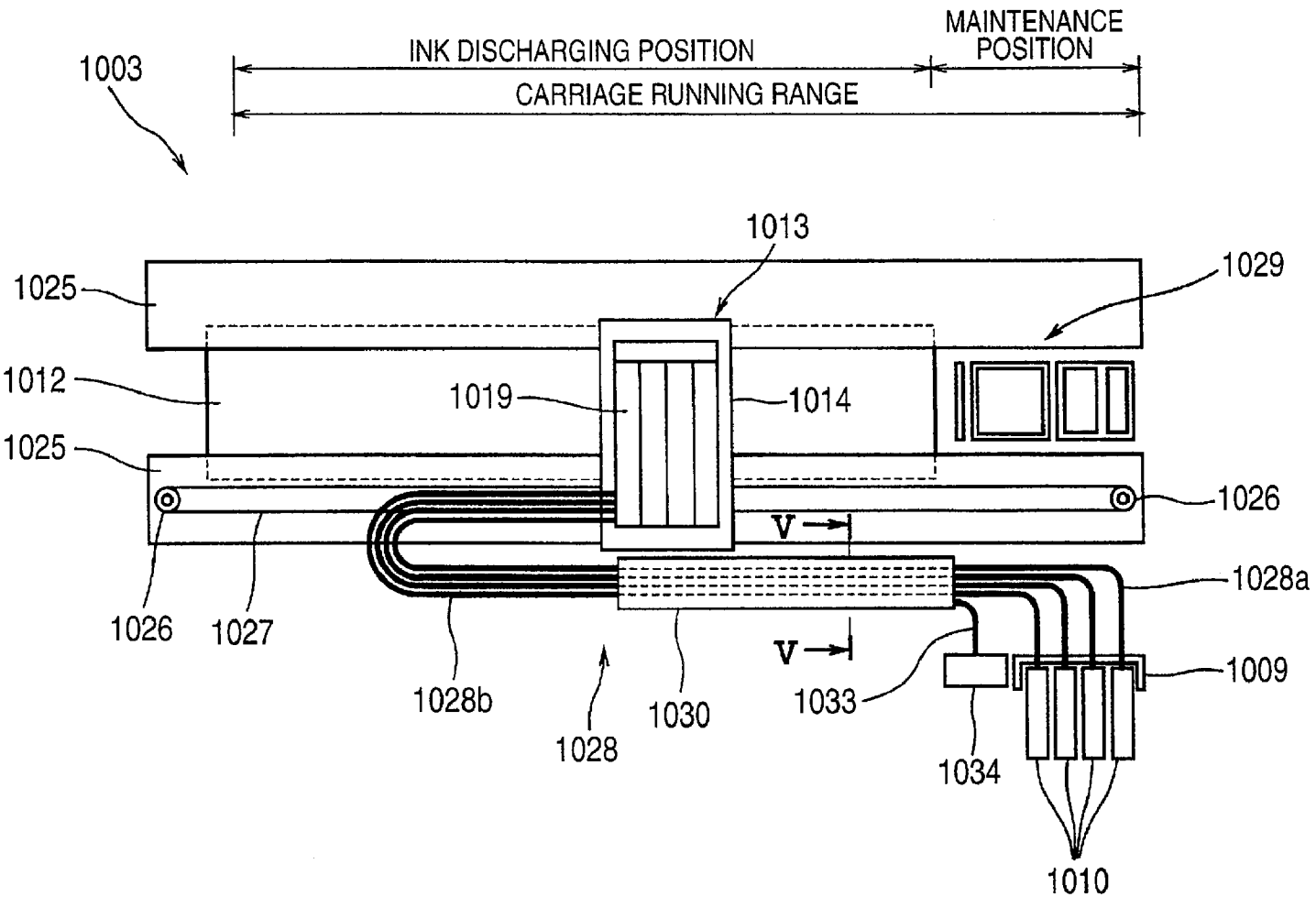
FIG. 18 is a schematic diagram illustrating the schematic structure of the printer of the sixth embodiment in a plan view.

FIG. 18 is a schematic diagram illustrating the schematic structure of the printer 1003 of the sixth embodiment in a plan view. As shown in FIG. 18, a pair of front and rear guide rails 1025 and 1025 extending parallel from side to side is provided above the platen 1012. The carriage 1014 of the image recording unit 1013 is supported so as to be capable of reciprocating from side to side (in a running direction) on the guide rails 1025. The image recording unit 1013 is connected to a timing belt 1027 wound around a pair of pulleys 1026 and 1026, and the timing belt 1027 is installed to be parallel to the extending direction of the guide rail 1025. A motor (not shown) driven to rotate positively and negatively is provided at one of the pulleys 1026 and 1026, and the timing belt 1027 reciprocates due to the pulley 1026 being driven to rotate positively and negatively, and the image recording unit 1013 is made to scan along the guide rails 1025.

The cartridge mounting part 1009 is disposed on the right side of the platen 1012, and the ink cartridges 1010 are mounted onto the cartridge mounting part 1009 so as to be detachable and replaceable. The printer 1003 is capable of performing full-color printing by using four color inks (cyan, magenta, yellow, and black inks), and the four ink cartridges 1010 storing the respective color inks therein are mounted so as to be arrayed from side to side to the cartridge mounting part 1009. The ink sub-tanks 1019 corresponding to the number of the ink cartridges 1010 are provided at the carriage 1014.

Note that, the ink for the printer 1003 is aqueous ink, and the solvent thereof is water. A solid-phase component included in the ink increases the viscosity of the ink. The viscosity of the ink which is one of the factors having an influence on a discharge operation of the discharge head 1015 varies so as to be greater as the concentration of the ink increases.

As shown in FIGS. 17 and 18, ink supply tubes 1028 (liquid supply pipes) to supply the inks in the ink cartridges 1010 to the discharge head 1015 loaded on the carriage 1014 are installed between the respective ink cartridges 1010 and the carriage 1014 inside the housing 1002. The ink supply tubes 1028 are composed of cartridge side ink supply tubes 1028*a* connected to the ink cartridges 1010 and carriage side ink supply tubes 1028*b* connected to the ink sub-tanks 1019, and the both tubes 1028*a* and 1028*b* are communicated with one another via a tube holding member 1030. That is, the ink cartridges 1010 are communicated with the ink sub-tanks 1019 via the both tubes 1028*a* and 1028*b* and the tube holding member 1030.

As shown in FIG. 18, a region above the platen 1012 in the running range of the carriage 1014 is an ink discharging position. The ink discharging position of the printer 1003 has at least a predetermined region corresponding to a width dimension of a recording sheet, and the carriage 1014 is made capable of reciprocating within this range. When the carriage 1014 is within this ink discharging position, the ink is discharged in an appropriate timing from the nozzle hole of the discharge head 1015 toward a recording sheet conveyed toward the front face side along the conveyance path 1021 (refer to FIG. 17) (in a direction perpendicular to the running direction of the carriage 1014) to reach on the platen 1012, which makes it possible to perform a printing operation to print images and characters on the recording sheet.

Note that the right side of the ink discharging position in the running range of the carriage 1014 is a maintenance position. When the carriage 1014 is at this maintenance position, by utilizing a maintenance unit 1029 provided on the right side of the platen 1012, it is possible to perform a wiping operation of wiping the opening surface of the nozzle hole of the discharge head 1015, a flushing operation of discharging ink in order to fix the opening surface of the nozzle hole after wiping, and a purge operation of sucking dried ink, foreign matter, and the like from the nozzle hole by negative pressure.

When the ink in the discharge head 1015 is consumed by a printing operation, a flushing operation, or a purge operation, the inks in the ink sub-tanks 1019 are supplied to the ink channel of the discharge head 1015, and the inks in the ink cartridges 1010 are supplied to the ink sub-tanks 1019 via the ink supply tubes 1028. In this way, the ink supply tubes 1028 are always filled with inks.

Figure 19:
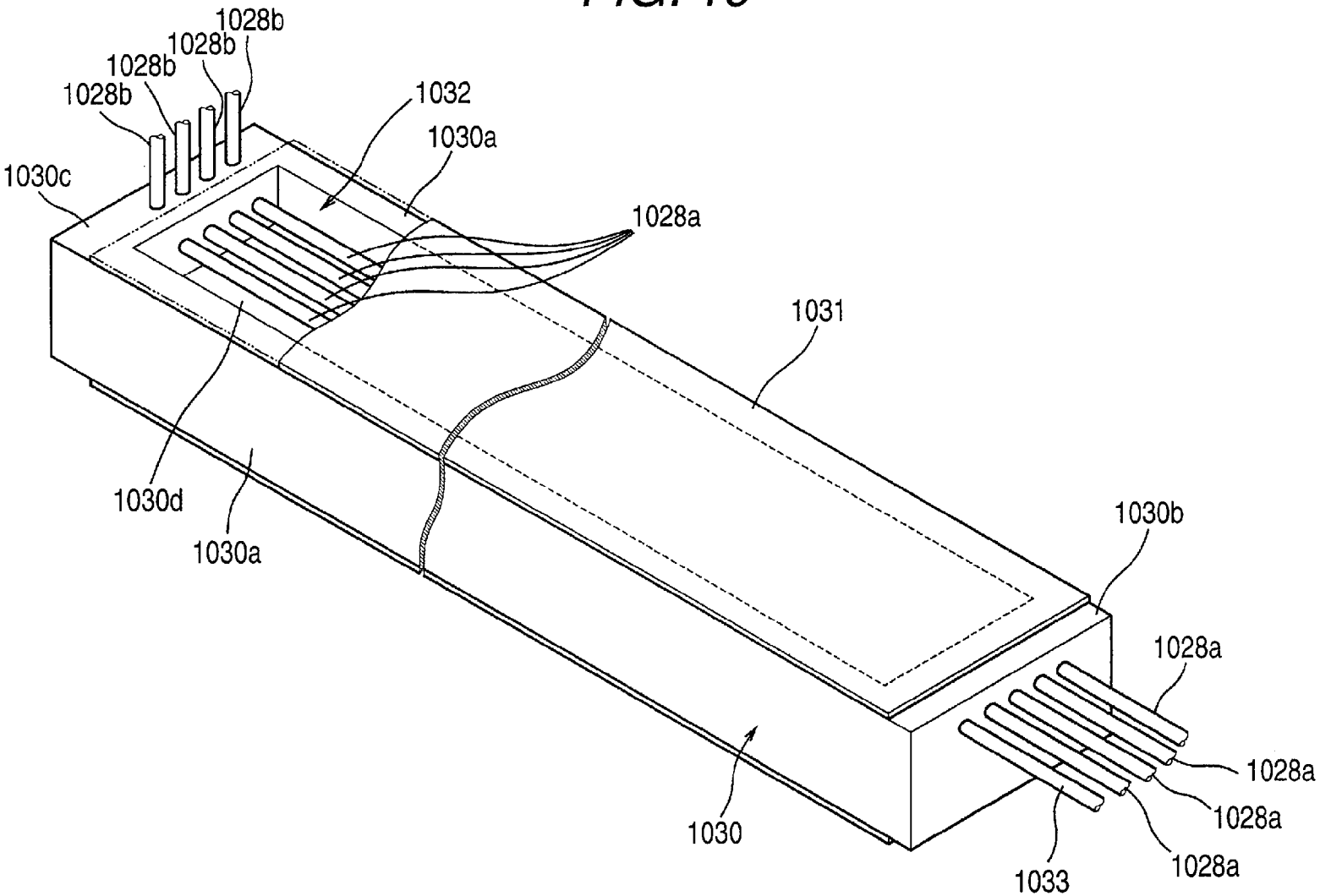
FIG. 19 is a perspective view illustrating the structure of the tube holding member and the periphery of the sixth embodiment.
Figure 20:
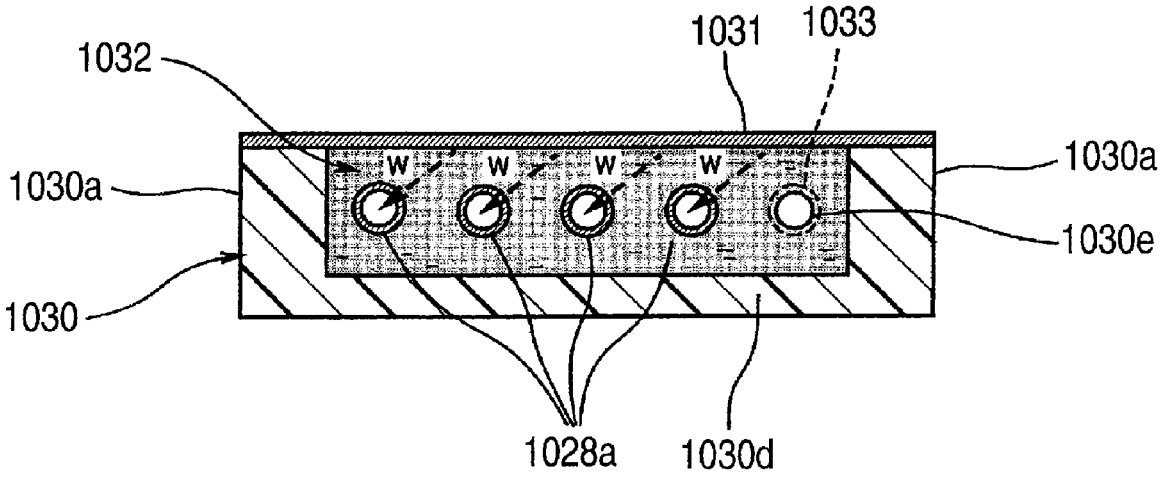
FIG. 20 is a view taken along the line connecting arrows V-V of FIG. 18, and a sectional view of the tube holding member of the sixth embodiment.

FIG. 19 is a perspective view illustrating the structure of the tube holding member 1030 and the periphery thereof. FIG. 20 is a view taken along the line connecting arrows V-V shown in FIG. 18, and a sectional view of the tube holding member 1030. As shown in FIG. 19, the tube holding member 1030 is formed of a material, such as elastomer, with elasticity and low moisture permeability. The tube holding member 1030 is composed of a pair of side walls 1030*a* and 1030*a* extending in a longitudinal direction, one end wall 1030*b* connecting one of the edges of the both side walls 1030*a* and 1030*a*, other end wall 1030*c* connecting the other of the edges of the both side walls 1030*a* and 1030*a*, and a bottom wall 1030*d* connecting the bottom faces of the respective walls

1030*a*, 1030*a*, 1030*b*, and 1030*c*, and as shown in FIG. 20, the tube holding member 1030 is formed into a U lettered shape in section. A film 1031 with low moisture permeability is bonded onto the tube holding member 1030 so as to cover the open surfaces, and with this film, a tube housing space 1032 surrounded by the both side walls 1030*a*, the bottom wall 1030*d*, and the film 1031 is formed.

Each of the respective cartridge side ink supply tubes 1028*a* is inserted into the one end wall 1030*b* of the tube holding member 1030 to extend along the extending direction of the side walls 1030*a* inside the tube housing space 1032, and is pressed into the inner face of the other end wall 1030*c* of the tube holding member 1030. One end of the carriage side ink supply tube 1028*b* is connected to the outer face of the other end wall 1030*c*. An internal channel (not shown) through which the both tubes 1028*a* and 1028*b* are communicated with one another is formed inside the other end wall 1030*c*. The four cartridge side ink supply tubes 1028*a* extend in a longitudinal direction so as to be arrayed at substantially even intervals between the both side walls 1030*a* and 1030*a* in the tube housing space 1032.

As shown in FIGS. 17 to 20, the tube housing space 1032 is communicated with an aqueous solution tank 1034 (refer to FIGS. 17 and 18) via a water supply tube 1033 pressed into a through-hole 1030*e* (refer to FIG. 20) formed in the one side wall 1030*b* of the tube holding member 1030 from the outside. The aqueous solution tank 1034 is attached to a frame substantially horizontally extending from the inner face of the housing 1002, and is disposed on the upper side by a height h from the tube housing space 1032. An aqueous solution using water as a solvent in the same way as the ink can be stored in the inside of the aqueous solution tank 1034. Note that a preservative such as paraben is dissolved in the aqueous solution, which prevents the aqueous solution from changing in quality over a long period. An atmosphere communicating hole 1035 through which the internal space in which the aqueous solution is stored is communicated with the atmosphere is provided at the aqueous solution tank 1034. One end of the water supply tube 1033 is connected to a water outflow hole 1036 through which the internal space of the aqueous solution tank 1034 is communicated with the outside. Accordingly, the inside of the tube housing space 1032 is filled with the aqueous solution stored in the aqueous solution tank 1034, and in a state in which water head pressure according the height h is imparted to the aqueous solution in the tube housing space 1032 as a liquid pressure.

The cartridge side ink supply tubes 1028*a* housed in the tube housing space 1032 to be filled with the aqueous solution are formed of a synthetic resin material, such as silicon rubber, with high moisture permeability. The carriage side ink supply tubes 1028*b* are formed of a synthetic resin material, such as polypropylene, with low moisture permeability.

Because a molar concentration of the aqueous solution is set to be less than a molar concentration of the ink, osmotic pressure according to its concentration difference between the aqueous solution and the ink is generated in the tube housing space 1032. Accordingly, as shown by dashed line arrow W in FIG. 20, the water serving as the solvent for the aqueous solution filling the inside of the tube housing space 1032 is made capable of permeating the inside of the tube via the cartridge side ink supply tubes 1028*a* formed of the material with moisture permeability.

An amount of the water serving as the solvent for the aqueous solution permeating the inside of the tube via the cartridge side ink supply tubes 1028*a* per unit time (a permeability rate) is determined in accordance with the concentration difference between the aqueous solution and the ink that determines osmotic pressure, the height h that determines the water head pressure to be imparted as liquid pressure to the aqueous solution in the tube housing space 1032, a material and a thickness Δ1 (refer to FIG. 17) of the cartridge side ink supply tube 1028*a* that determine water permeable amounts per unit time and per unit area corresponding to the osmotic pressure and the water head pressure, and a surface area of the regions of the cartridge side ink supply tubes 1028*a* housed in the tube housing space 1032 to contact the aqueous solution. Note that the thickness Δ1 of the cartridge side ink supply tube 1028*a* and the water permeable amounts per unit time and per unit area corresponding to osmotic pressure are generally in an inverse proportional relationship. Further, the surface area is determined in accordance with a dimension L1 (refer to FIG. 17) in a longitudinal direction of the tube housing space 1032 and a diameter ϕ1 (refer to FIG. 17) of the cartridge side ink supply tube 1028*a*. In this way, an amount of the water of the aqueous solution permeating per unit time is determined in accordance with the concentration difference between the aqueous solution and the ink, which is appropriately changeable, the specifications of the cartridge side ink supply tube 1028*a* and the tube holding member 1030, and the disposition of the aqueous solution tank 1034.

Further, the ink supply tube 1028 is always filled with ink as described above. The cartridge side ink supply tubes 1028*a* of the ink supply tube 1028 contact the outside air between the ink cartridge 1010 and the tube holding member 1030 inside the housing 1002. The entire carriage side ink supply tubes 1028*b* contact the outside air inside the housing 1002. In this way, the water serving as the solvent for the ink at the portions contacting the outside air evaporates exteriorly from the tubes.

An amount of the water of the ink in the cartridge side ink supply tubes 1028*a* evaporating exteriorly from the tubes per unit time is determined in accordance with a material and a thickness Δ1 (refer to FIG. 2) of the cartridge side ink supply tubes 1028*a* that determine the amounts of the water serving as the solvent for the ink evaporating per unit time and per unit area, and a surface area of the portion of the cartridge side ink supply tubes 1028*a* contacting the outside air. This surface area can be determined in accordance with a length L2 of the portions of the tubes 1028*a* contacting the outside air (refer to FIG. 17) and a diameter ϕ1 of the tube 1028*a* (refer to FIG. 17). In the same way, an amount of the water of the ink in the carriage side ink supply tubes 1028*b* evaporating exteriorly from the tubes per unit time is determined in accordance with a material and a thickness Δ3 (refer to FIG. 17) of the carriage side ink supply tubes 1028*b* and a surface area of the portions of the carriage side ink supply tubes 1028*b* contacting the outside air. This surface area can be determined in accordance with a length L3 (refer to FIG. 17, entire length in the present embodiment) of the portions of the tubes 1028*b* contacting the outside air and a diameter p3 of the tube 1028*b* (refer to FIG. 17). Note that the thicknesses A1 and A3 of the respective tubes 1028*a* and 1028*b* and the amounts of the water of the ink evaporating per unit time and per unit area are generally in an inverse proportional relationship. A sum of the amounts of evaporation from the respective tubes 1028*a* and 1028*b* per unit time obtained in this way is a total volume of the amounts of evaporation via the ink supply tube 1028. An amount of the water of the ink evaporating per unit time is determined in accordance with a specification of the ink supply tube 1028.

Accordingly, by taking into consideration the respective parameters with which a permeable amount of the water serving as the solvent for the aqueous solution per unit time is determined and the respective parameters with which an amount of evaporation of the water serving as the solvent for the ink per unit time is determined, it is possible to set these permeable amount and amount of evaporation to be equal.

In the printer 1003 configured in this way, even in a case in which the water of the ink in the ink supply tube 1028 evaporates, water in an amount equal to the amount of evaporation permeates the inside of the ink reservoir chamber 1032. In accordance therewith, the concentration of the ink can be kept constant over a long period, and the viscosity of the ink can be kept constant over a long period.

Note that, because the solvent for the ink is water, and the solvent for the liquid filling the inside of the tube housing space 1032 is water in the same way as the ink, even in a case in which the solvent for the liquid in the tube housing space 1032 permeates the inside of the tube via the cartridge side ink supply tubes 1028*a*, the permeation merely has an influence on the concentration of the ink, but does not change the composition of the ink.

Further, in the present embodiment, because water head pressure is imparted to the aqueous solution in the tube housing space 1032, it is possible to increase the amounts of the water permeating the inside of the tubes per unit time and per unit area in accordance with the imparted liquid pressure. In this way, by adjusting the water head pressure through the setting for the disposition of the aqueous solution tank 1034, the permeable amount and the amount of evaporation can be set to be equal. Further, even in a case in which the aqueous solution in the tube housing space 1032 is decreased due to permeation, the aqueous solution in the aqueous solution tank 1034 is replenished via the water supply tube 1033, which makes it possible to keep an amount of the aqueous solution in the tube housing space 1032 constant.

Note that, as shown in FIG. 19, the water supply tube 1033 that supplies the aqueous solution into the tube housing space 1032 of the tube holding member 1030 is connected to the one end wall 1030*b* located at the cartridge side of the tube holding member 1030. Because the one end wall 1030*b* located at such a position is at a remote position from the carriage 1014, an amount of movement according to the reciprocation of the carriage 1014 is made less than that at the carriage side. Accordingly, a moving amount of the water supply tube 1033 drawn by the tube holding member 1030 is slight even when the carriage 1014 reciprocates, which makes it possible to make a space to lead the water supply tube 1033 around inside the housing 1002 compact.

Further, in the present embodiment, the ink supply tube 1028 connecting the ink cartridges 1010 and the carriage 1014 is composed of the two tubes at the cartridge side and the carriage side. Only one of those (the cartridge side ink supply tube in the present embodiment) is housed in the tube housing space 1032 filled with the aqueous solution, and the other one (the carriage side ink supply tube in the present embodiment) is provided so as to entirely contact the outside air. In the present embodiment, because the material with high moisture permeability is selected for the tube through which water is permeable, and the material with low moisture permeability is selected for the tube contacting the outside air, it is possible to effectively perform both of the acceleration of water permeation and the suppression of evaporation. In accordance therewith, because a permeable amount of water required for keeping an ink concentration constant is decreased by suppressing evaporation, and at the same time, a permeable amount of water per unit area is increased, the volume of the tube housing space 1032 can be downsized.

Note that the ink supply tube connecting the ink cartridges 1010 and the carriage 1014 may be one, or may be divided into three of a portion connecting the ink cartridges 1010 and the tube holding member, a portion housed in the tube housing space 1032, and a portion connecting the tube holding member and the carriage. In a case in which the ink supply tube is divided into three, provided that the portion housed in the tube housing space 1032 is formed of a material with high moisture permeability, and the remaining two portions are formed of a material with low moisture permeability, it is possible to further improve the above-described effect.

Next, a seventh embodiment of the present invention will be described. The seventh embodiment is different in its structure to impart liquid pressure to the aqueous solution from the above-described embodiment. Note that structures which are the same as those of the above-described embodiment are denoted by the same reference numerals, and descriptions thereof will be simplified.

Figure 21:
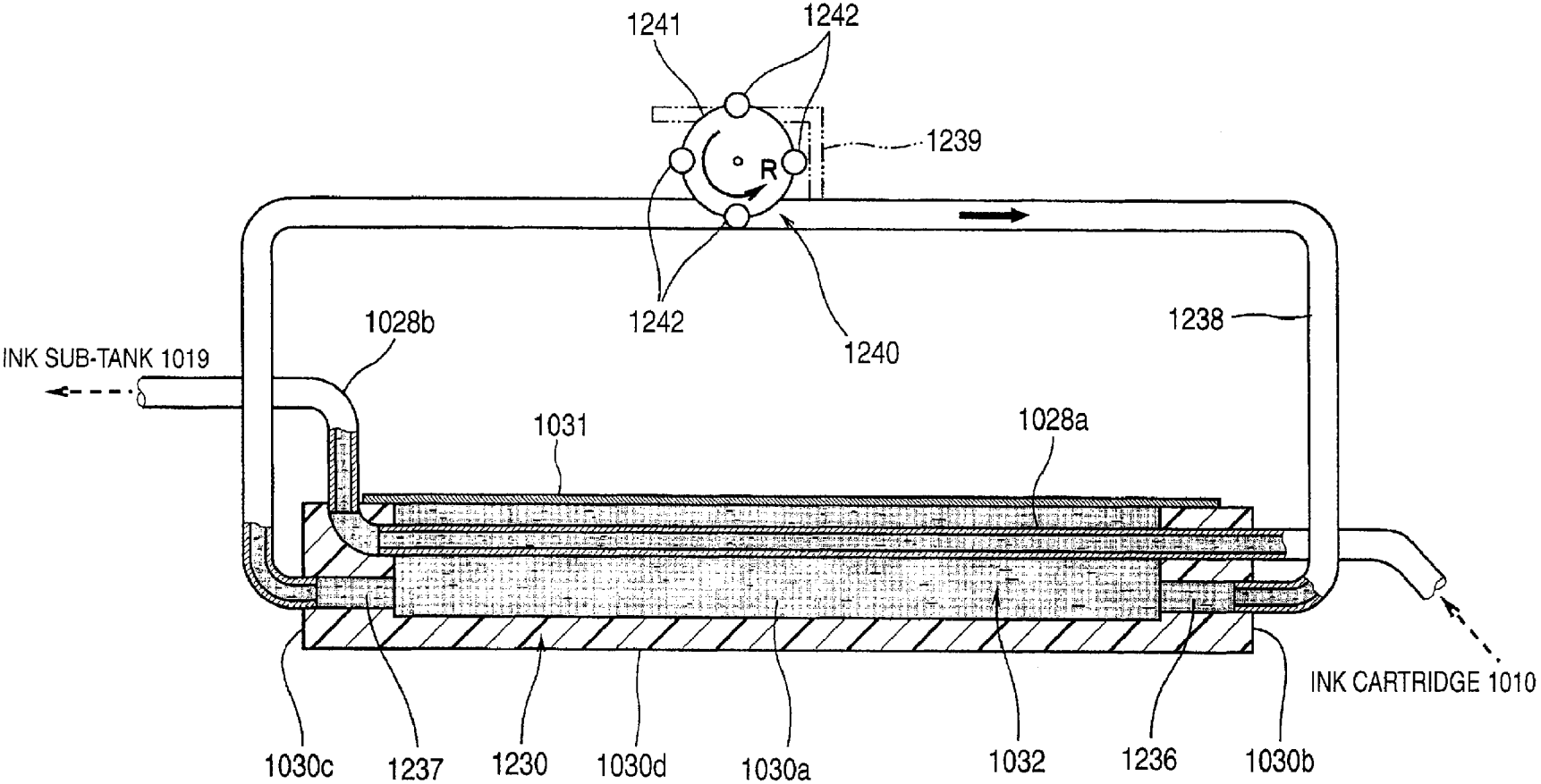
FIG. 21 is a schematic diagram illustrating the structure of a tube holding member 1230 and a periphery thereof of a seventh embodiment in a sectional side view.

FIG. 21 is a schematic diagram illustrating the structure of a tube holding member 1230 and the periphery thereof of the seventh embodiment in a side sectional view. As shown in FIG. 21, the tube holding member 1230 is the same in outer shape as that of the sixth embodiment, and the tube holding member 1230 is formed into a U lettered shape in section, which has a pair of the side walls 1030*a* and 1030*a*, the one end wall 1030*b* located at the cartridge side, the other end wall 1030*c* located at the carriage side, and the bottom wall 1030*d*, and the film 1031 is attached onto the tube holding member 1230 so as to cover the open surfaces. The cartridge side ink supply tubes 1028*a* are housed in the tube housing space 1032 formed thereby, and the tube housing space 1032 is filled with the aqueous solution described above.

A first communicating hole 1236 which is provided in the one end wall 1030*b* to cause the tube housing space 1032 to be communicated with the outside and a second communicating hole 1237 which is provided in the other end wall 1030*c* to cause the tube housing space 1032 to be communicated with the outside are provided at the tube holding member 1230. A water circulation tube 1238 connecting the first communicating hole 1236 and the second communicating hole 1237 is provided outside the tube holding member 1230.

Further, a pump 1240 to circulate the aqueous solution in the water circulation tube 1238 is provided so as to be supported by a frame 1239 extending from the inner side face of the housing. This pump 1240 is constituted by a tube pump, and is composed of a drum 1241 driven to rotate in a predetermined rotation direction shown by arrow R, and a plurality of indenters 1242 provided so as to protrude from the outer circumferential surface of the drum 1241, and are pressed to contact the water circulation tube 1238 from the outside. When the drum 1241 is driven to rotate, the indenters 1242 rotate so as to crush the water circulation tube 1238, and dynamic pressure is imparted to the aqueous solution in the tube 1238 in accordance with the rotation, and a coolant is made to flow in one direction along the rotating direction of the indenters 1242.

In the present embodiment, the dynamic pressure imparted by the pump 1240 corresponds to the water head pressure in the sixth embodiment. Due to the dynamic pressure being imparted to the aqueous solution, the water serving as the solvent for the aqueous solution permeates the inside of the tube via the cartridge side ink supply tubes 1028*a* as shown by dashed line arrow W. However, when the pump 1240 is driven so as to increase dynamic pressure, it is possible to increase permeable amounts of the ink supply tubes 1028*a* per unit area and per unit time. Therefore, the volume of the tube housing space 1032 can be downsized.

Next, an eighth embodiment of the present invention will be described. The eighth embodiment is different in an internal structure of the ink cartridge from the above-described embodiment. Here, the eighth embodiment is considered as a modified embodiment of the sixth embodiment for descriptive purposes. However, the internal structure can be applied to the seventh embodiment as well. Note that structures which are the same as those of the above-described embodiment are denoted by the same reference numerals, and descriptions thereof will be simplified.

Figure 22:
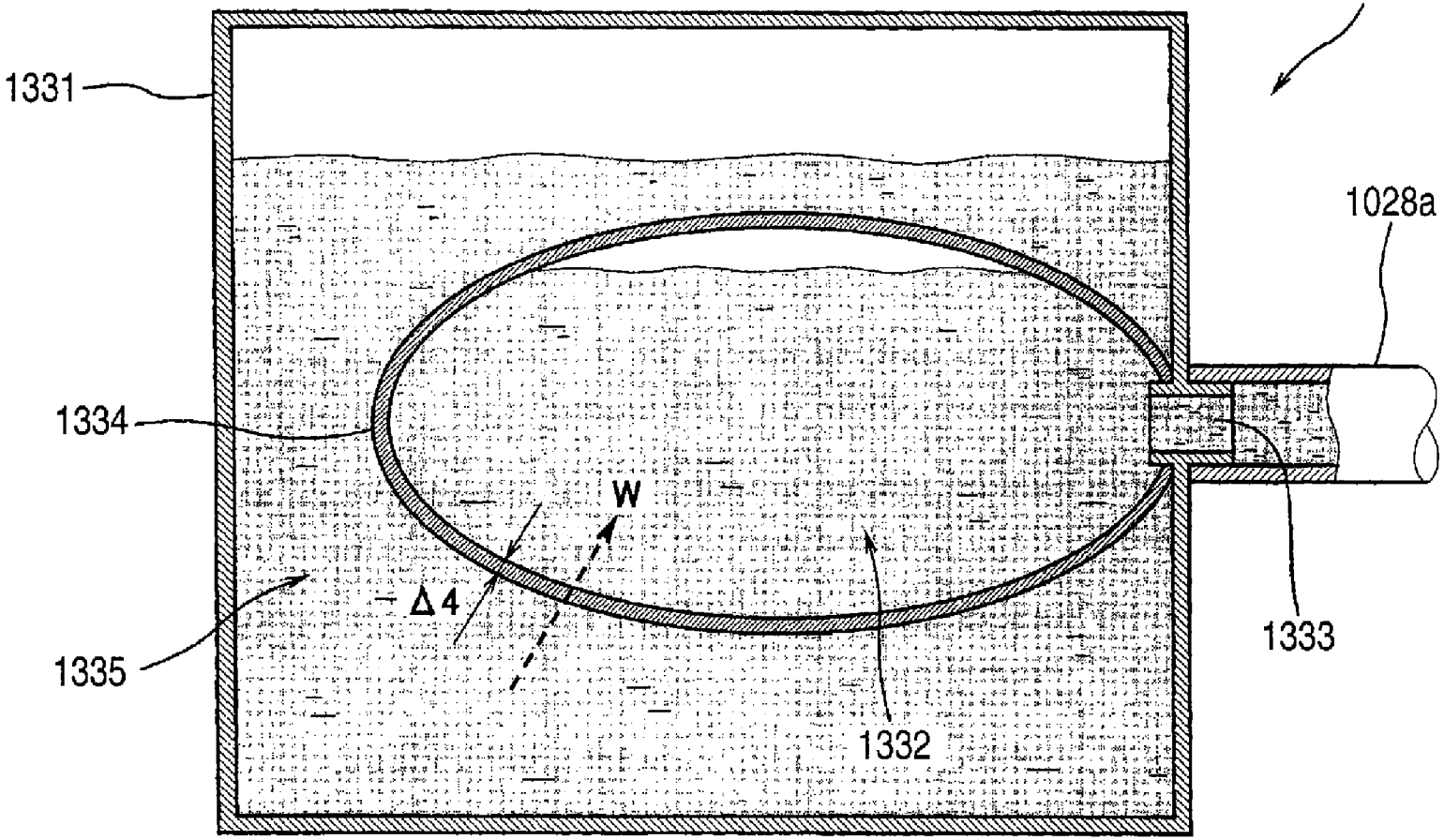
FIG. 22 is a sectional view illustrating the internal structure of an ink cartridge of an eighth embodiment.

FIG. 22 is a sectional view illustrating the internal structure of an ink cartridge 1310 of the eighth embodiment. The ink cartridge 1310 has a rectangular parallelepiped casing 1331 formed of a synthetic resin material, and an ink pack 1334 forming an ink reservoir chamber 1332 is housed in the casing 1331. An ink supply hole 1333 through which the ink reservoir chamber 1332 is communicated with the outside is provided at the casing 1331, and when the cartridge 1310 is mounted to the cartridge mounting part 1009, an end of the cartridge side ink supply tube 1028*a* is connected to the ink supply hole 1333. A valve mechanism (not shown) which is usually closed and is connected to the end of the ink supply tube 1028*a* to be opened is provided inside an ink supply hole 1333 of the ink cartridge 1310. The ink pack 1334 is formed of a film with moisture permeability such as a polystyrene film, a urethane film, or a polyolefin film. A water reservoir chamber 1335 is formed at a space region outside the ink pack 1334 in the casing 1331, and the aqueous solution described above is stored in the water reservoir chamber 1335.

The ink cartridge 1310 has the ink reservoir chamber 1332 surrounded by the inner face of the ink pack 1334, and the water reservoir chamber 1335 surrounded by the outer face of the ink pack 1334 and the inner face of the casing 1331, and the both chambers 1332 and 1335 are partitioned with the permeable film forming the ink pack 1334.

In the ink cartridge 1310, osmotic pressure is generated in accordance with a concentration difference between the aqueous solution stored in the water reservoir chamber 1335 and the ink stored in the ink reservoir chamber 1332, and as shown by dashed line arrow W, the water serving as the solvent for the aqueous solution stored in the water reservoir chamber 1335 is made capable of permeating the inside of the ink reservoir chamber 1332 via the ink pack 1334.

An amount of the water serving as the solvent for the aqueous solution stored in the water reservoir chamber 1335, that permeates the inside of the ink reservoir chamber 1332 via the ink pack 1334 per unit time (a permeability rate) is determined in accordance with a concentration difference between the aqueous solution and the ink that determines osmotic pressure, a material and a thickness Δ4 of the ink pack 1334 that determine water permeable amounts per unit time and per unit area corresponding to the osmotic pressure, and an area of the region of the ink pack 1334 partitioning its inside into the ink reservoir chamber 1332 and the water reservoir chamber 1335 (corresponding to the entire surface area of the ink pack 1334 in the present embodiment). Note that the thickness Δ4 of the ink pack 1334 and the water permeable amounts per unit time and per unit area corresponding to osmotic pressure are generally in an inverse proportional relationship. In this way, an amount of the water of the aqueous solution permeating per unit time is determined in accordance with a concentration difference between the aqueous solution and the ink, which is appropriately changeable, and a specification of the ink pack 1334.

Then, a total permeable amount of water in the present embodiment is a sum of the permeable amount of the water of the aqueous solution in the tube housing space 1032 described in the sixth embodiment and the permeable amount of the water of the aqueous solution in the ink cartridge 1010. On the other hand, the water serving as the solvent for the ink evaporates by an amount as described in the sixth embodiment. Accordingly, by taking into consideration the respective parameters with which a permeable amount of the water serving as the solvent for the aqueous solution per unit time is determined and the respective parameters with which an amount of evaporation of the water serving as the solvent for the ink per unit time is determined, it is possible to set these permeable amount and amount of evaporation to be equal.

Next, a ninth embodiment of the present invention will be described. The ninth embodiment is different in an internal structure of the ink cartridge from the eighth embodiment. Note that structures which are the same as those of the eighth embodiment are denoted by the same reference numerals, and descriptions thereof will be simplified.

Figure 23A:
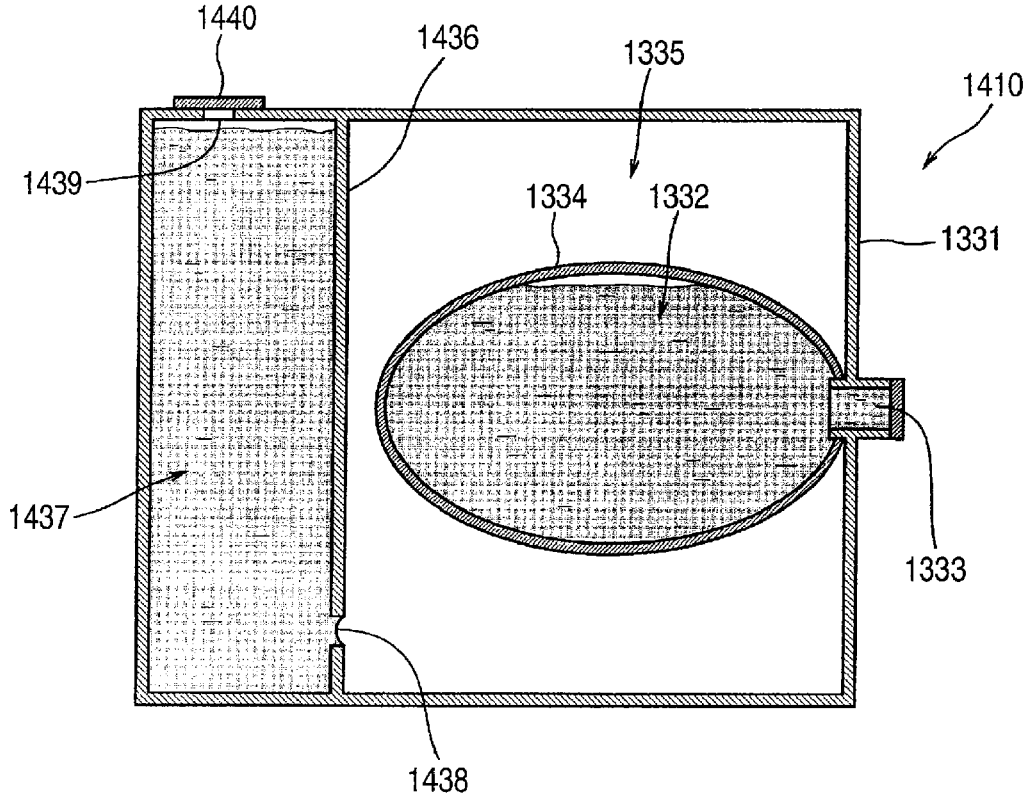
FIG. 23A shows a state before the ink cartridge is mounted.
Figure 23B:
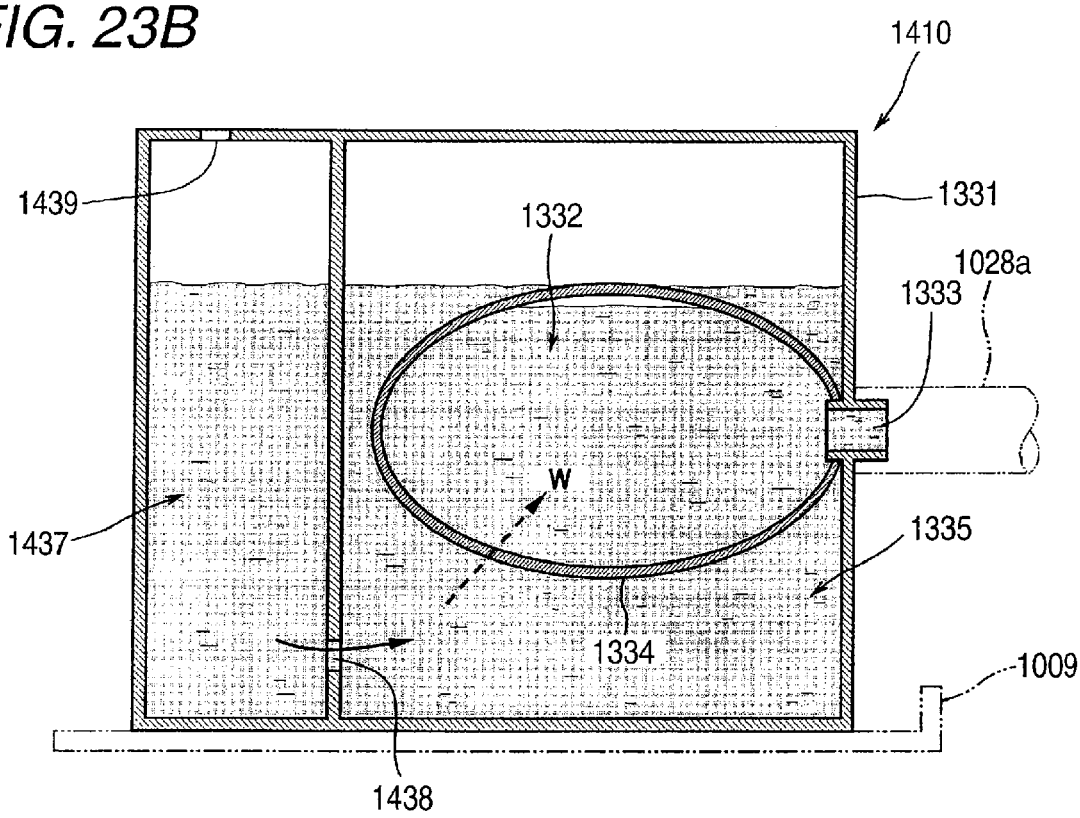

FIG. 23 is a sectional view illustrating the internal structure of an ink cartridge 1410 of the ninth embodiment. FIG. 23A shows a state before the ink cartridge 1410 is mounted on the cartridge mounting part 1009, and FIG. 23B shows a state in which the ink cartridge 1410 is mounted on the cartridge mounting part 1009. As shown in FIG. 23, a partition wall 1436 that partitions the inside into the water reservoir chamber 1335 and an initial water reservoir chamber 1437 (an initial liquid reservoir chamber) is provided in the casing 1331 of the ink cartridge 1410. The inside of the casing 1331 is divided into two in this way. However, the ink pack 1334 is built in the water reservoir chamber 1335, and the initial water reservoir chamber 1437 forms a space isolated from the ink pack 1334. The initial water reservoir chamber 1437 is communicated with the water reservoir chamber 1335 via a small opening 1438 formed so as to pass through the partition wall 1436, and is communicated with the atmosphere via an atmosphere communicating hole 1439 formed in the casing 1331. Further, in the same way as in the eighth embodiment, the ink supply hole 1333 through which the ink reservoir chamber 1332 is communicated with the outside is provided at the casing 1331, and a valve mechanism (not shown) is provided in the ink supply hole 1333.

At the time of manufacturing the ink cartridge 1410, the ink reservoir chamber 1332 is filled with aqueous ink, and as shown in FIG. 23A, the inside of the initial water reservoir chamber 1437 is filled with the aqueous solution described above, and the inner pressure in the water reservoir chamber 1335 and the initial water reservoir chamber 1437 is reduced to be negative pressure as compared with the atmosphere pressure. A seal 1440 is bonded onto the outer face of the casing 1331 so as to be easily detachable, and the atmosphere communicating hole 1439 is sealed up with the seal 1440, and the water reservoir chamber 1335 and the initial water reservoir chamber 1437 are maintained in a depressurized state. The small opening 1438 is formed to be sufficiently small in order for the aqueous solution filling the inside of the initial water reservoir chamber 1437 to form a meniscus by its surface tension, and in a state in which the seal 1440 is bonded thereto, the aqueous solution in the initial water reservoir chamber 1437 does not flow into the water reservoir chamber 1335.

In contrast thereto, as shown in FIG. 23B, when the seal 1440 is detached therefrom, the initial water reservoir chamber 1437 is communicated with the atmosphere via the atmosphere communicating hole 1439, and the inside of the initial water reservoir chamber 1437 is made to have positive pressure as compared with that in the water reservoir chamber 1335. In accordance therewith, the meniscus formed in the small opening 1438 is broken, and the water in the initial water reservoir chamber 1437 passes through the small opening 1438 to flow into the water reservoir chamber 1335.

In accordance with the ink cartridge 1410 of the present embodiment, in a state in which the seal 1440 is bonded thereto, water is stored in the initial water reservoir chamber 1437 independent of the ink reservoir chamber 1332, and the water does not permeate the inside of the ink reservoir chamber 1332. From which the seal 1440 is detached, the aqueous solution flows into the water reservoir chamber 1335, and as shown by the dashed line arrow W in FIG. 23B, the water serving as the solvent for the flowed aqueous solution is capable of permeating the inside of the ink reservoir chamber 1332 via the ink pack 1334. Accordingly, unless the seal 1440 is not detached therefrom directly before the ink cartridge 1410 is detached to be replaced, it is possible to prevent the water of the aqueous solution from permeating the inside of the ink reservoir chamber 1332 during a period from the time of manufacturing it to the time of mounting it onto the cartridge mounting part 1009. In this way, provided that the seal 1440 is handled correctly, it is possible to keep the concentration of the ink stored in the ink reservoir chamber 1332 in an appropriate state until the ink cartridge 1410 is actually used.

Next, a tenth embodiment of the present invention will be described. The tenth embodiment is different from the third and ninth embodiments in the point that a liquid pressure applying unit 1541 to apply liquid pressure to the aqueous solution in the water reservoir chamber 1335 is separately provided. Here, the tenth embodiment is considered as a modified embodiment of the ninth embodiment for descriptive purposes, and the liquid pressure applying unit 1541 can be applied to the eighth embodiment as well. Note that structures which are the same as those of the above-described ninth embodiment are denoted by the same reference numerals, and descriptions thereof will be simplified.

Figure 24:
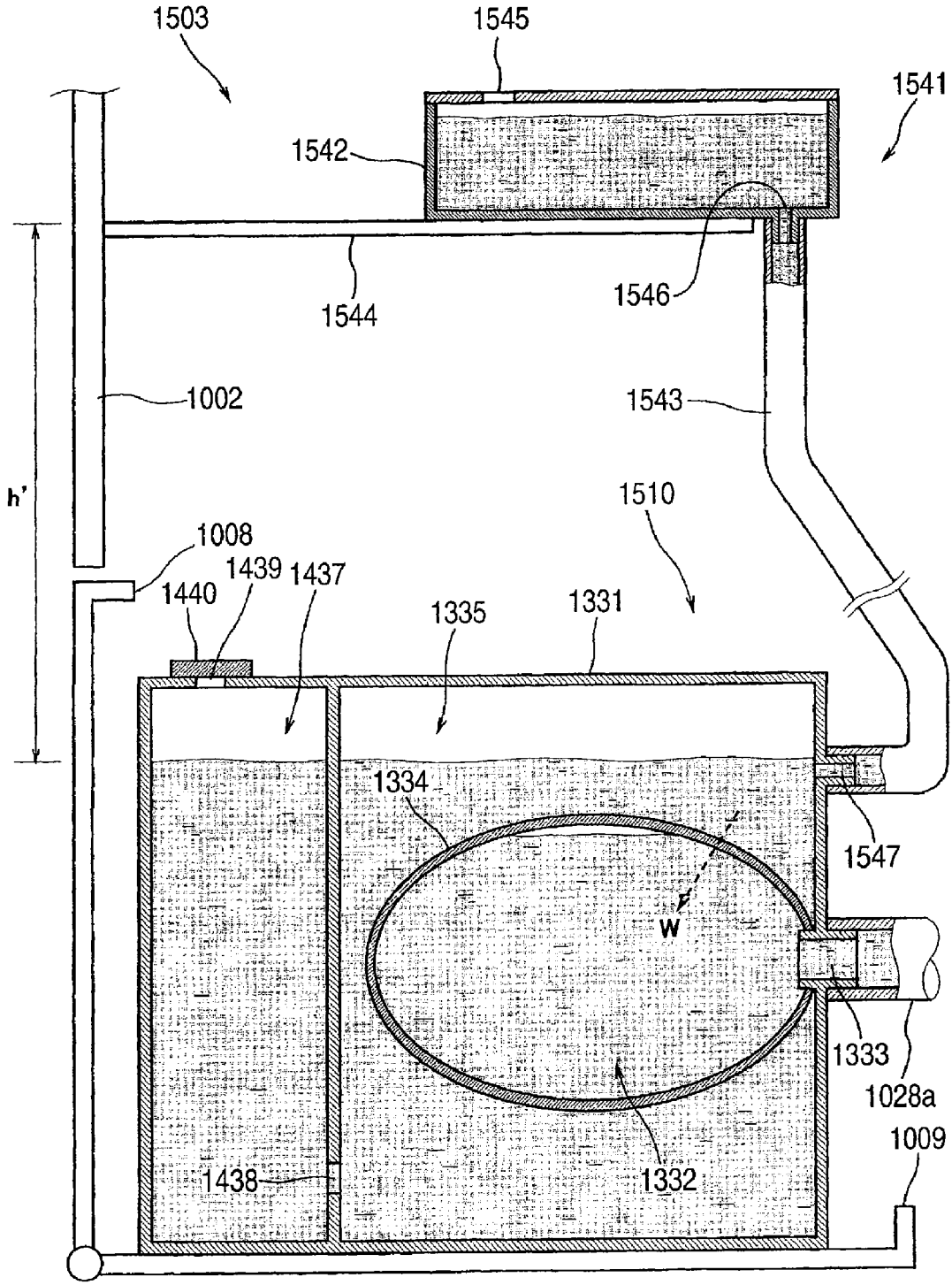
FIG. 24 is a schematic diagram illustrating the internal structure of an ink cartridge and the structure of a liquid pressure imparting unit of a tenth embodiment in a lateral view.

FIG. 24 is a schematic diagram illustrating the internal structure of an ink cartridge 1510 and the structure of the liquid pressure applying unit 1541 of the tenth embodiment, and shows a state in which the ink cartridge 1510 from which the seal 1440 is detached is mounted on the cartridge mounting part 1009. As shown in FIG. 24, the liquid pressure imparting unit 1541 includes an upper water tank 1542 provided above the water reservoir chamber 1335 of the ink cartridge 1510, and a water supply tube 1543 through which the upper water tank 1542 is communicated with the water reservoir chamber 1335. The upper water tank 1542 is attached to a frame 1544 horizontally extending from an area higher than the door 1008 on the inner face of the housing 1002, and is disposed on the upper side by a predetermined height h' from the water reservoir chamber 1335. The upper water tank 1542 is capable of storing the aqueous solution described above therein, and the internal space is communicated with the atmosphere via an atmosphere communicating hole 1545. The water supply tube 1543 connects a water supply hole 1546 through which the internal space of the upper water tank 1542 is communicated with the outside and a water inflow hole 1547 through which the water reservoir chamber 1335 of the ink cartridge 1510 is communicated with the outside therebetween. Accordingly, water head pressure determined in accordance with the height h' is applied to the aqueous solution in the water reservoir chamber 1335. Note that an end of the water supply tube 1543 to be connected to the water inflow hole 1547 is supported by a support mechanism (not shown) to fix its disposition, and when the ink cartridge 1510 is mounted on the cartridge mounting part 1009, the end of the water supply tube 1543 is automatically connected to the water inflow hole 1547. Then, a valve mechanism (not shown) which is usually closed and is connected to the end of the water inflow hole 1547 to be opened is provided inside the end of the water supply tube 1543. With this valve mechanism, the aqueous solution in the upper water tank 1542 is prevented from leaking out of the water supply tube 1543 when the ink cartridge 1510 is not mounted on the cartridge mounting part 1009. Further, a valve mechanism (not shown) which is usually closed and is connected to the end of the water supply tube 1543 to be opened is provided inside the water inflow hole 1547 of the ink cartridge 1510.

In this way, in the present embodiment, because the aqueous solution in the water reservoir chamber 1335 receives the water head pressure to increase its liquid pressure, it is possible to increase the amounts of the water of the aqueous solution in the water reservoir chamber 1335 permeating the inside of the ink reservoir chamber 1332 via the ink pack 1334 per unit time and per unit area. Further, even in a case in which the aqueous solution in the water reservoir chamber 1335 is decreased due to permeation, the aqueous solution in the upper water tank 1542 is replenished via the water supply tube 1543, which makes it possible to keep an amount of the aqueous solution in the water reservoir chamber 1335 constant.

Next, an eleventh embodiment of the present invention will be described. The eleventh embodiment is different from the third to tenth embodiments in the point that a cooling unit 1648 to cool the periphery of the discharge head 1015 is provided. Here, the eleventh embodiment is considered as a modified embodiment of the ninth embodiment for descriptive purposes, and the cooling unit 1448 can be applied to the third and tenth embodiments as well. Structures which are the same as those of the above-described embodiments are denoted by the same reference numerals, and descriptions thereof will be simplified.

Figure 25:
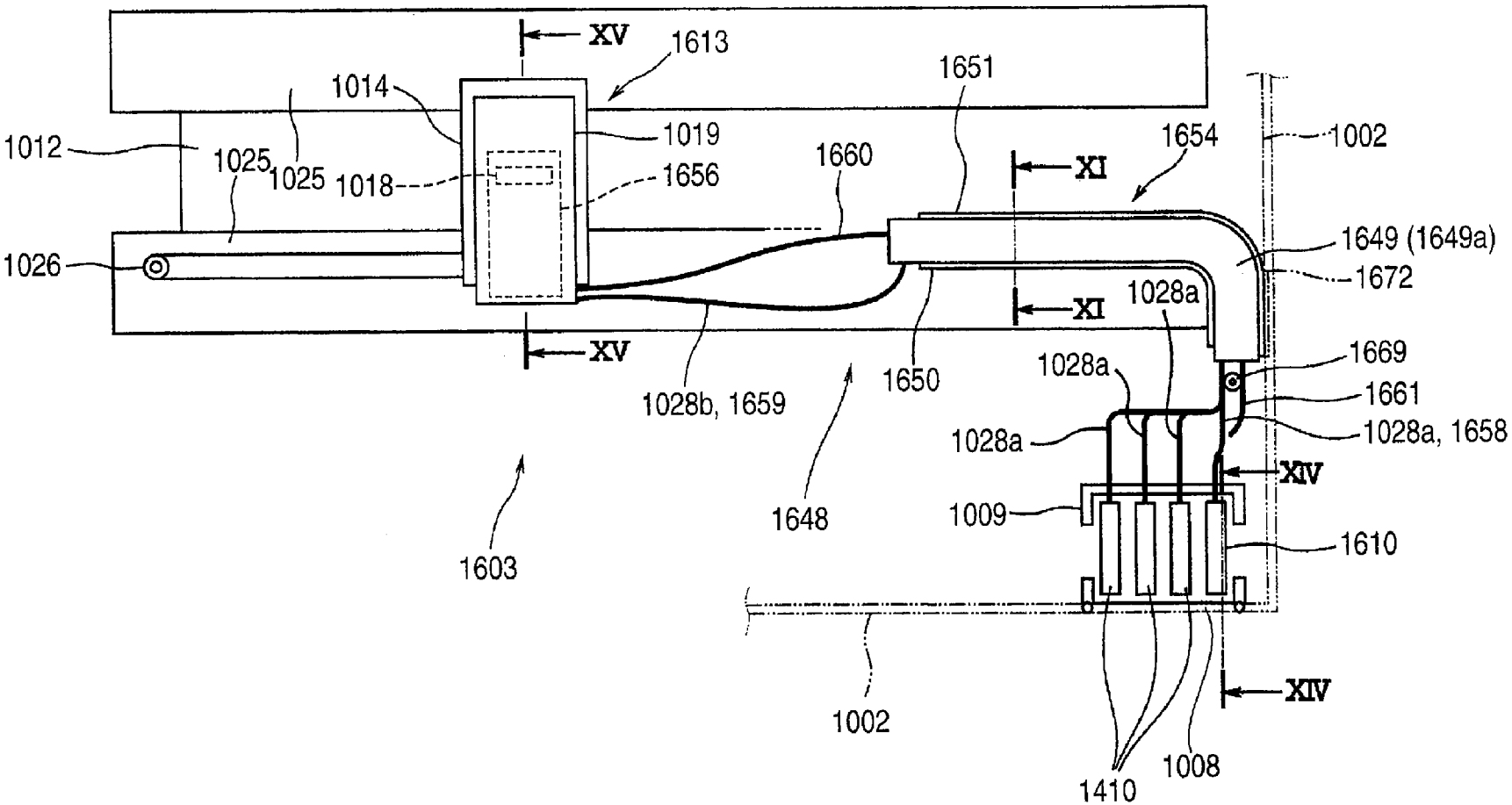
FIG. 25 is a schematic diagram illustrating the schematic structure of a printer of an eleventh embodiment in a plan view.

FIG. 25 is a schematic diagram illustrating the schematic structure of a printer 1603 of the eleventh embodiment in a plan view. The printer 1603 is provided inside the housing 1002 shown in FIG. 16 to form the multifunctional device 1. As shown in FIG. 25, four ink cartridges are mounted on the cartridge mounting part 1009 in order to perform full-color printing. However, three of the four ink cartridges have the same structure as that of the ink cartridge 1410 in the ninth embodiment shown in FIG. 23, and a remaining ink cartridge 1610 is one in which the structure of the ink cartridge 1410 in the ninth embodiment is modified as will be described later.

Figure 29:
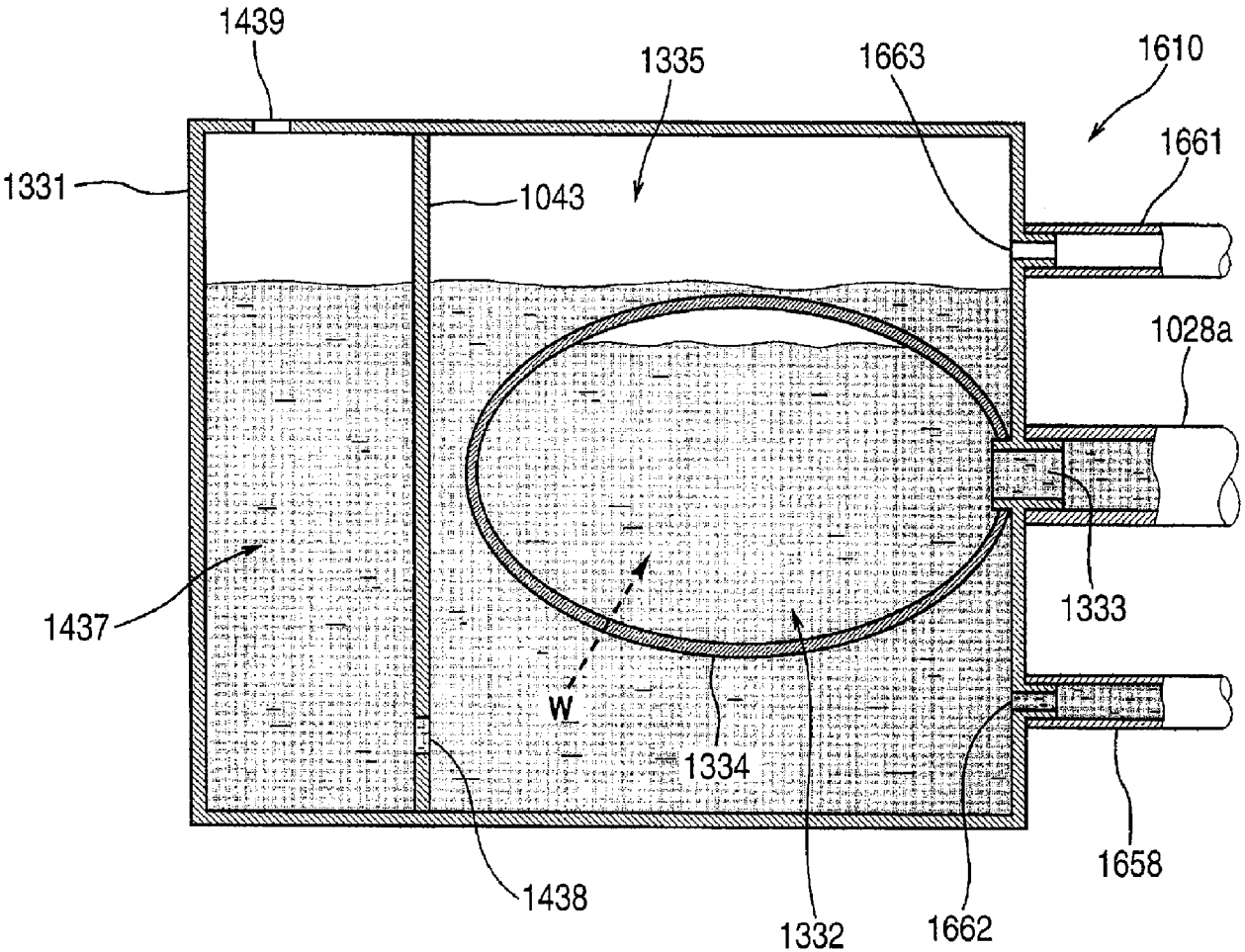
FIG. 29 is a view taken along the line connecting arrows XIV-XIV of FIG. 25, and a sectional view illustrating the internal structure of an ink cartridge of the eleventh embodiment.
Figure 30:
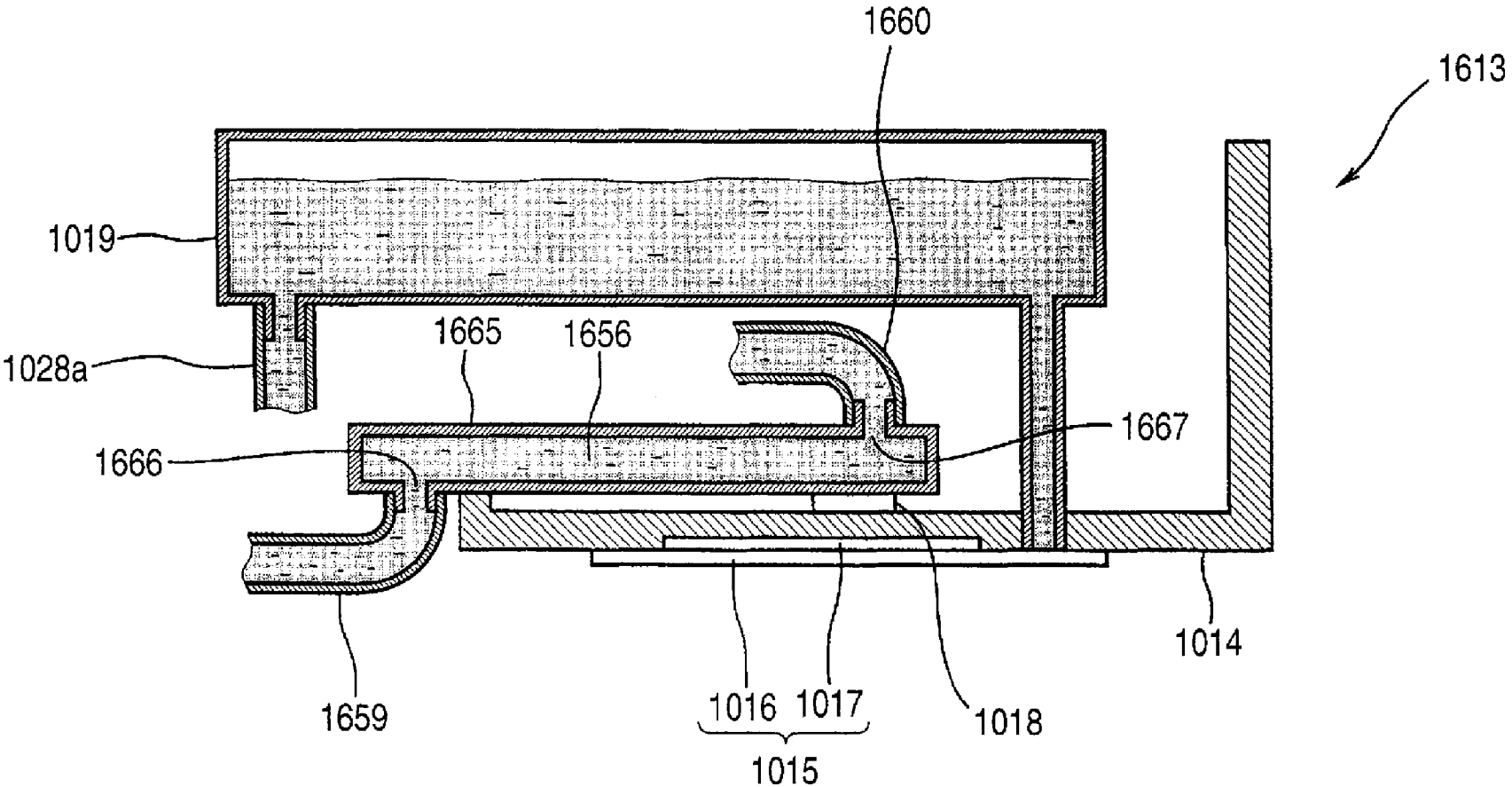
FIG. 30 is a view taken along the line connecting arrows XV-XV of FIG. 25, and a schematic diagram illustrating the structure of an image recording unit of the eleventh embodiment in a side sectional view.

First, to describe a structure to connect the ink cartridges 1410 and 1610 and the ink sub-tank 1019, the cartridge side ink supply tubes 1028*a* are connected to the ink supply holes 1333 (refer to FIGS. 23 and 29) of the respective ink cartridges 1410 and 1610, and the ink supply tubes 1028*a* are connected to the carriage side ink supply tubes 1028*b* via a tube holding member 1649, and the carriage side ink supply tubes 1028*b* are connected to the ink sub-tanks 1019 (refer to FIG. 30 as well).

Figure 26:
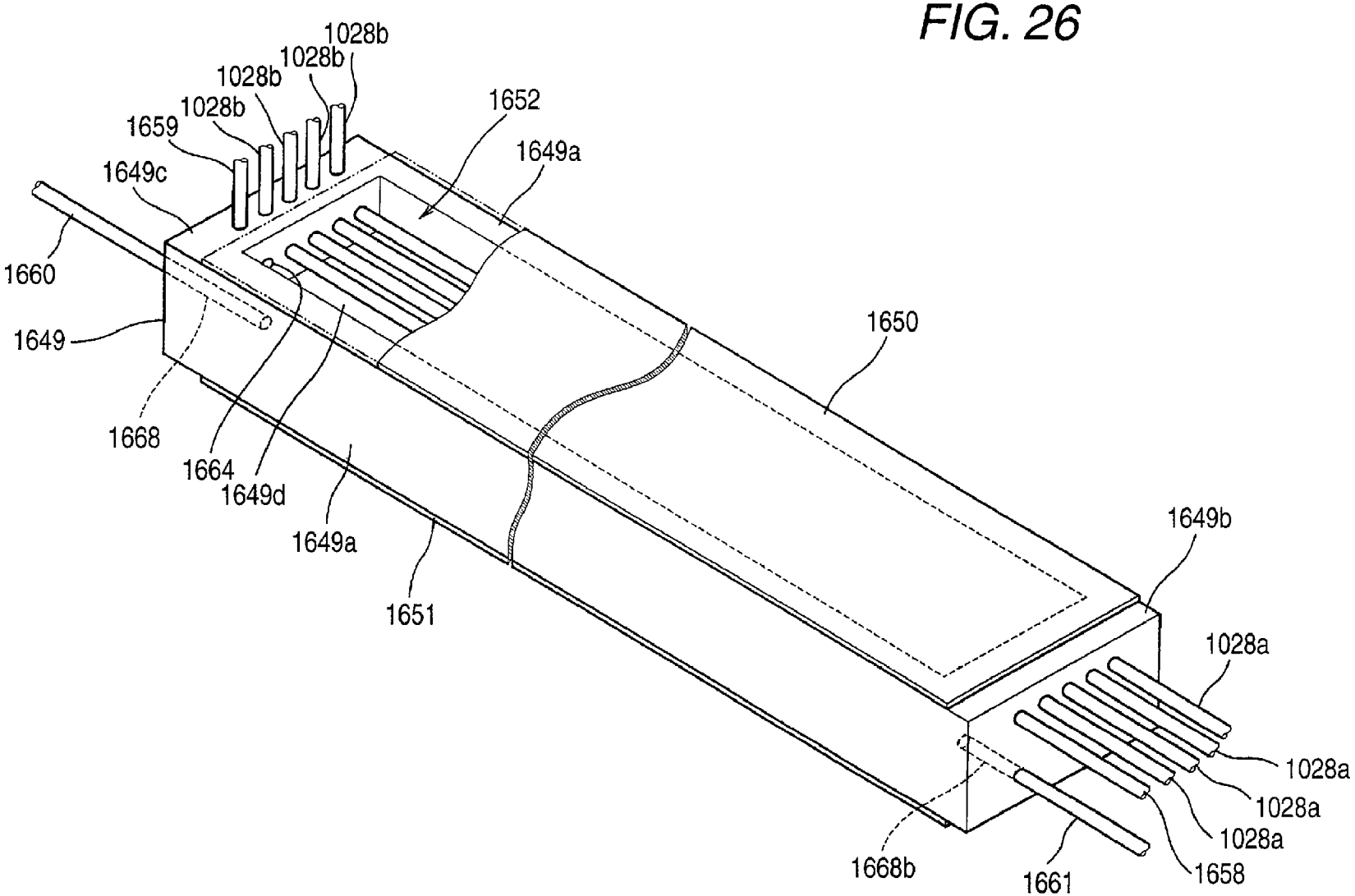
FIG. 26 is a perspective view of a tube holding member of the eleventh embodiment.
Figure 27:
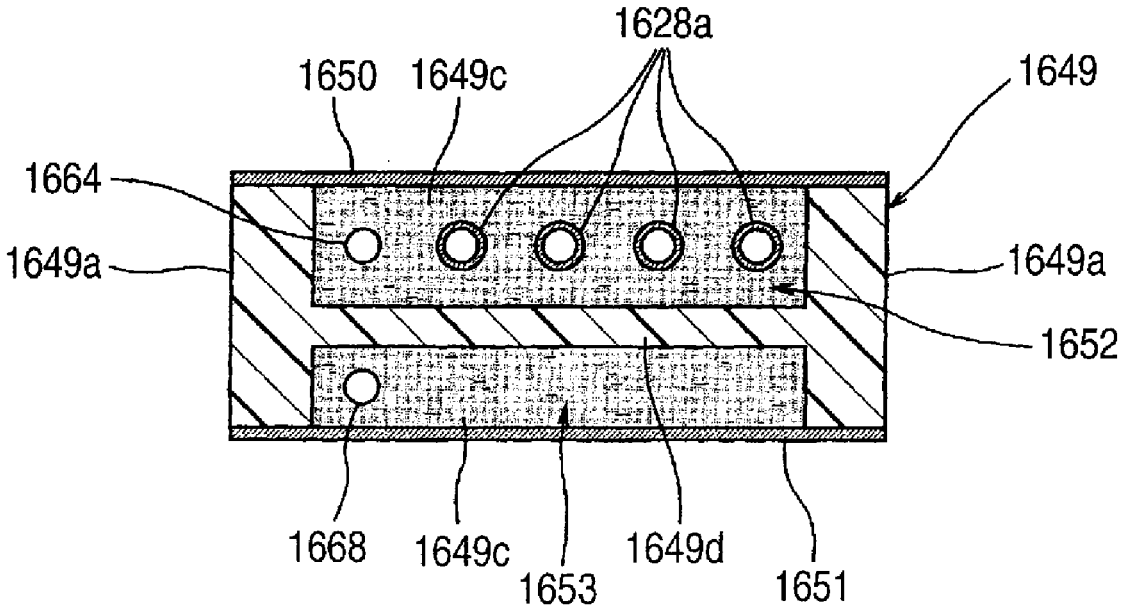
FIG. 27 is a view taken along the line connecting arrows M-XI of FIG. 25, and a sectional view of the tube holding member of the eleventh embodiment.

FIG. 26 is a perspective view of the tube holding member 1649 of the eleventh embodiment. FIG. 27 is a view taken along the line connecting arrows XI-XI of FIG. 25, and a sectional view of the tube holding member 1649 of the eleventh embodiment. This tube holding member 1649 as well is, in the same way as in the tube holding member 1030 of the sixth embodiment shown in FIGS. 19 and 20, formed of a material, such as elastomer, with elasticity and low moisture permeability. As shown in FIG. 26, the tube holding member 1649 has a pair of side walls 1649*a* and 1649*a* extending in a longitudinal direction, one end wall 1649*b* connecting one of the edges of the both side walls 1649*a* and 1649*a*, and other end wall 1649*c* connecting the other of the edges of the both side walls 1649*a* and 1649*a*, and has an intermediate wall 1649*d* partitioning a rectangular frame shaped space surrounded by the walls 1649*a*, 1649*a*, 1649*b*, and 1649*c* into two spaces. As shown in FIG. 27, the tube holding member 1649 is formed into an H lettered shape in section, and films 1650 and 1651 with low water permeability are bonded onto the tube holding member 1649 so as to cover the two open surfaces respectively. Accordingly, a first space 1652 surrounded by the inner faces of the both side walls 1649*a*, one plane of the intermediate wall 1649*d*, and the film 1650, and a second space 1653 surrounded by the inner faces of the both side walls 1649*a*, the other plane of the intermediate wall 1649*d*, and the film 1651 are formed.

As shown in FIG. 26, each of the respective cartridge side ink supply tubes 1028*a* is inserted into the one end wall 1649*b* of the tube holding member 1649 to extend along the extending direction of the side walls inside the first space 1652, and is pressed into the inner face of the other end wall 1649*c* of the tube holding member 1649. One end of the carriage side ink supply tube 1028*b* is connected to the outer face of the other end wall 1649*c*. An internal channel (not shown) through which the both ink supply tubes 1028*a* and 1028*b* are communicated with one another is formed inside the other end wall 1649*c*. Note that the four cartridge side ink supply tubes 1028*a* extend in a longitudinal direction so as to be arrayed at substantially even intervals between the both side walls 1649*a* and 1649*a* in the first space 1652.

Figure 28:
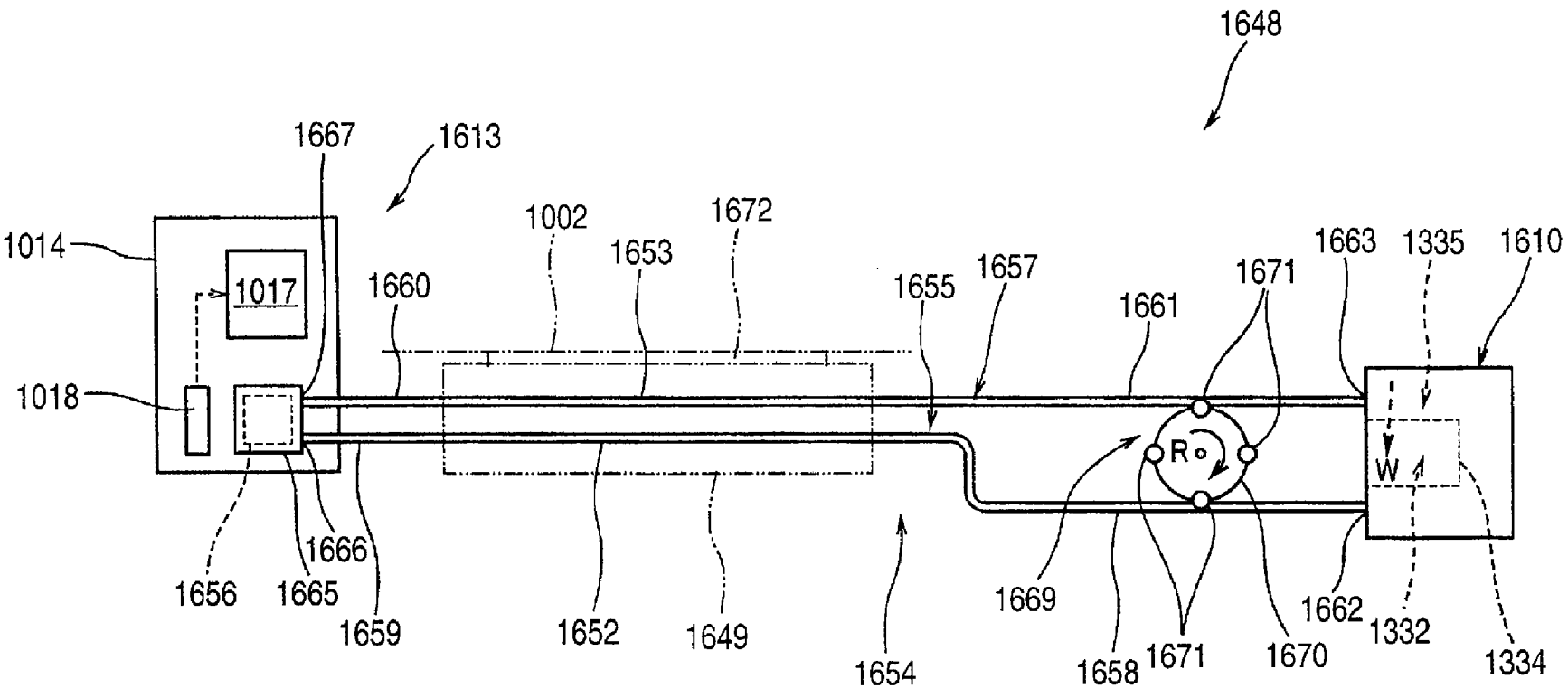
FIG. 28 is a schematic diagram for explanation of the structure of a cooling unit of the eleventh embodiment.

FIG. 28 is a schematic diagram for explanation of the structure of the cooling unit 1648 in the eleventh embodiment. As shown in FIG. 28, the cooling unit 1648 is configured to cool the periphery of an IC chip 1018 which is loaded on the carriage 1014 to control the driving of the piezoelectric actuator 1017 by using the aqueous solution stored in the water reservoir chamber 1335 in the ink cartridge 1610 as a coolant, This cooling unit 1648 includes a coolant tank 1665 forming a coolant chamber 1656 provided in the vicinity of the IC chip 1018 in the carriage 1014 to be capable of storing a coolant therein, a coolant circulation pathway 1654 composed of a coolant outward path 1655 and a coolant return path 1657 through which the water reservoir chamber 1335 of the ink cartridge 1610 is communicated with the coolant chamber 1656, and a pump 1669 that imparts dynamic pressure to the coolant in the coolant circulation pathway 1654.

FIG. 29 is a view taken along the line connecting arrows XIV-XIV of FIG. 22, and a sectional view illustrating the structure of the ink cartridge 1610 of the eleventh embodiment. As shown in FIG. 29, a water outflow hole 1662 and a water inflow hole 1663 through which the water reservoir chamber 1335 is communicated with the outside are provided at the ink cartridge 1610. A cartridge side coolant supply tube 1658 forming the coolant outward path 1655 is connected to the water outflow hole 1662, and a cartridge side coolant collection tube 661 forming the coolant return path 1657 is connected to the water inflow hole 1663 (refer to FIG. 28 as well). Note that the ends of the cartridge side coolant supply tube 1658, the cartridge side coolant collection tube 1661, and the cartridge side ink supply tube 1028*a* are supported by a support mechanism (not shown) to fix their disposition, and when the ink cartridge 1610 is mounted on the cartridge mounting part 1009, the cartridge side coolant supply tube 1658 is connected to the water outflow hole 1662, the cartridge side coolant collection tube 1661 is connected to the water inflow hole 1663, and the cartridge side ink supply tube 1028*a* is connected to the ink supply hole 1333, automatically. Then, valve mechanisms (not shown) which are usually closed and are connected to corresponding holes to be opened are provided inside the ends of these tubes 1658, 1661, and 1028*a*. With the valve mechanisms, when the ink cartridge 1610 is not mounted on the cartridge mounting part 1009, the aqueous solution in the coolant outward path and the coolant return path is prevented from leaking out of the tube, and the ink is prevented from leaking out of the tube. Further, valve mechanisms (not shown) which are usually closed and are connected to corresponding tubes to be opened are provided inside the water outflow hole 1662, the water inflow hole 1663, and the ink supply hole 1333 as well of the ink cartridge 1610.

As shown in FIG. 26, the cartridge side coolant supply-tube 1658 is pressed into the one end wall 1649*b* of the tube holding member 1649 to cause the coolant chamber 1656 to be communicated with the first space 1652. A carriage side coolant supply tube 1659 is connected to the other end wall 1649*c* of the tube holding member 1649 so as to be arrayed with the carriage side ink supply tube 1628*b*. The carriage side coolant supply tube 1659 is communicated with the first space 1652 via a through-hole 1664 formed inside the other end wall 1649*c*.

FIG. 30 is a view taken along the line connecting arrows XV-XV of FIG. 25, and a schematic diagram illustrating the structure of the image recording unit 1613 in a side sectional view. As shown in FIG. 30, the IC chip 1018 is loaded on the inner bottom face of the carriage 1014, and the coolant tank 1665 is installed between the IC chip 1018 and the ink sub-tank 1019. A water inflow hole 1666 and a water outflow hole 1667 through which the coolant chamber 1656 is communicated with the outside are provided at the coolant tank 1665. The carriage side coolant supply tube 1659 is connected to the water inflow hole 1666, and a carriage side coolant collection tube 1660 is connected to the water outflow hole 1667 (refer to FIG. 28 as well).

As shown in FIGS. 26 and 27, the carriage side coolant collection tube 1660 is connected to the other end wall 1649*c* of the tube holding member 1649, and is communicated with the second space 1653 via the through-hole 1668. Further, as shown in FIG. 26, the cartridge side coolant collection tube 1661 is connected to the one end wall 1649*b* of the tube holding member 1649. The cartridge side coolant collection tube 1661 is communicated with the second space 1653 via a through-hole 1668*b* formed inside the one end wall 1649*b*, and as described above, the cartridge side coolant collection tube 1661 is communicated with the water reservoir chamber 1335 via the water inflow hole 1663 of the ink cartridge 1610.

In this way, the coolant outward path 1655 is formed by the cartridge side coolant supply tube 1658, the first space 1652, and the carriage side coolant supply tube 1659, and the coolant return path 1657 is formed by the carriage side coolant collection tube 1660, the second space 1653, and the cartridge side coolant collection tube 1661 (refer to FIG. 28).

As shown in FIG. 25, the cartridge side coolant supply tube 1658 is disposed so as to be overlapped above and below with the cartridge side ink supply tube 1028*a*, and the carriage side coolant supply tube 1659 is disposed so as to be overlapped above and below with the carriage side ink supply tube 1028*b*. The cartridge side coolant supply tube 1658 and the cartridge side coolant collection tube 1661 respectively extend back and forth so as to be arrayed right and left between the ink cartridge 1610 and the one end wall 1649*b* of the tube holding member 1649. A pump 1669 is provided so as to be sandwiched by the both tubes 1658 and 1661. As the structure shown in FIG. 28, the pump 1669 is constituted by a tube pump, and is composed of a drum 1670 driven to rotate in a predetermined direction shown by arrow R, and a plurality of indenters 1671 provided as protrusions on the outer circumferential surface of the drum 1670, and the both tubes 1658 and 1661 are disposed so as to be crushed by the indenters 1671.

Further, as described above, the tube holding member 1649 is made to partially contact the inner side face of the housing 1002 to be bent. The tube holding member 1649 is disposed such that the side walls 1649*a* and 1649*a* are directed upward and downward, and the film 1650 forming the first space 1652 is directed toward the inner circumferential side of the bent tube holding member 1649, and the film 1651 forming the second space 1653 is directed toward the outer circumferential side thereof. Accordingly, a part of the film 1651 forming the second space 1653 comes into contact with the inner side face of the housing 1002. In contrast thereto, a heat sink 1672 formed such that a material with high heat conductivity such as aluminum is formed into a plate shape is attached to the portion contacting the film 1651 of the inner side face of the housing 1002 (refer to FIG. 28 as well). Note that, provided that the tube holding member 1649 is disposed in this way, because the four ink supply tubes 1028*a* come to be arrayed above and below between the both side walls 1649*a* and 1649*a*, the tubes can be led around at the same curvature.

In the printer 1603 including the cooling unit 1648, when the pump 1669 is driven, the aqueous liquid (coolant) in the water reservoir chamber 1335 flows toward the coolant chamber 1656 through the coolant outward path 1655. At this time, in the process in which the aqueous solution passes through the first space 1652, it is possible to suppress a rise in temperature of the ink in the cartridge side ink supply tube 1028*a*. Further, because the outside of the cartridge side ink supply tube 1028*a* is filled with the aqueous solution, it is possible to prevent the water of the ink in the cartridge side ink supply tube 1028*a* from evaporating (refer to FIGS. 26 and 27).

Further, because the coolant flown into the coolant chamber 1656 draws heat from the IC chip 1018, it is possible to suppress a rise in temperature around the discharge head 1015 in the carriage 1014.

Further, by driving the pump 1669, the coolant in the coolant chamber 1656 increased in temperature due to the heat exchange with the IC chip 1018 flows toward the water reservoir chamber 1335 through the coolant outward path 1657. At this time, in the process in which the coolant passes through the second space 1653, the heat is absorbed by the heat sink 1672 attached to the inner side face of the housing 1002. The coolant cooled in this way is guided to the water reservoir chamber 1335 via the cartridge side coolant collection tube 1661.

In the present embodiment as well, in the same way as in the third to tenth embodiments, the water of the aqueous solution in the water reservoir chamber 1335 is made to permeate the inside of the ink reservoir chamber 1332 via the ink pack 1334, and the water of the aqueous solution in the first space 1652 is made to permeate the inside of the tube via the cartridge side ink supply tube 1028*a*, which makes it possible to keep the concentration of the ink constant over a long period even if evaporation of the ink occurs, and to keep the viscosity of the ink constant over a long period. Accordingly, it is possible to stably perform an ink discharge operation by the discharge head 1015.

Moreover, it is possible to water-cool the periphery of the discharge head 1015 by using the aqueous solution therein as a coolant by the cooling unit 1648. In accordance therewith, it is possible to suppress a rise in temperature of the ink in the ink channel of the discharge head 1015 and the ink in the ink sub-tank 1019 disposed above the discharge head 1015. Accordingly, it is possible to prevent the viscosity of the ink from changing around the discharge head 1015, which makes it possible to more stably perform an ink discharge operation by the discharge head 15.

In this way, because the aqueous solution stored in the water reservoir chamber 1335 of the present embodiment is used as a coolant, a component effective as a coolant may be mixed therein. That is, high boiling point liquid such as glycerine may be mixed therein, or a microparticulated capsule filled with a phase-change material that makes a phase change under a temperature condition around the IC chip 1018 (for example, at 1020 to 1080 degrees) may be mixed therein.

To describe the timing of driving the pump 1669, because heat generation from the periphery of the carriage 1015 notably occurs when the piezoelectric actuator 1017 is controlled to drive by a circuit built in the IC chip 1018 to perform a printing operation, the driving of the pump 1669 may be performed simultaneously with the execution of the printing operation. In accordance therewith, cooling is carried out when heat generation notably occurs, and the pump 1669 is made to pause during another duration, which makes it possible to reduce electricity consumption and the like. Further, a temperature sensor capable of sensing a temperature around the discharge head 1015 to output temperature data denoting the temperature is loaded on the carriage 1014, and when it is judged that the temperature data is greater than a threshold temperature set in advance, the control for driving the pump 1669 may be carried out.

Next, a twelfth embodiment of the present invention will be described. The twelfth embodiment is different in a structure of a cooling unit 1748 from the eleventh embodiment. Note that structures which are the same as those of the above-described embodiment are denoted by the same reference numerals, and descriptions thereof will be simplified.

Figure 31:
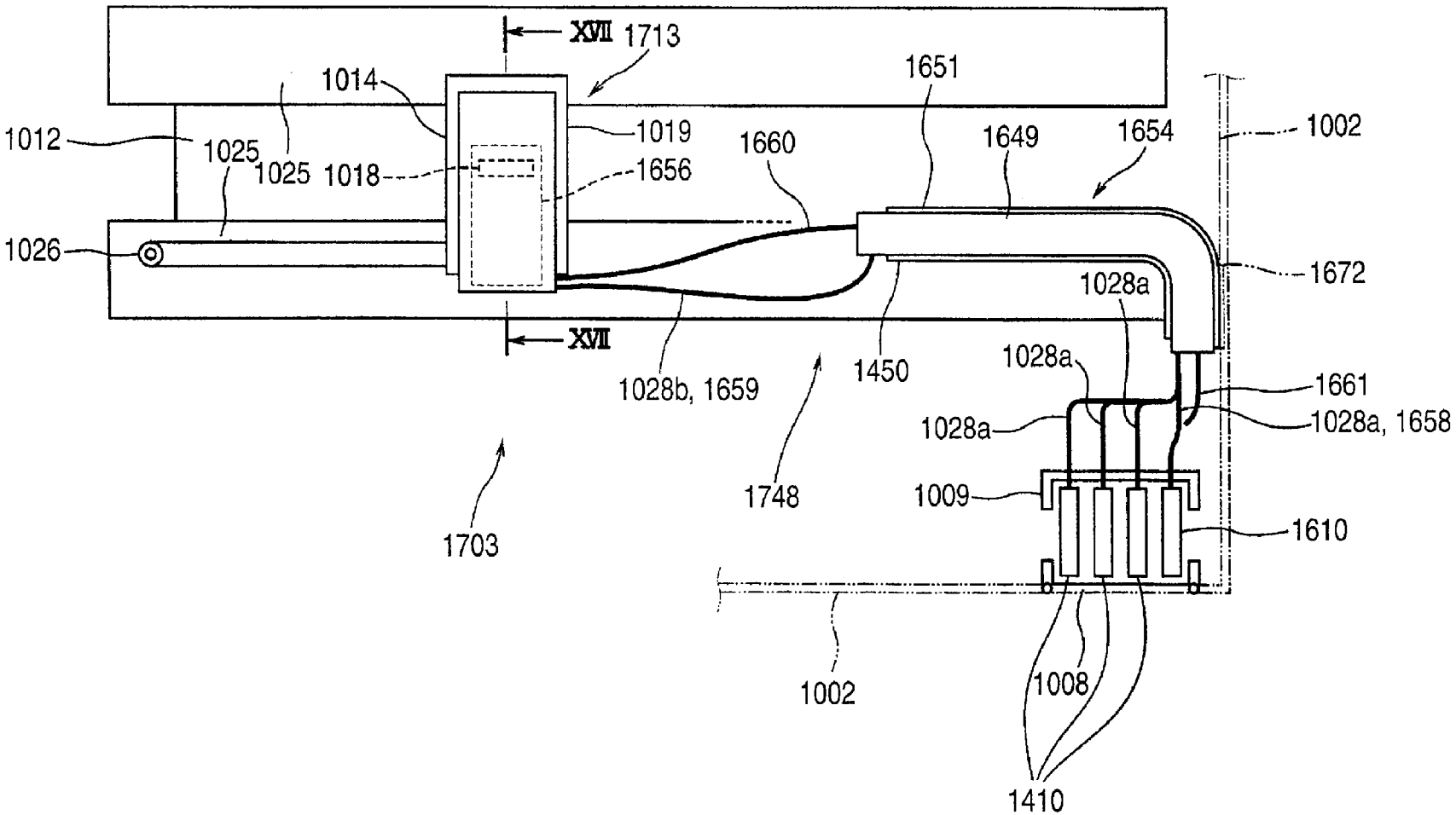
FIG. 31 is a schematic diagram illustrating the schematic structure of a printer of a twelfth embodiment in a plan view.
Figure 32:
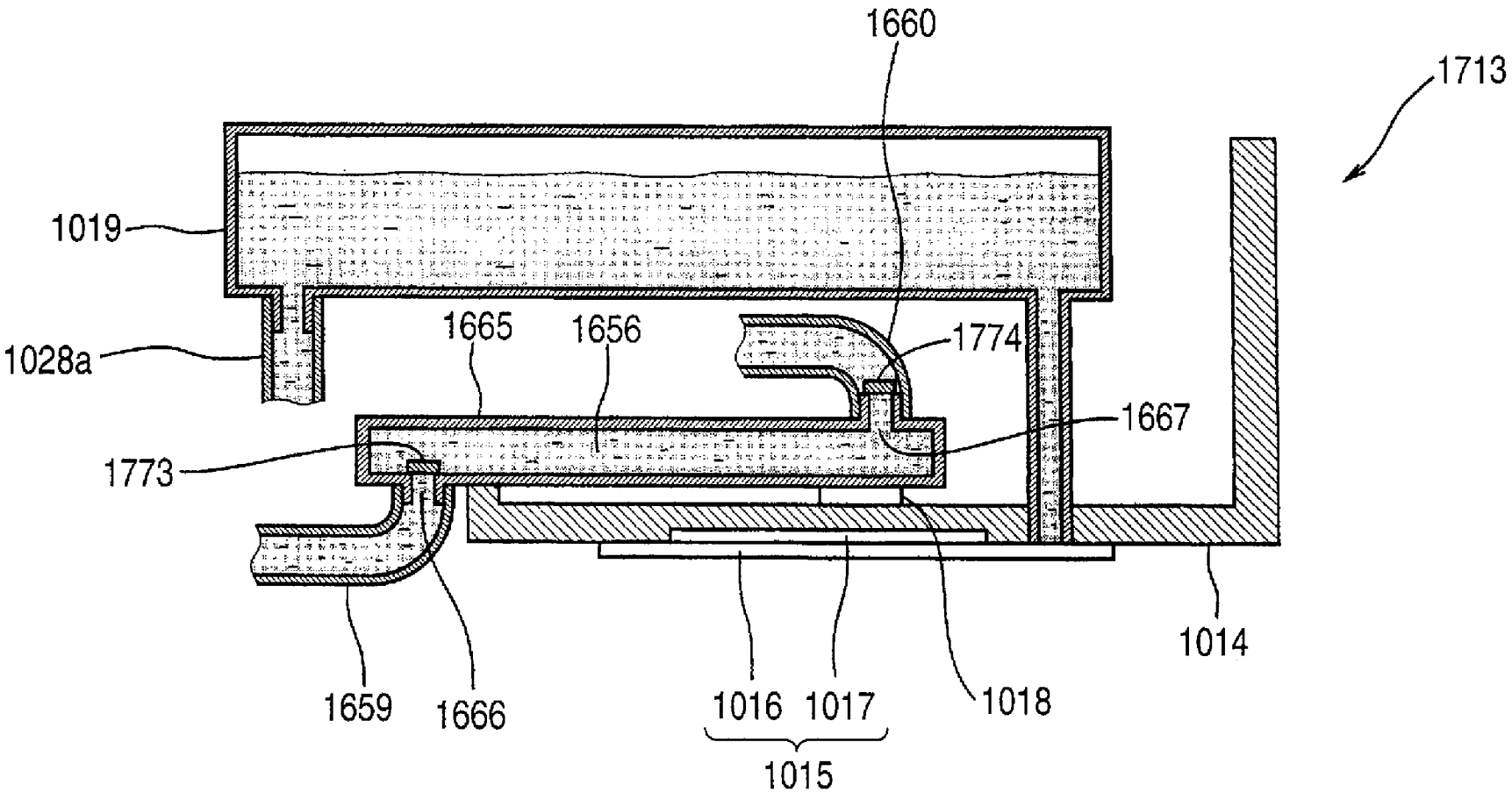
FIG. 32 is a view taken along the line connecting arrows XVII-XVII of FIG. 31, and a schematic diagram illustrating the structure of an image recording unit of the twelfth embodiment in a side sectional view.

FIG. 31 is a schematic diagram illustrating the schematic structure of a printer 1703 of the twelfth embodiment in a plan view. FIG. 32 is a view taken along the line connecting arrows XVII-XVII of FIG. 31, and a schematic diagram illustrating the structure of an image recording unit 1713 of the twelfth embodiment in a side sectional view. The cooling unit 1748 of the present embodiment shown in FIGS. 31 and 32, as can be understood by comparison with FIGS. 25 and 30 showing the eleventh embodiment, in place of the pump 1669 being omitted, an inflow side check valve 1773 is provided at the water inflow hole 1666 of the coolant chamber 1665, and an outflow side check valve 1774 is provided at the water outflow hole 1667. The other structures of the ink cartridge 1610, the coolant circulation pathway 1654, the tube holding member 1649, the heat sink 1672, and the like are the same as those of the cooling unit 1648 in the eleventh embodiment.

As shown in FIG. 31, the carriage side coolant supply tube 1659 and the carriage side coolant collection tube 1660 extend to the right which is one side of the running direction of the carriage 1014 from the image recording unit 1713. Note that the carriage side coolant supply tube 1659 and the carriage side coolant collection tube 1660 may extend toward any side of the running direction of the carriage 1014, and may extend to the left.

As shown in FIG. 32, the water inflow hole 1666 of the coolant tank 1665 is formed in the bottom face, and the coolant in the carriage side coolant supply tube 1659 flows from the lower side to the upper side through the water inflow hole 1666 to flow into the coolant chamber 1656. Further, the water outflow hole 1667 of the coolant tank 1665 is formed in the top face, and the coolant in the coolant chamber 1656 flows from the lower side to the upper side out of the water outflow hole 1667 to the carriage side coolant collection tube 1660. The inflow side check valve 1773 is composed of a valve element placed so as to block the opening at the upper side of the water inflow hole 1666, and the outflow side check valve 1774 is composed of a valve element placed so as to block the opening at the upper side of the water outflow hole 1667. The valve elements have a specific gravity greater than that of the coolant, and are made lightweight so as to be floatable due to the dynamic pressure of the coolant.

Figure 33A:
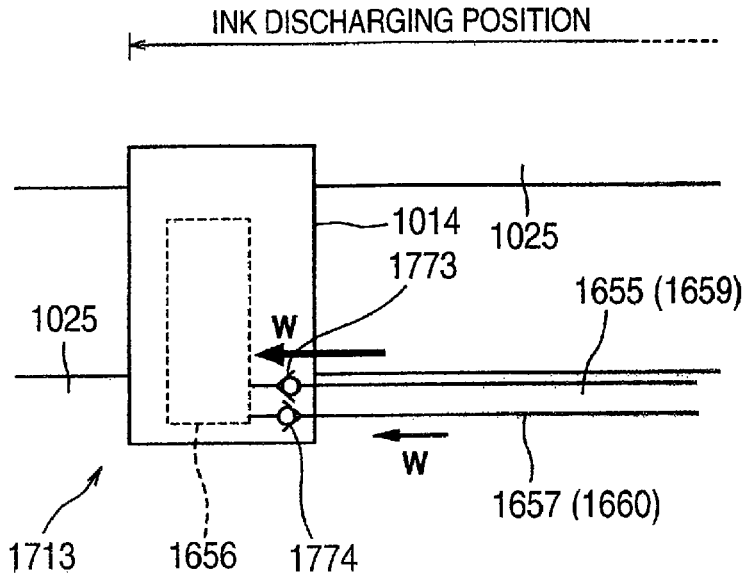
FIG. 33A shows a state in which the carriage is located on the extreme left in the ink discharging position.
Figure 33B:
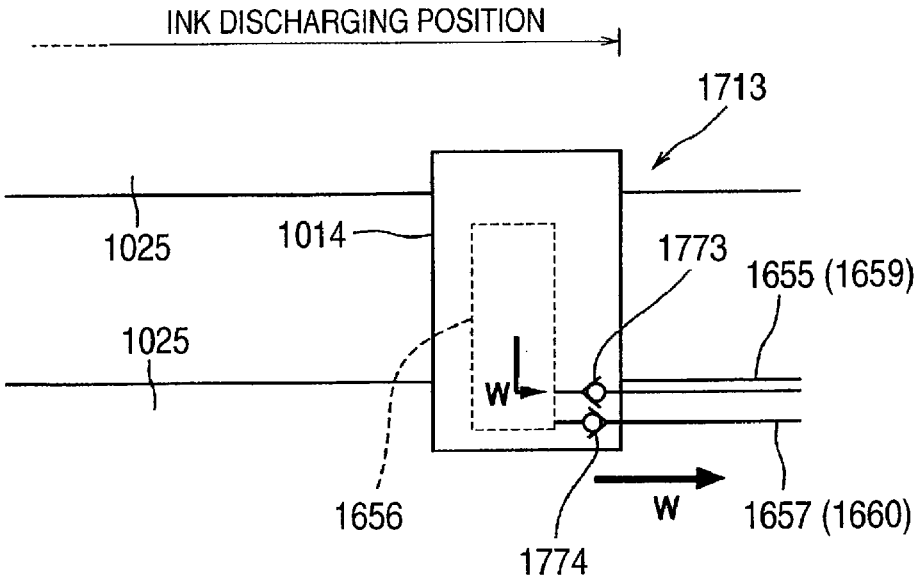
FIG. 33B shows a state in which the carriage is located on the extreme right in the ink discharging position.

FIG. 33 is an action diagram for explanation of an operation for circulating the coolant in the present embodiment. FIG. 33A shows a state in which the carriage 1014 is located on the extreme left in the ink discharging position in order to turn its traveling direction to the right, and FIG. 33B shows a state in which the carriage 1014 is located on the extreme right in the ink discharging position in order to turn its traveling direction to the left. Note that, when the printer 1703 performs a printing operation, the carriage 1014 reciprocates from side to side within the ink discharging position. However, the carriage 1014 makes a substantially uniform motion at the intermediate portion in the ink discharging position.

As shown in FIG. 33A, when the carriage 1014 moving to the left turns its traveling direction to the right, after the carriage 1014 reduces its traveling speed at a predetermined deceleration to stop on the extreme left, the carriage 1014 accelerates at a predetermined acceleration to move to the right. Accordingly, inertia force toward the left is applied to the coolant in the carriage side coolant supply tube 1659 and the carriage side coolant collection tube 1660 which are provided so as to extend from the carriage 1014 to the right. Therefore, the coolant in the tubes 1659 and 1660 makes an attempt to flow by receiving the dynamic pressure according to this inertia force as shown by arrow W. That is, the coolant in the carriage side coolant supply tube 1659 flows from the lower side to the upper side through the water inflow hole 1666, and the dynamic pressure floats the valve element of the inflow side check valve 1773 against gravitational force of the inflow side check valve 1773 to open the inflow side check valve 1773, and the coolant flows into the coolant chamber 1656. The coolant in the carriage side coolant collection tube 1660 makes an attempt to flow from the upper side to the lower side through the water outflow hole 1667. However, because the valve element of the inflow side check valve 1774 blocks the opening of the water outflow hole 1667, the coolant does not counterflow into the coolant chamber 1656.

As shown in FIG. 33B, when the carriage 1014 moving to the right turns its traveling direction to the left, after the carriage 1014 reduces its traveling speed at a predetermined deceleration to stop on the extreme right, the carriage 1014 accelerates at a predetermined acceleration to move to the left. Accordingly, inertia force toward the right is applied to the coolant in the carriage side coolant supply tube 1659 and the carriage side coolant collection tube 1660. Therefore, the coolant in the tubes 1659 and 1660 makes an attempt to flow by receiving the dynamic pressure according to this inertia as shown by arrow W. That is, the coolant in the carriage side coolant collection tube 1660 makes an attempt to flow from the lower side to the upper side through the water outflow hole 1667, and the dynamic pressure floats the valve element of the outflow side check valve 1774 against gravitational force of the outflow side check valve 1774 to open the outflow side check valve 1774, and the coolant flows into the carriage side coolant collection tube 1660. The coolant in the carriage side coolant supply tube 1659 makes an attempt to flow from the upper side to the lower side through the water inflow hole 1666. However, because the valve element of the inflow side check valve 1773 blocks the opening of the water inflow hole 1666, the coolant does not counterflow from the inside of the coolant chamber 1656 into the carriage side coolant supply tube 1659.

In this way, when the carriage 1014 is made to reciprocate from side to side according to the execution of a printing operation, the coolant flows in the coolant circulation pathway 1654 with the inertia force applied thereto in accordance with acceleration and deceleration at the time of turning its direction as dynamic pressure. At this time, the coolant is prevented from counterflowing by the check valves 1773 and 1774, and the coolant in the coolant circulation pathway 1654 flows in one direction to be circulated. Note that, because the tubes 1659 and 1660 are provided so as to extend in the running direction of the carriage 1014 from the carriage 1014, and the direction in which the dynamic pressure generated by the inertia force according to the acceleration and deceleration of the carriage 1014 is generated and the direction in which the tubes 1659 and 1660 extend are made parallel to one another, it is possible to smoothly perform the circulation of the coolant by utilizing the reciprocation of the carriage 1014.

In this way, in the present embodiment, a dedicated driving source for circulating the coolant is not necessary, which makes it possible to form the cooling unit 1748 compact. However, the present embodiment may be configured such that the pump 1669 as well in the eleventh embodiment is provided, and the coolant is circulated even while the carriage 1014 does not move.

Note that, in the third to tenth embodiments, permeation of the aqueous solution in the tube housing space may not be carried out, and only permeation of the aqueous solution in the ink cartridge may be carried out, and a permeable amount and an amount of evaporation in the ink cartridge may be set to be equal.

As described above, a liquid discharge apparatus according to the present invention includes a discharge head that discharges a first liquid supplied via a liquid supply tube from a liquid tank, and in the apparatus, the liquid tank has a first liquid reservoir chamber that stores the first liquid and a second liquid reservoir chamber that stores a second liquid whose solvent is the same as that of the first liquid and whose concentration is lower than that of the first liquid, the liquid tank is partitioned by a partition wall that partitions an inside into the first liquid reservoir chamber and the second liquid reservoir chamber, and at least a part of the partition wall has liquid permeability and a solvent for the second liquid stored in the second liquid reservoir chamber is made capable of permeating the inside of the first liquid reservoir chamber via the partition wall.

In accordance with this structure, the solvent for the second liquid permeates the inside of the first liquid reservoir chamber via the partition wall in the liquid tank, which makes it possible to decrease a concentration of the first liquid stored in the first liquid reservoir chamber. Note that, because the components of solvents for the first liquid and the second liquid are the same, even if the solvent for the second liquid permeates the inside of the first liquid reservoir chamber, the composition of the first liquid is not changed, and the concentration thereof is simply changed. Accordingly, even if the solvent for the first liquid evaporates outside the liquid tank for example, it is possible to prevent the viscosity of the first liquid from increasing.

Further, the apparatus may be configured such that a concentration of the second liquid is set to a concentration in which the solvent for the second liquid is made capable of permeating the inside of the first liquid reservoir chamber via the partition wall due to a concentration difference between the first liquid and the second liquid.

In this way, by adjusting the concentration of the second liquid in view of the concentration of the first liquid, it is possible to easily achieve the permeation of the solvent via the partition wall.

Further, the apparatus may be configured such that the concentration of the second liquid, a thickness of the liquid supply tube, and a thickness and a surface area of at least a part of the partition wall are set so as to equalize an amount of a solvent for the first liquid evaporating via the liquid supply tube per unit time and an amount of the second liquid permeating the first liquid reservoir chamber per unit time.

In accordance with this structure, the concentration of the first liquid can be kept constant over a long period, and as a result, the viscosity thereof can be kept constant over a long period. Note that, because an evaporation rate of the solvent for the first liquid can be predicted in advance when a component of the first liquid to be used and the design for the liquid supply tube are determined, by only taking into consideration the concentration of the second liquid and design parameters for the partition wall according to those, it is possible to provide a liquid discharge apparatus capable of preventing an increase in the viscosity in this way.

Further, the apparatus may be configured such that the liquid tank is mounted to a main body of the liquid discharge apparatus so as to be detachable and replaceable, and has an initial liquid reservoir chamber which is independent of the first liquid reservoir chamber and is communicated with the second liquid reservoir chamber through a small opening, and an atmosphere open hole through which the initial liquid reservoir chamber is communicated with the atmosphere, before the liquid tank is mounted, the atmosphere open hole is sealed up, the second liquid is stored in the initial liquid reservoir chamber, and inner pressure in the second liquid reservoir chamber is negative pressure as compared with the atmosphere pressure, and when the liquid tank is mounted, the atmosphere open hole is opened, and the second liquid stored in the initial liquid reservoir chamber flows into the second liquid reservoir chamber via the small opening.

In accordance with this structure, in a case in which the liquid tank is formed as a cartridge type, the second liquid is made to not flow into the second liquid reservoir chamber from the manufacturing time until the liquid tank is mounted to the apparatus main body, and the second liquid flows into the second liquid reservoir chamber when the liquid tank is mounted. Therefore, during a period from the manufacturing time until the liquid tank is mounted to the apparatus main body, the solvent for the second liquid does not permeate the inside of the first liquid reservoir chamber, which makes it possible to keep the concentration of the first liquid in an appropriate state.

Further, the apparatus may be configured such that the second liquid reservoir chamber is communicated with an upper liquid reservoir unit which is provided at a position higher than the second liquid reservoir chamber to be opened to the atmosphere, and water head pressure determined according to a vertical interval between the upper liquid reservoir chamber and the second liquid reservoir chamber is applied to the solvent for the second liquid stored in the second liquid reservoir chamber.

In accordance with this structure, liquid pressure of the second liquid stored in the second liquid reservoir chamber is influenced by a vertical interval between the second liquid reservoir chamber and the liquid reservoir unit, and a permeation rate of the solvent for the second liquid is determined according to the liquid pressure. Therefore, the permeation rate can be adjusted by adjusting the vertical interval, which makes it possible to more precisely control the viscosity of the first liquid. Further, in a case in which the component of the first liquid is changed, it is possible to equalize an evaporation rate and a permeation rate by merely changing the vertical interval without changing the design parameters for the partition wall.

Further, the apparatus may be configured such that the liquid tank has an inflow hole and an outflow hole to be communicated with the second liquid reservoir chamber, a liquid circulation path that connects the inflow hole and the outflow hole to the outside of the liquid tank to circulate the second liquid is provided, and a part of the liquid circulation path is disposed around the discharge head.

In accordance with this structure, it is possible to water-cool the discharge head by utilizing the second liquid. Therefore, it is possible to prevent a rise in temperature of the first liquid supplied to the vicinity of the discharge head, and to prevent a change in the viscosity of the first liquid according to a change in temperature.

Further, the apparatus may be configured such that the discharge head is configured to reciprocate in a predetermined direction to perform an operation of discharging liquid, and inertia force generated at the time of acceleration and deceleration according to the reciprocation of the discharge head is applied to the second liquid in the liquid circulation path, check valves that allow the second liquid to move from the inflow hole side to the outflow hole side, and prevent the second liquid from moving from the outflow hole side to the inflow hole side are provided in the liquid circulation path. Further, the apparatus may further include a pump means for imparting pressure to the second liquid in the liquid circulation path to move the second liquid.

In accordance with these structures, a structure in which the second liquid is circulated via the liquid circulation path can be realized, and a structure to cool the discharge head by water-cooling can be realized.

Further, the apparatus may be configured such that the pump means operates at least when the discharge head performs an operation of discharging liquid.

In accordance with this structure, it is possible to efficiently cool heat generation around the discharge head generated in operation of the discharge head, which makes it possible to eliminate waste of operation time of the pump means.

Further, the apparatus may be configured such that the part of the liquid circulation path is disposed so as to be able to contact a support member that supports the discharge head.

In accordance with this structure, it is possible to change heat between the second liquid which increases in temperature by passing around the discharge head and the support member, which makes it possible to cool the second liquid.

Further, the apparatus may be configured such that part of the liquid circulation path is provided so as to surround the liquid supply tube.

In accordance with this structure, because the periphery of the liquid supply tube is permeated with the second liquid, it is hard for the outside air to invade the inside of the liquid supply tube. In accordance therewith, it is hard for the air to invade the discharge head.

In accordance with the liquid discharge apparatus according to the present invention, it is possible to prevent an increase in the viscosity of the first liquid discharged by the discharge head, which makes it possible to stably perform a discharge operation by the discharge head.

Further, a liquid discharge apparatus according to the present invention includes a discharge head that discharges a first liquid and a liquid supply tube that supplies the first liquid to the discharge head from a liquid tank storing the first liquid therein, the liquid discharge apparatus further includes a liquid circulation path through which a second liquid whose solvent is the same as that of the first liquid and whose concentration is lower than that of the first liquid is circulated, and in the apparatus, the liquid supply tube has liquid permeability, by providing the liquid circulation path so as to surround at least a part of the liquid supply tube, the second liquid circulating in the liquid circulation path circulates while contacting the outer surface of the liquid supply tube, and a solvent for the second liquid is made capable of permeating the liquid supply tube.

In accordance with this structure, the solvent for the second liquid permeates the liquid supply tube, which makes it possible to decrease a concentration of the first liquid in the liquid supply tube. Note that, because the components of solvents for the first liquid and the second liquid are the same, even if the solvent for the second liquid permeates the liquid supply tube, the composition of the first liquid is not changed, and the concentration thereof is simply changed. Accordingly, even if the solvent for the first liquid evaporates via the portion which is not surrounded by the liquid circulation path of the liquid supply tube, it is possible to prevent the viscosity of the first liquid from increasing.

Further, the apparatus may be configured such that a concentration of the second liquid is set to a concentration in which the solvent for the second liquid is made capable of permeating the inside of the first liquid reservoir chamber via the liquid supply tube due to a concentration difference between the first liquid and the second liquid.

In this way, by adjusting the concentration of the second liquid in view of the concentration of the first liquid, it is possible to easily achieve the permeation of the solvent via the liquid supply tube.

Further, the apparatus may be configured such that the concentration of the second liquid, a thickness of the liquid supply tube, and a surface area of a portion surrounded by the liquid circulation path of the liquid supply tube are set so as to equalize an amount of a solvent for the first liquid evaporating via the liquid supply tube per unit time and an amount of the solvent for the second liquid permeating per unit time.

In accordance with this structure, the concentration of the first liquid can be kept constant over a long period, and as a result, the viscosity thereof can be kept constant over a long period. Note that, because an evaporation rate of the solvent for the first liquid can be predicted in advance when a component of the first liquid to be used and the design for the liquid supply tube are determined, by only taking into consideration the concentration of the second liquid and design parameters for the liquid supply tube, it is possible to provide a liquid discharge apparatus capable of preventing an increase in the viscosity in this way.

Further, the apparatus may be configured such that the liquid circulation path is connected to an upper liquid reservoir unit opened to the atmosphere, and water head pressure determined according to a vertical interval between the upper liquid reservoir unit and the liquid circulation path is applied to the second liquid circulating in the liquid circulation path.

In accordance with this structure, liquid pressure of the second liquid circulating in the liquid circulation path is influenced by a vertical interval between the liquid circulation path and the upper liquid reservoir chamber, and a permeation rate of the solvent for the second liquid is determined according to the liquid pressure. Therefore, the permeation rate can be adjusted by adjusting the vertical interval, which makes it possible to more precisely control the viscosity of the first liquid. Further, in a case in which the component of the first liquid is changed, it is possible to equalize an evaporation rate and a permeation rate by merely changing the vertical interval without changing the design parameters for the liquid supply tube.

Further, the apparatus may further include a pump means for imparting pressure to the second liquid in the liquid circulation path.

In accordance with this structure, the liquid pressure of the second liquid circulating in the liquid circulation path is increased by the pump means, and a permeation rate of the solvent for the second liquid is determined in accordance with the pressure. Accordingly, a permeation rate can be adjusted by adjusting a driving force of the pump means, which makes it possible to more precisely control the viscosity of the first liquid. Further, in a case in which the component of the first liquid is changed, it is possible to equalize an evaporation rate and a permeation rate by merely changing driving force of the pump means without changing the design parameters for the liquid supply tube.

Further, the apparatus may be configured such that the solvents for the first liquid and the second liquid are water, and the first liquid is aqueous ink.

In accordance with this structure, it is possible to provide a liquid discharge apparatus capable of preventing the aqueous ink from increasing its viscosity. Further, in view of the liquid permeability (in this case, water permeability), it is possible to appropriately select a material for the liquid supply tube.

In accordance with the liquid discharge apparatus according to the present invention, it is possible to prevent an increase in the viscosity of the first liquid discharged by the discharge head, which makes it possible to stably perform a discharge operation by the discharge head.

What is claimed is:

1. A liquid discharge apparatus comprising a discharge head that discharges a first liquid supplied via a liquid supply tube from a liquid tank, wherein the liquid tank has a first liquid reservoir chamber that stores the first liquid and a second liquid reservoir chamber that stores a second liquid whose solvent is the same as that of the first liquid and whose concentration is lower than that of the first liquid, the liquid tank is partitioned by a partition wall that partitions an inside into the first liquid reservoir chamber and the second liquid reservoir chamber, and at least a part of the partition wall comprises a permeable film which has liquid permeability and which allows a solvent for the second liquid stored in the second liquid reservoir chamber to pass therethrough and enter the inside of the first liquid reservoir chamber via the part of the partition wall, wherein the concentration of the second liquid is set to a concentration in which the solvent for the second liquid permeates the inside of the first liquid reservoir chamber via the partition wall due to a concentration difference between the first liquid and the second liquid.

2. The liquid discharge apparatus according to claim 1, wherein the concentration of the second liquid, a thickness of the liquid supply tube, and a thickness and a surface area of at least the part of the partition wall are set such that an amount of a solvent for the first liquid evaporating via the liquid supply tube per unit time equals an amount of the second liquid permeating the first liquid reservoir chamber per unit time.

3. The liquid discharge apparatus according to claim 1, wherein the liquid tank is mounted to a main body of the liquid discharge apparatus so as to be detachable and replaceable, the liquid tank has an initial liquid reservoir chamber which is independent of the first liquid reservoir chamber and is communicated with the second liquid reservoir chamber via a small opening, and an atmosphere open hole through which the initial liquid reservoir chamber communicates with the atmosphere, before the liquid tank is mounted, the atmosphere open hole is sealed up, the second liquid is stored in the initial liquid reservoir chamber, and inner pressure in the second liquid reservoir chamber is negative pressure as compared with the atmosphere pressure, and when the liquid tank is mounted, the atmosphere open hole is opened, and the second liquid stored in the initial liquid reservoir chamber flows into the second liquid reservoir chamber via the small opening.

4. The liquid discharge apparatus according to claim 1, wherein the second liquid reservoir chamber communicates with an upper liquid reservoir unit which is provided at a position higher than the second liquid reservoir chamber in a vertical direction perpendicular to a liquid surface of the second liquid stored in the second liquid reservoir, the upper liquid reservoir unit is open to the atmosphere, and water head pressure determined according to a distance in the vertical direction between the upper liquid reservoir unit and the second liquid reservoir chamber is applied to the solvent for the second liquid stored in the second liquid reservoir chamber.

5. The liquid discharge apparatus according to claim 1, wherein the liquid tank has an inflow hole and an outflow hole to be communicated with the second liquid reservoir chamber, a liquid circulation path that connects the inflow hole and the outflow hole to the outside of the liquid tank to circulate the second liquid is provided, and a part of the liquid circulation path is disposed around the discharge head.

6. The liquid discharge apparatus according to claim 5, wherein the discharge head is configured to reciprocate in a predetermined direction to perform an operation of discharging liquid, wherein inertia force generated at the time of acceleration and deceleration according to the reciprocation of the discharge head is applied to the second liquid in the liquid circulation path, and wherein the liquid circulation path comprises check valves that allow the second liquid to move from the inflow hole side to the outflow hole side, and prevent the second liquid from moving from the outflow hole side to the inflow hole side in the liquid circulation path.

7. The liquid discharge apparatus according to claim 5, further comprising:

a pump unit for imparting pressure to the second liquid in the liquid circulation path to move the second liquid.

8. The liquid discharge apparatus according to claim 7, wherein the pump unit operates at least when the discharge head performs an operation of discharging liquid.

9. The liquid discharge apparatus according to claim 5, wherein the part of the liquid circulation path is disposed so as to be able to contact a support member that supports the discharge head.

10. The liquid discharge apparatus according to claim 5, wherein the part of the liquid circulation path is provided so as to surround the liquid supply tube.

11. A liquid discharge apparatus comprising:

a discharge head that discharges a first liquid;

a liquid supply tube that supplies the first liquid to the discharge head from a liquid tank storing the first liquid; and a liquid circulation path through which a second liquid whose solvent is the same as that of the first liquid and whose concentration is lower than that of the first liquid is circulated, wherein the liquid supply tube comprises a portion which has a greater liquid permeability than a liquid permeability of the other portion of the liquid supply tube, the liquid circulation path is configured to surround at least the portion of the liquid supply tube, the second liquid circulating in the liquid circulation path circulates while contacting the outer surface of the liquid supply tube, and a solvent for the second liquid permeates the portion of the liquid supply tube to enter into the liquid supply tube.

12. The liquid discharge apparatus according to claim 11, wherein a concentration of the second liquid is set to a concentration in which the solvent for the second liquid is capable of permeating the inside of the first liquid reservoir chamber via the liquid supply tube due to a concentration difference between the first liquid and the second liquid.

13. The liquid discharge apparatus according to claim 11, wherein the concentration of the second liquid, a thickness of the liquid supply tube, and a surface area of a portion surrounded by the liquid circulation path of the liquid supply tube are set such that an amount of a solvent for the first liquid evaporating via the liquid supply tube per unit time equals an amount of the solvent for the second liquid permeating per unit time.

14. The liquid discharge apparatus according to claim 11, wherein the liquid circulation path is connected to an upper liquid reservoir unit opened to the atmosphere, and water head pressure, determined according to a distance between the upper liquid reservoir unit and the liquid circulation path in a vertical direction perpendicular to a liquid surface of the second liquid stored in the upper liquid reservoir unit, is applied to the second liquid circulating in the liquid circulation path.

15. The liquid discharge apparatus according to claim 11, further comprising:

a pump unit for imparting pressure to the second liquid in the liquid circulation path.

16. The liquid discharge apparatus according to claim 11, wherein the solvents for the first liquid and the second liquid are water, and the first liquid is aqueous ink.

17. A liquid tank for storing a first liquid that is supplied to a discharge head via a liquid supply tube, comprising:

a first liquid reservoir chamber that stores the first liquid;

a second liquid reservoir chamber that stores a second liquid whose solvent is the same as that of the first liquid and whose concentration is lower than that of the first liquid, and a partition wall that partitions an inside of the liquid tank into the first liquid reservoir chamber and the second liquid reservoir chamber, wherein at least a part of the partition wall comprises a permeable film which has liquid permeability and which allows a solvent for the second liquid stored in the second liquid reservoir chamber to pass therethrough and to enter the inside of the first liquid reservoir chamber via the part of the partition wall, wherein the concentration of the second liquid is set to a concentration in which the solvent for the second liquid permeates the inside of the first liquid reservoir chamber via the partition wall due to a concentration difference between the first liquid and the second liquid.

18. The liquid tank according to claim 17, wherein the concentration of the second liquid, a thickness of the liquid supply tube, and a thickness and a surface area of at least the part of the partition wall are set such that an amount of a solvent for the first liquid evaporating via the liquid supply tube per unit time equals an amount of the second liquid permeating the first liquid reservoir chamber per unit time.

19. The liquid tank according to claim 17, wherein the liquid tank is mounted to a main body of a liquid discharge apparatus so as to be detachable and replaceable, the liquid tank has an initial liquid reservoir chamber which is independent of the first liquid reservoir chamber and is communicated with the second liquid reservoir chamber via a small opening, and an atmosphere open hole through which the initial liquid reservoir chamber communicates with the atmosphere, before the liquid tank is mounted, the atmosphere open hole is sealed up, the second liquid is stored in the initial liquid reservoir chamber, and inner pressure in the second liquid reservoir chamber is negative pressure as compared with the atmosphere pressure, and when the liquid tank is mounted, the atmosphere open hole is opened, and the second liquid stored in the initial liquid reservoir chamber flows into the second liquid reservoir chamber via the small opening.

* * * * *